US011313013B2

(12) United States Patent
Oishi et al.

(10) Patent No.: US 11,313,013 B2
(45) **Date of Patent: *Apr. 26, 2022**

(54) FREE-CUTTING COPPER ALLOY AND METHOD FOR PRODUCING FREE-CUTTING COPPER ALLOY

(71) Applicant: MITSUBISHI MATERIALS CORPORATION, Tokyo (JP)

(72) Inventors: Keiichiro Oishi, Osaka (JP); Kouichi Suzaki, Osaka (JP); Shinji Tanaka, Osaka (JP); Yoshiyuki Goto, Osaka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 135 days.

This patent is subject to a terminal disclaimer.

(21) Appl. No.: 16/324,684

(22) PCT Filed: Aug. 15, 2017

(86) PCT No.: PCT/JP2017/029369

§ 371 (c)(1),
(2) Date: Feb. 11, 2019

(87) PCT Pub. No.: WO2018/034280

PCT Pub. Date: Feb. 22, 2018

(65) Prior Publication Data

US 2019/0169711 A1 Jun. 6, 2019

(30) Foreign Application Priority Data

Aug. 15, 2016 (JP) ..... JP2016-159238

(51) Int. Cl.

| | |
|---|---|
| ***C22C 9/04*** | (2006.01) |
| ***C22F 1/00*** | (2006.01) |
| ***C22F 1/08*** | (2006.01) |

(52) U.S. Cl.
CPC ..... *C22C 9/04* (2013.01); *C22F 1/002* (2013.01); *C22F 1/08* (2013.01)

(58) Field of Classification Search
CPC ..... C22C 9/04; C22F 1/002; C22F 1/08
See application file for complete search history.

(56) References Cited

U.S. PATENT DOCUMENTS 4,055,445 A 10/1977 Pops
5,865,910 A 2/1999 Bhargava
(Continued)

FOREIGN PATENT DOCUMENTS

CA 2 582 972 A1 4/2006
EP 1 045 041 A1 10/2000
(Continued)

OTHER PUBLICATIONS

Office Action issued in co-pending U.S. Appl. No. 16/274,622 dated Aug. 26, 2019.
(Continued)

*Primary Examiner* — Robert S Jones, Jr.
*Assistant Examiner* — Jiangtian Xu
(74) *Attorney, Agent, or Firm* — Merchant & Gould P.C.

(57) ABSTRACT

This free-cutting copper alloy contains more than 77.0% but less than 81.0% Cu, more than 3.4% but less than 4.1% Si, 0.07% to 0.28% Sn, 0.06% to 0.14% P, and more than 0.02% but less than 0.25% Pb, with the remainder being made up of Zn and unavoidable impurities. The composition satisfies the following relations: $1.0 \le f0 = 100 \times Sn/(Cu+Si+0.5 \times Pb+0.5 \times P-75.5) \le 3.7$, $78.5 \le f1 = Cu+0.8 \times Si-8.5 \times Sn+P+0.5 \times Pb \le 83.0$, $61.8 \le f2 = Cu-4.2 \times Si-0.5 \times Sn-2 \times P \le 63.7$. The area ratios (%) of the constituent phases satisfy the following relations, $36 \le \kappa \le 72$, $0 \le \gamma \le 2.0$, $0 \le \beta \le 0.5$, $0 \le \mu \le 2.0$, $96.5 \le f3 = \alpha+\kappa$, $99.4 \le f4 = \alpha+\kappa+\gamma+\mu$, $0 \le f5 = \gamma+\mu \le 3.0$, $38 \le f6 = \kappa+6 \times \gamma^{1/2}+0.5 \times \mu \le 80$. The long side of the γ phase does not
(Continued)

exceed 50 μm, and the long side of the μ phase does not exceed 25 μm.

9 Claims, 2 Drawing Sheets

(56) References Cited

U.S. PATENT DOCUMENTS

| | | | | |
|---|---|---|---|---|
| 2002/0159912 | A1 | 10/2002 | Oishi | |
| 2007/0062615 | A1* | 3/2007 | Oishi | C22C 9/04 148/434 |
| 2007/0169854 | A1 | 7/2007 | Oishi | |
| 2007/0169855 | A1 | 7/2007 | Oishi | |
| 2009/0297390 | A1 | 12/2009 | Hidenobu et al. | |
| 2013/0276938 | A1* | 10/2013 | Oishi | C22C 9/04 148/433 |
| 2013/0315660 | A1* | 11/2013 | Oishi | B23K 1/008 403/272 |
| 2013/0319581 | A1 | 12/2013 | Oishi | |
| 2014/0251488 | A1* | 9/2014 | Oishi | C22C 9/04 138/177 |
| 2016/0068931 | A1 | 3/2016 | Xu et al. | |
| 2017/0211169 | A1 | 7/2017 | Hanaoka et al. | |

FOREIGN PATENT DOCUMENTS

| | | | |
|---|---|---|---|
| EP | 2 634 275 | A1 | 9/2013 |
| JP | 7-508560 | A | 9/1995 |
| JP | 2000-119774 | A | 4/2000 |
| JP | 2000-119775 | A | 4/2000 |
| JP | 2004-263301 | A | 9/2004 |
| JP | 2008-516081 | A | 5/2008 |
| JP | 2008-214760 | A | 9/2008 |
| JP | 2009-509031 | A | 3/2009 |
| JP | 2013-104071 | A | 5/2013 |
| JP | 2016-511792 | A | 4/2016 |
| WO | 94/01591 | A1 | 1/1994 |
| WO | 2006/016442 | A1 | 2/2006 |
| WO | 2006/016624 | A1 | 2/2006 |
| WO | 2007/034571 | A1 | 3/2007 |
| WO | 2008/081947 | A1 | 7/2008 |
| WO | 2012/057055 | A1 | 5/2012 |
| WO | 2013/065830 | A1 | 5/2013 |
| WO | 2015/166998 | A1 | 11/2015 |
| WO | 2018/034280 | A1 | 2/2018 |
| WO | 2018/034281 | A1 | 2/2018 |
| WO | 2018/034282 | A1 | 2/2018 |
| WO | 2018/034283 | A1 | 2/2018 |
| WO | 2018/034284 | A1 | 2/2018 |
| WO | 2019/035224 | A1 | 2/2019 |
| WO | 2019/035225 | A1 | 2/2019 |
| WO | 2019/035226 | A1 | 2/2019 |

OTHER PUBLICATIONS

Mima, Genjiro, et al., Journal of the Japan Copper and Brass Research Association, 2 (1963) p. 62-77, with partial translation.
International Search Report issued in application PCT/JP2017/029374, completed Oct. 30, 2017 dated Nov. 7, 2017.
Office Action issued in Japanese application No. 2017-567262 dated Mar. 26, 2018, with machine translation.
International Search Report issued in application PCT/JP2017/029369, completed Oct. 30, 2017 dated Nov. 7, 2017.
International Search Report issued in application PCT/JP2017/029376, completed Oct. 30, 2017 dated Nov. 7, 2017.
Office Action issued in Japanese application No. 2017-567267 dated Mar. 26, 2018, with machine translation.
International Search Report issued in application PCT/JP2017/029371, completed Oct. 30, 2017 dated Nov. 7, 2017.
Office Action issued in Japanese application No. 2017-567265 dated Mar. 26, 2018, with machine translation.
International Search Report issued in application PCT/JP2017/029373, completed Oct. 30, 2017 dated Nov. 7, 2017.
International Search Report issued in application PCT/JP2018/006203, completed Apr. 26, 2018 dated May 15, 2018.
International Search Report issued in application PCT/JP2018/006218, completed Apr. 26, 2018 dated May 15, 2018.
International Search Report issued in application PCT/JP2018/006245, completed Apr. 26, 2018 dated May 15, 2018.
JCBAT204 : Sep. 12, 2005 "Lead-less free-cutting brass bar", Japan Copper and Brass Association technical standard, with computer translation.
Office Action issued in co-pending Japanese application 2018-530923, dated Aug. 7, 2018, with Machine translation obtained by Global Dossier on May 8, 2019.
Opposition issued in co-pending Japanese application 2017-567267 dated May 5, 2019 with computer translation.
Opposition issued in co-pending Japanese application 2017-567265 dated May 27, 2019 with computer translation.
Opposition issued in co-pending Japanese application 2017-567266 dated May 27, 2019 with computer translation.
Opposition issued in co-pending Japanese application 2017-567267 dated Mar. 5, 2019 with computer translation.
Opposition issued in co-pending Japanese application 2017-567265 dated Mar. 27, 2019 with computer translation.
Opposition issued in co-pending Japanese application 2017-567266 dated Mar. 27, 2019 with computer translation.
Extended European Search Report issued in co-pending application 18846602.3 completed on Jun. 15, 2020 dated Jun. 26, 2020.
Office Action issued in Indian application 201917005548 dated Jan. 6, 2021.

* cited by examiner

CROSS-SECTION OF TEST No. T601 AFTER USE IN HARSH WATER ENVIRONMENT FOR 8 YEARS (a)

CROSS-SECTION OF TEST No. T602 AFTER DEZINCIFICATION CORROSION TEST 1

(b)

CROSS-SECTION OF TEST No. T01 AFTER DEZINCIFICATION CORROSION TEST 1

(c)

FREE-CUTTING COPPER ALLOY AND METHOD FOR PRODUCING FREE-CUTTING COPPER ALLOY

This is a National Phase Application in the United States of International Patent Application No. PCT/JP2017/029369 filed Aug. 15, 2017, which claims priority on Japanese Patent Application No. 2016-159238, filed Aug. 15, 2016. The entire disclosures of the above patent applications are hereby incorporated by reference.

TECHNICAL FIELD

The present invention relates to a free-cutting copper alloy having excellent corrosion resistance, excellent impact resistance, high strength, and high-temperature strength in which the lead content is significantly reduced, and a method of manufacturing the free-cutting copper alloy. In particular, the present invention relates to a free-cutting copper alloy used in devices such as faucets, valves, or fittings for drinking water consumed by a person or an animal every day as well as valves, fittings and the like for electrical uses, automobiles, machines, and industrial plumbing in various harsh environments, and a method of manufacturing the free-cutting copper alloy.

Priority is claimed on Japanese Patent Application No. 2016-159238, filed on Aug. 15 2016, the content of which is incorporated herein by reference.

BACKGROUND ART

Conventionally, as a copper alloy that is used in devices for drinking water and valves, fittings and the like for electrical uses, automobiles, machines, and industrial plumbing, a Cu—Zn—Pb alloy including 56 to 65 mass % of Cu, 1 to 4 mass % of Pb, and a balance of Zn (so-called free-cutting brass), or a Cu—Sn—Zn—Pb alloy including 80 to 88 mass % of Cu, 2 to 8 mass % of Sn, 2 to 8 mass % of Pb, and a balance of Zn (so-called bronze: gunmetal) was generally used.

However, recently, Pb's influence on a human body or the environment is a concern, and a movement to regulate Pb has been extended in various countries. For example, a regulation for reducing the Pb content in drinking water supply devices to be 0.25 mass % or lower has come into force from January, 2010 in California, the United States and from January, 2014 across the United States. In addition, it is said that a regulation for reducing the amount of Pb leaching from the drinking water supply devices to about 5 mass ppm will come into force in the future. In countries other than the United States, a movement of the regulation has become rapid, and the development of a copper alloy material corresponding to the regulation of the Pb content has been required.

In addition, in other industrial fields such as automobiles, machines, and electrical and electronic apparatuses industries, for example, in ELV regulations and RoHS regulations of the Europe, free-cutting copper alloys are exceptionally allowed to contain 4 mass % Pb. However, as in the field of drinking water, strengthening of regulations on Pb content including elimination of exemptions has been actively discussed.

Under the trend of the strengthening of the regulations on Pb in free-cutting copper alloys, copper alloys that includes Bi or Se having a machinability improvement function instead of Pb, or Cu—Zn alloys including a high concentration of Zn in which the amount of β phase is increased to improve machinability have been proposed.

For example, Patent Document 1 discloses that corrosion resistance is insufficient with mere addition of Bi instead of Pb, and proposes a method of slowly cooling a hot extruded rod to 180° C. after hot extrusion and further performing a heat treatment thereon in order to reduce the amount of β phase to isolate β phase.

In addition, Patent Document 2 discloses a method of improving corrosion resistance by adding 0.7 to 2.5 mass % of Sn to a Cu—Zn—Bi alloy to precipitate γ phase of a Cu—Zn—Sn alloy.

However, the alloy including Bi instead of Pb as disclosed in Patent Document 1 has a problem in corrosion resistance. In addition, Bi has many problems in that, for example, Bi may be harmful to a human body as with Pb, Bi has a resource problem because it is a rare metal, and Bi embrittles a copper alloy material. Further, even in cases where β phase is isolated to improve corrosion resistance by performing slow cooling or a heat treatment after hot extrusion as disclosed in Patent Documents 1 and 2, corrosion resistance is not improved at all in a harsh environment.

In addition, even in cases where γ phase of a Cu—Zn—Sn alloy is precipitated as disclosed in Patent Document 2, this γ phase has inherently lower corrosion resistance than α phase, and corrosion resistance is not improved at all in a harsh environment. In addition, in Cu—Zn—Sn alloys, γ phase including Sn has a low machinability improvement function, and thus it is also necessary to add Bi having a machinability improvement function.

On the other hand, regarding copper alloys including a high concentration of Zn, β phase has a lower machinability function than Pb. Therefore, such copper alloys cannot be replacement for free-cutting copper alloys including Pb. In addition, since the copper alloy includes a large amount of β phase, corrosion resistance, in particular, dezincification corrosion resistance or stress corrosion cracking resistance is extremely poor. In addition, these copper alloys have a low strength under high temperature (for example, 150° C.), and thus cannot realize a reduction in thickness and weight, for example, in automobile components used under high temperature near the engine room when the sun is blazing, or in plumbing pipes used under high temperature and high pressure.

Further, Bi embrittles copper alloy, and when a large amount of β phase is contained, ductility deteriorates. Therefore, copper alloy including Bi or a large amount of β phase is not appropriate for components for automobiles or machines, or electrical components or for materials for drinking water supply devices such as valves. Regarding brass including γ phase in which Sn is added to a Cu—Zn alloy, Sn cannot improve stress corrosion cracking, strength under high temperature is low, and impact resistance is poor. Therefore, the brass is not appropriate for the above-described uses.

On the other hand, for example, Patent Documents 3 to 9 disclose Cu—Zn—Si alloys including Si instead of Pb as free-cutting copper alloys.

The copper alloys disclosed in Patent Documents 3 and 4 have an excellent machinability without containing Pb or containing only a small amount of Pb that is mainly realized by superb machinability-improvement function of γ phase. Addition of 0.3 mass % or higher of Sn can increase and promote the formation of γ phase having a function to improve machinability. In addition, Patent Documents 3 and 4 disclose a method of improving corrosion resistance by forming a large amount of γ phase.

In addition, Patent Document 5 discloses a copper alloy including an extremely small amount of 0.02 mass % or lower of Pb having excellent machinability that is mainly realized by defining the total area of γ phase and κ phase. Here, Sn functions to form and increase γ phase such that erosion-corrosion resistance is improved.

Further, Patent Documents 6 and 7 propose a Cu—Zn—Si alloy casting. The documents disclose that in order to refine crystal grains of the casting, an extremely small amount of Zr is added in the presence of P, and the P/Zr ratio or the like is important.

In addition, in Patent Document 8, proposes a copper alloy in which Fe is added to a Cu—Zn—Si alloy is proposed.

Further, Patent Document 9, proposes a copper alloy in which Sn, Fe, Co, Ni, and Mn are added to a Cu—Zn—Si alloy.

Here, in Cu—Zn—Si alloys, it is known that, even when looking at only those having Cu concentration of 60 mass % or higher, Zn concentration of 30 mass % or lower, and Si concentration of 10 mass % or lower as described in Patent Document 10 and Non-Patent Document 1, 10 kinds of metallic phases including matrix α phase, β phase, γ phase, δ phase, ε phase, ζ phase, η phase, κ phase, μ phase, and χ phase, in some cases, 13 kinds of metallic phases including α', β', and γ' in addition to the 10 kinds of metallic phases are present. Further, it is empirically known that, as the number of additive elements increases, the metallographic structure becomes complicated, or a new phase or an intermetallic compound may appear. In addition, it is also empirically known that there is a large difference in the constitution of metallic phases between an alloy according to an equilibrium diagram and an actually produced alloy. Further, it is well known that the composition of these phases may change depending on the concentrations of Cu, Zn, Si, and the like in the copper alloy and processing heat history.

Apropos, γ phase has excellent machinability but contains high concentration of Si and is hard and brittle. Therefore, when a large amount of γ phase is contained, problems arise in corrosion resistance, impact resistance, high-temperature strength, and the like in a harsh environment. Therefore, use of Cu—Zn—Si alloys including a large amount of γ phase is also restricted like copper alloys including Bi or a large amount of β phase.

Incidentally, the Cu—Zn—Si alloys described in Patent Documents 3 to 7 exhibit relatively satisfactory results in a dezincification corrosion test according to ISO-6509. However, in the dezincification corrosion test according to ISO-6509, in order to determine whether or not dezincification corrosion resistance is good or bad in water of ordinary quality, the evaluation is merely performed after a short period of time of 24 hours using a reagent of cupric chloride which is completely unlike water of actual water quality. That is, the evaluation is performed for a short period of time using a reagent which only provides an environment that is different from the actual environment, and thus corrosion resistance in a harsh environment cannot be sufficiently evaluated.

In addition, Patent Document 8 proposes that Fe is added to a Cu—Zn—Si alloy. However, Fe and Si form an Fe—Si intermetallic compound that is harder and more brittle than γ phase. This intermetallic compound has problems like reduced tool life of a cutting tool during cutting and generation of hard spots during polishing such that the external appearance is impaired. In addition, since Si is consumed when the intermetallic compound is formed, the performance of the alloy deteriorates.

Further, in Patent Document 9, Sn, Fe, Co, and Mn are added to a Cu—Zn—Si alloy. However, each of Fe, Co, and Mn combines with Si to form a hard and brittle intermetallic compound. Therefore, such addition causes problems during cutting or polishing as disclosed by Document 8. Further, according to Patent Document 9, β phase is formed by addition of Sn and Mn, but β phase causes serious dezincification corrosion and causes stress corrosion cracking to occur more easily.

RELATED ART DOCUMENT

Patent Document

[Patent Document 1] JP-A-2008-214760
[Patent Document 2] WO2008/081947
[Patent Document 3] JP-A-2000-119775
[Patent Document 4] JP-A-2000-119774
[Patent Document 5] WO2007/034571
[Patent Document 6] WO2006/016442
[Patent Document 7] WO2006/016624
[Patent Document 8] JP-T–2016-511792
[Patent Document 9] JP-A-2004-263301
[Patent Document 10] U.S. Pat. No. 4,055,445

Non-Patent Document

[Non-Patent Document 1] Genjiro MIMA, Masaharu HASEGAWA, Journal of the Japan Copper and Brass Research Association, 2 (1963), p. 62 to 77

SUMMARY OF THE INVENTION

Problem that the Invention is to Solve

The present invention has been made in order to solve the above-described problems of the conventional art, and an object thereof is to provide a free-cutting copper alloy having excellent corrosion resistance in a harsh environment, impact resistance, and high-temperature strength, and a method of manufacturing the free-cutting copper alloy. In this specification, unless specified otherwise, corrosion resistance refers to both dezincification corrosion resistance and stress corrosion cracking resistance.

Means for Solving the Problem

In order to achieve the object by solving the problems, a free-cutting copper alloy according to the first aspect of the present invention comprises:

higher than 77.0 mass % and lower than 81.0 mass % of Cu;

higher than 3.4 mass % and lower than 4.1 mass % of Si;

0.07 mass % to 0.28 mass % of Sn;

0.06 mass % to 0.14 mass % of P;

higher than 0.02 mass % and lower than 0.25 mass % of Pb; and a balance including Zn and inevitable impurities, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$1.0 \leq f0 = 100 \times [Sn]/([Cu]+[Si]+0.5 \times [Pb]+0.5 \times [P]-75.5) \leq 3.7,\ 78.5 \leq f1 = [Cu]+0.8 \times [Si]-8.5 \times [Sn]+[P]+0.5 \times [Pb] \leq 83.0 \text{ and}$$

$$61.8 \leq f2 = [Cu]-4.2 \times [Si]-0.5 \times [Sn]-2 \times [P] \leq 63.7$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$36 \leq (\kappa) \leq 72,$$

$$0 \leq (\gamma) \leq 2.0,$$

$$0 \leq (\beta) \leq 0.5,$$

$$0 \leq (\mu) \leq 2.0,$$

$$96.5 \leq f3 = (\alpha)+(\kappa),$$

$$99.4 \leq f4 = (\alpha)+(\kappa)+(\gamma)+(\mu),$$

$$0 \leq f5 = (\gamma)+(\mu) \leq 3.0, \text{ and}$$

$$38 \leq f6 = (\kappa)+6 \times (\gamma)^{1/2}+0.5 \times (\mu) \leq 80$$

are satisfied, the length of the long side of γ phase is 50 μm or less, and the length of the long side of μ phase is 25 μm or less.

According to the second aspect of the present invention, the free-cutting copper alloy according to the first aspect further comprises:

one or more element(s) selected from the group consisting of higher than 0.02 mass % and lower than 0.08 mass % of Sb, higher than 0.02 mass % and lower than 0.08 mass % of As, and higher than 0.02 mass % lower than 0.30 mass % of Bi.

A free-cutting copper alloy according to the third aspect of the present invention comprises:

77.5 mass % to 80.0 mass % of Cu;

3.45 mass % to 3.95 mass % of Si;

0.08 mass % to 0.25 mass % of Sn;

0.06 mass % to 0.13 mass % of P;

0.022 mass % to 0.20 mass % of Pb; and a balance including Zn and inevitable impurities, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$1.1 \leq f0 = 100 \times [Sn]/([Cu]+[Si]+0.5 \times [Pb]+0.5 \times [P]-75.5) \leq 3.4,$$

$$78.8 \leq f1 = [Cu]+0.8 \times [Si]-8.5 \times [Sn]+[P]+0.5 \times [Pb] \leq 81.7 \text{ and}$$

$$62.0 \leq f2 = [Cu]-4.2 \times [Si]-0.5 \times [Sn]-2 \times [P] \leq 63.5$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$40 \leq (\kappa) \leq 67,$$

$$0 \leq (\gamma) \leq 1.5,$$

$$0 \leq (\beta) \leq 0.5,$$

$$97.5 \leq f3 = (\alpha)+(\kappa),$$

$$99.6 \leq f4 = (\alpha)+(\kappa)+(\gamma)+(\mu),$$

$$0 \leq f5 = (\gamma)+(\mu) \leq 2.0, \text{ and}$$

$$42 \leq f6 = (\kappa)+6 \times (\gamma)^{1/2}+0.5 \times (\mu) \leq 72$$

are satisfied, the length of the long side of γ phase is 40 μm or less, and the length of the long side of μ phase is 15 μm or less.

According to the fourth aspect of the present invention, the free-cutting copper alloy according to the third aspect further comprises:

one or more element(s) selected from the group consisting of higher than 0.02 mass % and lower than 0.07 mass % of Sb, higher than 0.02 mass % and lower than 0.07 mass % of As, and higher than 0.02 mass % and lower than 0.20 mass % of Bi.

According to the fifth aspect of the present invention, in the free-cutting copper alloy according to any one of the first to fourth aspects of the present invention, a total amount of Fe, Mn, Co, and Cr as the inevitable impurities is lower than 0.08 mass %.

According to the sixth aspect of the present invention, in the free-cutting copper alloy according to any one of the first to fifth aspects of the present invention, an amount of Sn in κ phase is 0.08 mass % to 0.45 mass %, and an amount of P in κ phase is 0.07 mass % to 0.24 mass %.

According to the seventh aspect of the present invention, the free-cutting copper alloy according to any one of the first to sixth aspects of the present invention, that is made into a hot-worked material, wherein the Charpy impact test value is 12 J/cm$^2$ or higher, the tensile strength is 560 N/mm$^2$ or higher, and the creep strain after holding the material at 150° C. for 100 hours in a state where a load corresponding to 0.2% proof stress at room temperature is applied is 0.4% or lower. The Charpy impact test value is a value of a specimen having a U-shaped notch.

According to the eighth aspect of the present invention, the free-cutting copper alloy according to any one of the first to seventh aspects of the present invention is for use in water supply devices, industrial plumbing components, or devices that come in contact with liquid.

According to the ninth aspect of the present invention, the method of manufacturing the free-cutting copper alloy according to any one of the first to eighth aspects of the present invention comprises:

a hot working step, wherein the material's temperature during hot working is 600° C. to 740° C., and the material is cooled in a temperature range from 470° C. to 380° C. at an average cooling rate of 2.5° C./min to 500° C./min.

According to the tenth aspect of the present invention, the method of manufacturing the free-cutting copper alloy according to any one of the first to eighth aspects of the present invention comprises:

any one or both of a cold working step and a hot working step; and a low-temperature annealing step that is performed after the cold working step or the hot working step, wherein in the low-temperature annealing step, conditions are as follows:

the material's temperature is in a range of 240° C. to 350° C.;

the heating time is in a range of 10 minutes to 300 minutes; and when the material's temperature is represented by T° C. and a heating time is represented by t min, $150 \leq (T-220) \times (t)^{1/2} \leq 1200$ is satisfied.

Advantage of the Invention

According to the aspects of the present invention, a metallographic structure is defined in which the amount of μ phase that is effective for machinability is reduced as much as possible while minimizing the amount of γ phase that has an excellent machinability-improvement function but low corrosion resistance, impact resistance and high-temperature strength. In addition, a composition and a manufacturing method for obtaining this metallographic structure are also defined. Therefore, according to the aspects of the present invention, it is possible to provide a free-cutting copper alloy having excellent corrosion resistance in a harsh environment, high tensile strength, and high-temperature strength and a method of manufacturing the free-cutting copper alloy.

BEST MODE FOR CARRYING OUT THE INVENTION

Figure 1:
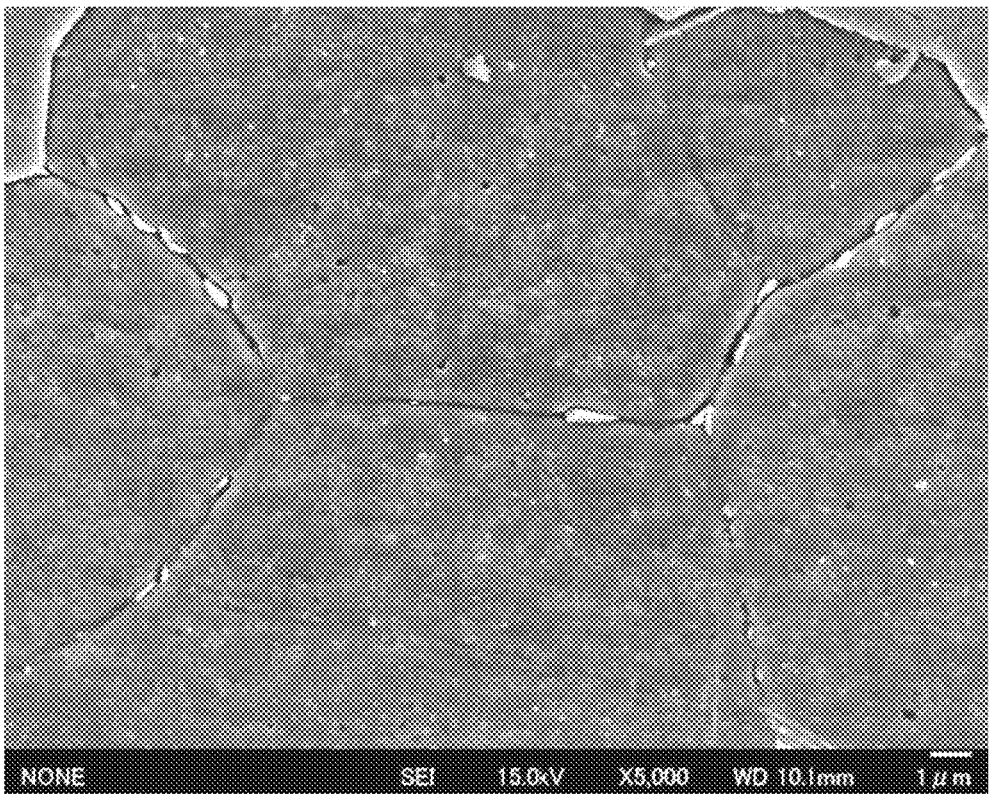
FIG. 1 is a structure observation image showing a free-cutting copper alloy according to Example 1.

Below is a description of free-cutting copper alloys according to the embodiments of the present invention and the methods of manufacturing the free-cutting copper alloys.

The free-cutting copper alloys according to the embodiments are for use in devices such as faucets, valves, or fittings to supply drinking water consumed by a person or an animal every day, components for electrical uses, automobiles, machines and industrial plumbing, and devices and components that contact liquid, such as valves or fittings.

Here, in this specification, an element symbol in parentheses such as [Zn] represents the content (mass %) of the element.

In the embodiment, using this content expressing method, a plurality of composition relational expressions are defined as follows.

Composition Relational Expression $f0=100\times[Sn]/([Cu]+[Si]+0.5\times[Pb]+0.5\times[P]-75.5)$ Composition Relational Expression $f1=[Cu]+0.8\times[Si]-8.5\times[Sn]+[P]+0.5\times[Pb]$ Composition Relational Expression $f2=[Cu]-4.2\times[Si]-0.5\times[Sn]-2\times[P]$ Further, in the embodiments, in constituent phases of metallographic structure, an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%. Constituent phases of metallographic structure refer to α phase, γ phase, κ phase, and the like and do not include intermetallic compound, precipitate, non-metallic inclusion, and the like. In addition, κ phase present in α phase is included in the area ratio of α phase. The sum of the area ratios of all the constituent phases is 100%.

In the embodiments, a plurality of metallographic structure relational expressions are defined as follows.

Metallographic Structure Relational Expression $f3=(\alpha)+(\kappa)$

Metallographic Structure Relational Expression $f4=(\alpha)+(\kappa)+(\gamma)+(\mu)$ Metallographic Structure Relational Expression $f5=(\gamma)+(\mu)$ Metallographic Structure Relational Expression $f6=(\kappa)+6\times(\gamma)^{1/2}+0.5\times(\mu)$ A free-cutting copper alloy according to a first embodiment of the present invention includes: higher than 77.0 mass % and lower than 81.0 mass % of Cu; higher than 3.4 mass % and lower than 4.1 mass % of Si; 0.07 mass % to 0.28 mass % of Sn; 0.06 mass % to 0.14 mass % of P; higher than 0.02 mass % and lower than 0.25 mass % of Pb; and a balance including Zn and inevitable impurities. The composition relational expression f0 is in a range of $1.0 \leq f0 \leq 3.7$, the composition relational expression f1 is in a range of $78.5 \leq f1 \leq 83.0$, and the composition relational expression f2 is in a range of $61.8 \leq f2 \leq 63.7$. The area ratio of κ phase is in a range of $36 \leq (\kappa) \leq 72$, the area ratio of γ phase is in a range of $0 \leq (\gamma) \leq 2.0$, the area ratio of β phase is in a range of $0 \leq (\beta) \leq 0.5$, and the area ratio of μ phase is in a range of $0 \leq (\mu) \leq 2.0$. The metallographic structure relational expression f3 is in a range of $f3 \leq 96.5$, the metallographic structure relational expression f4 is in a range of $f4 \leq 99.4$, the metallographic structure relational expression f5 is in a range of $0 \leq f5 \leq 3.0$, and the metallographic structure relational expression f6 is in a range of $38 \leq f6 \leq 80$. The length of the long side of γ phase is 50 μm or less, and the length of the long side of μ phase is 25 μm or less.

A free-cutting copper alloy according to a second embodiment of the present invention includes: 77.5 mass % to 80.0 mass % of Cu; 3.45 mass % to 3.95 mass % of Si; 0.08 mass % to 0.25 mass % of Sn; 0.06 mass % to 0.13 mass % of P; 0.022 mass % to 0.20 mass % of Pb; and a balance including Zn and inevitable impurities. The composition relational expression f0 is in a range of $1.1 \leq f0 \leq 3.4$, the composition relational expression f1 is in a range of $78.8 \leq f1 \leq 81.7$, and the composition relational expression f2 is in a range of $62.0 \leq f2 \leq 63.5$. The area ratio of κ phase is in a range of $40 \leq (\kappa) \leq 67$, the area ratio of γ phase is in a range of $0 \leq (\gamma) \leq 1.5$, the area ratio of β phase is in a range of $0 \leq (\beta) \leq 0.5$, and the area ratio of μ phase is in a range of $0 \leq (\mu) \leq 1.0$. The metallographic structure relational expression f3 is in a range of $f3 \leq 97.5$, the metallographic structure relational expression f4 is in a range of $f4 \leq 99.6$, the metallographic structure relational expression f5 is in a range of $0 \leq f5 \leq 2.0$, and the metallographic structure relational expression f6 is in a range of $42 \leq f6 \leq 72$. The length of the long side of γ phase is 40 μm or less, and the length of the long side of μ phase is 15 μm or less.

In addition, the free-cutting copper alloy according to the first embodiment of the present invention may further include one or more element(s) selected from the group consisting of higher than 0.02 mass % and lower than 0.08 mass % of Sb, higher than 0.02 mass % and lower than 0.08 mass % of As, and higher than 0.02 mass % and lower than 0.30 mass % of Bi.

In addition, the free-cutting copper alloy according to the second embodiment of the present invention may further include one or more element(s) selected from the group consisting of higher than 0.02 mass % and lower than 0.07 mass % of Sb, higher than 0.02 mass % and lower than 0.07 mass % of As, and higher than 0.02 mass % and lower than 0.20 mass % of Bi.

Further, in the free-cutting copper alloy according to the first and second embodiments of the present invention, it is preferable that the amount of Sn in κ phase is 0.08 mass % to 0.45 mass %, and it is preferable that the amount of P in κ phase is 0.07 mass % to 0.22 mass %.

In addition, if the free-cutting copper alloys according to the first and second embodiments of the present invention is made into a hot-worked material, it is preferable that a Charpy impact test value of the hot-worked material is 12 $J/cm^2$ or higher, it is preferable that a tensile strength is 560 $N/mm^2$ or higher, and it is preferable that a creep strain after holding the copper alloy at 150° C. for 100 hours in a state where 0.2% proof stress (load corresponding to 0.2% proof stress) at room temperature is applied is 0.4% or lower.

The reason why the component composition, the composition relational expressions f0, f1, and f2, the metallographic structure, the metallographic structure relational expressions f3, f4, f5, and f6, and the mechanical properties are defined as above is explained below.

<Component Composition>

(Cu)

Cu is a main element of the alloy according to the embodiment. In order to achieve the object of the present invention, it is necessary to add at least higher than 77.0 mass % of Cu. When the Cu content is 77.0 mass % or lower, the proportion of γ phase is higher than 2% although depending on the contents of Si, Zn, and Sn, and dezincification corrosion resistance, stress corrosion cracking resistance, impact resistance, and high-temperature strength deteriorate. In some cases, β phase may also appear. Accordingly, the lower limit of the Cu content is higher than 77.0 mass %, preferably 77.5 mass % or higher, and more preferably 77.8 mass % or higher.

On the other hand, when the Cu content is 81.0 mass % or higher, a large amount of expensive copper is used, which causes an increase in cost. Further, the above-described effects are saturated, and the proportion of κ phase may be excessively high. In addition, μ phase having a high Cu concentration, in some cases, ζ phase and χ phase are likely to precipitate. As a result, machinability, impact resistance, and hot workability may deteriorate although depending on conditions of a metallographic structure, and dezincification corrosion resistance may deteriorate instead. Accordingly, the upper limit of the Cu content is lower than 81.0 mass %, preferably 80.0 mass % or lower, more preferably 79.5 mass % or lower, still more preferably 79.0 mass % or lower, and most preferably 78.8 mass % or lower.

(Si)

Si is an element necessary for obtaining most of excellent properties of the alloy according to the embodiment. Si improves machinability, corrosion resistance, strength, and high-temperature strength of the alloy according to the embodiment. In the case of α phase, addition of Si does not substantially improve machinability. However, due to a phase such as γ phase, κ phase, μ phase, β phase, or in some cases, ζ phase, or χ phase that is formed by addition of Si and is harder than α phase, excellent machinability can be obtained without addition of a large amount of Pb. However, as the proportion of γ phase, κ phase, μ phase, β phase, ζ phase, or χ phase that is the hard metallic phase increases, a problem of deterioration in impact resistance, a problem of deterioration of corrosion resistance in a harsh environment, and a problem in high temperature creep properties for withstanding long-term use under high temperature, in particular, under practical high temperature arise. Therefore, it is necessary to define γ phase, κ phase, μ phase, or β phase to be in an appropriate range. In addition, Si has an effect of significantly suppressing evaporation of Zn during melting or casting, and as the Si content increases, the specific gravity can be reduced.

In order to solve these problems of a metallographic structure and to satisfy all the properties, it is necessary to add higher than 3.4 mass % of Si although depending on the contents of Cu, Zn, Sn, and the like. The lower limit of the Si content is preferably 3.45 mass % or higher, more preferably 3.5 mass % or higher, and still more preferably 3.55 mass % or higher. At first, it is presumed that the Si content should be reduced in order to reduce the proportion of γ phase or μ phase having a high Si concentration. However, as a result of a thorough study on a mixing ratio between Si and another element, it was found that it is necessary to define the lower limit of the Si content as described above. In addition, by adding higher than 3.4 mass % of Si, the proportion of γ phase is reduced, γ phase breaks such that the long side of γ phase is reduced, and the influence on the properties can be reduced.

On the other hand, when the Si content is excessively high, the amount of κ phase is excessively large, and β phase may appear. Further, in some cases, δ phase, ε phase, η phase, γ phase, μ phase, ζ phase, or χ phase having a high Si concentration appears such that corrosion resistance, ductility, and impact resistance deteriorate. Therefore, the upper limit of the Si content is lower than 4.1 mass %, preferably 3.95 mass % or lower, more preferably 3.9 mass % or lower, and still more preferably 3.87 mass % or lower.

(Zn)

Zn is a main element of the alloy according to the embodiment together with Cu and Si and is an element for improving machinability, corrosion resistance, strength, and castability. Zn is included in the balance. If anything, the upper limit of the Zn content is lower than 19.5 mass %, preferably lower than 19 mass %, and more preferably 18.5 mass % or lower. On the other hand, the lower limit of the Zn content is higher than 15.0 mass % and preferably 16.0 mass % or higher.

(Sn)

Sn significantly improves dezincification corrosion resistance, in particular, in a harsh environment and improves stress corrosion cracking resistance. In a copper alloy including a plurality of metallic phases (constituent phases), there is a difference in corrosion resistance between the respective metallic phases. Even in a case where the two phases that remain in the metallographic structure are α phase and κ phase, corrosion begins from a phase having lower corrosion resistance and progresses. Sn improves corrosion resistance of α phase having the highest corrosion resistance and improves corrosion resistance of κ phase having the second highest corrosion resistance at the same time. The amount of Sn distributed in κ phase is about 1.5 times the amount of Sn distributed in α phase. That is, the amount of Sn distributed in κ phase is about 1.5 times the amount of Sn distributed in α phase. As the amount of Sn in κ phase is more than α phase, corrosion resistance of κ phase improves more. Because of the larger Sn content in κ phase, there is little difference in corrosion resistance between α phase and κ phase. Alternatively, at least a difference in corrosion resistance between α phase and κ phase is reduced. Therefore, the corrosion resistance of the alloy significantly improves.

However, addition of Sn promotes the formation of γ phase. γ phase has excellent machinability but deteriorates alloy corrosion resistance, ductility, impact resistance, and high-temperature strength. The amount of Sn distributed in γ phase is about 15 times the amount of Sn distributed in α phase. That is, the amount of Sn distributed in γ phase is about 15 times the amount of Sn distributed in α phase. γ phase including Sn improves corrosion resistance slightly more than γ phase not including Sn, which is insufficient. This way, addition of Sn to a Cu—Zn—Si alloy promotes the formation of γ phase although the corrosion resistance of κ phase and α phase is improved. In addition, a large amount of Sn is distributed in γ phase. Therefore, unless a mixing ratio between the essential elements of Cu, Si, P, and Pb is more exactly and appropriately adjusted and an appropriate control of a metallographic structure state is performed, addition of Sn merely slightly improves the corrosion resistance of κ phase and α phase, and an increase in γ phase causes deterioration in alloy corrosion resistance, ductility, impact resistance, and high temperature properties instead. That is, addition of Sn promotes the formation of γ phase and causes a large amount of Sn to be distributed in γ phase. As a result, it is presumed that the distribution of Sn in κ phase is restricted. However, by appropriately adjusting the mixing ratio between the essential elements for suppressing the formation of γ phase and performing an appropriate control of a metallographic structure state, dezincification corrosion resistance, stress corrosion cracking resistance, impact resistance, and high temperature properties are improved. Addition of Sn has an effect of suppressing precipitation of μ phase.

In addition, addition of Sn to κ phase improves the machinability of κ phase. This effect is further improved by addition of P and Sn.

By performing a control of a metallographic structure including the relational expressions described below, a copper alloy having excellent properties can be prepared. In order to exhibit the above-described effect, the lower limit of the Sn content needs to be 0.07 mass % or higher, preferably 0.08 mass % or higher, and more preferably 0.10 mass % or higher, or exceeding 0.10 mass %.

On the other hand, when the Sn content is higher than 0.28 mass %, the proportion of γ phase increases. Therefore, the upper limit of the Sn content is 0.28 mass % or lower, and preferably 0.25 mass % or lower.

(Pb)

Addition of Pb improves the machinability of the copper alloy. About 0.003 mass % of Pb is solid-solubilized in the matrix, and when the Pb content is higher than 0.003 mass %, Pb is present in the form of Pb particles having a diameter of about 1 μm. Pb has an effect of improving machinability even with a small amount of addition. In particular, when the Pb content is higher than 0.02 mass %, a significant effect starts to be exhibited. In the alloy according to the embodiment, the proportion of γ phase having excellent machinability is limited to be 2.0% or lower. Therefore, a small amount of Pb can be replaced with γ phase.

Therefore, the lower limit of the Pb content is higher than 0.02 mass %, preferably 0.022 mass % or higher, and more preferably 0.025 mass % or higher. In particular, in the case of deep drilling using a drill (for example, drill cutting at a length that is five times a drill diameter) and in cases where the value of the metallographic structure relational expression f6 relating to machinability falls below 42, the Pb content is preferably 0.022 mass % or higher or 0.025 mass % or higher.

On the other hand, Pb is harmful to a human body and has an effect on impact resistance and high-temperature strength. Therefore, the upper limit of the Pb content is lower than 0.25 mass %, preferably 0.20 mass % or lower, more preferably 0.15 mass % or lower, and most preferably 0.10 mass % or lower.

(P)

As in the case of Sn, P significantly improves dezincification corrosion resistance and stress corrosion cracking resistance, in particular, in a harsh environment.

As in the case of Sn, the amount of P distributed in κ phase is about 2 times the amount of P distributed in α phase. That is, the amount of P distributed in κ phase is about 2 times the amount of P distributed in α phase. In addition, p has a significant effect of improving the corrosion resistance of α phase. However, when P is added alone, the effect of improving the corrosion resistance of κ phase is low. However, in cases where P is present together with Sn, the corrosion resistance of κ phase can be improved. P scarcely improves the corrosion resistance of γ phase. In addition, P contained in κ phase slightly improves the machinability of κ phase. By adding P together with Sn, machinability of κ phase improves more effectively.

In order to exhibit the above-described effects, the lower limit of the P content is 0.06 mass % or higher, preferably 0.065 mass % or higher, and more preferably 0.07 mass % or higher.

On the other hand, in cases where the P content is higher than 0.14 mass %, the effect of improving corrosion resistance is saturated. In addition, a compound of P and Si is more likely to be formed, impact resistance and ductility deteriorates, and machinability becomes adversely affected also. Therefore, the upper limit of the P content is 0.14 mass % or lower, preferably 0.13 mass % or lower, and more preferably 0.12 mass % or lower.

(Sb, As, Bi)

As in the case of P and Sn, Sb and As significantly improve dezincification corrosion resistance and stress corrosion cracking resistance, in particular, in a harsh environment.

In order to improve corrosion resistance by addition of Sb, it is necessary to add Sb in the amount exceeding 0.02 mass %, and it is preferable to add 0.03 mass % or higher amount of Sb. On the other hand, even if Sb content is 0.08 mass % or higher, the effect of improving corrosion resistance is saturated, and the proportion of γ phase increases instead. Therefore, Sb content is lower than 0.08 mass % and preferably lower than 0.07 mass %.

In order to improve corrosion resistance due to addition of As, it is necessary to add As in the amount exceeding 0.02 mass %, and it is preferable to add 0.03 mass % or higher amount of As. On the other hand, even if As content is 0.08 mass % or higher, the effect of improving corrosion resistance is saturated. Therefore, the As content is lower than 0.08 mass % and preferably lower than 0.07 mass %.

By adding Sb alone, the corrosion resistance of α phase is improved. Sb is a metal of low melting point although it has a higher melting point than Sn, and exhibits similar behavior to Sn. The amount of Sn distributed in γ phase or κ phase is larger than the amount of Sn distributed in α phase. By adding Sn together, Sb has an effect of improving the corrosion resistance of κ phase. However, regardless of whether Sb is added alone or added together with Sn and P, the effect of improving the corrosion resistance of γ phase is very little. Moreover, addition of an excessive amount of Sb may increase the proportion of γ phase.

Among Sn, P, Sb, and As, As strengthens the corrosion resistance of α phase. Even in cases where κ phase is corroded, the corrosion resistance of α phase is improved, and thus As functions to prevent α phase from corroding in a chain reaction. However, regardless of whether As is added alone or added together with Sn, P, and Sb, the effect of improving the corrosion resistance of κ phase and γ phase is low.

In cases where both Sb and As are added, even when the total content of Sb and As is higher than 0.10 mass %, the effect of improving corrosion resistance is saturated, and ductility and impact resistance deteriorate. Therefore, the total content of Sb and As is preferably 0.10 mass % or lower. As in the case of Sn, Sb has an effect of improving the corrosion resistance of κ phase. Therefore, when the amount of [Sn]+0.7×[Sb] is higher than 0.10 mass %, the corrosion resistance of the alloy is further improved.

Bi further improves the machinability of the copper alloy. For Bi to exhibits the effect, it is necessary to add Bi in the amount exceeding 0.02 mass %, and it is preferable to add 0.025 mass % or higher. On the other hand, whether Bi is harmfulness to human body is uncertain. However, considering the influence on impact resistance and high-temperature strength, the upper limit of the Bi content is lower than 0.30 mass %, preferably lower than 0.20 mass %, more preferably 0.15 mass % or lower, and still more preferably 0.10 mass % or lower.

(Inevitable Impurities)

Examples of the inevitable impurities in the embodiment include Al, Ni, Mg, Se, Te, Fe, Co, Ca, Zr, Cr, Ti, In, W, Mo, B, Ag, and rare earth elements.

Conventionally, a free-cutting copper alloy is not mainly formed of a good-quality raw material such as electrolytic copper or electrolytic zinc but is mainly formed of a recycled copper alloy. In a subsequent step (downstream step, machining step) of the related art, almost all the members and components are machined, and a large amount of copper alloy is wasted at a proportion of 40 to 80% in the process. Examples of the wasted copper alloy include chips, ends of an alloy material, burrs, runners, and products having manufacturing defects. This wasted copper alloy is the main raw material. When chips and the like are insufficiently separated, alloy becomes contaminated by Pb, Fe, Se, Te, Sn, P, Sb, As, Bi, Ca, Al, Zr, Ni, or rare earth elements of other free-cutting copper alloys. In addition, the cutting chips include Fe, W, Co, Mo, and the like that originate in tools. The wasted materials include plated product, and thus are contaminated with Ni and Cr. Mg, Fe, Cr, Ti, Co, In, and Ni are mixed into pure copper-based scrap. From the viewpoints of reuse of resources and costs, scrap such as chips including these elements is used as a raw material to the extent that such use does not have any adverse effects to the properties. Empirically speaking, a large part of Ni that is mixed into the alloy comes from the scrap and the like, and Ni may be contained in the amount lower than 0.06 mass %, but it is preferable if the content is lower than 0.05 mass %. Fe, Mn, Co, Cr, or the like forms an intermetallic compound with Si and, in some cases, forms an intermetallic compound with P and affect machinability. Therefore, each amount of Fe, Mn, Co, and Cr is preferably lower than 0.05 mass % and more preferably lower than 0.04 mass %. The total amount of Fe, Mn, Co, and Cr is also preferably lower than 0.08 mass %. This total amount is more preferably lower than 0.07 mass %, and still more preferably lower than 0.06 mass %. With respect to other elements such as Al, Mg, Se, Te, Ca, Zr, Ti, In, W, Mo, B, Ag, and rare earth elements, each amount is preferably lower than 0.02 mass % and more preferably lower than 0.01 mass %.

The amount of the rare earth elements refers to the total amount of one or more of Sc, Y, La, Ce, Pr, Nd, Pm, Sm, Eu, Gd, Tb, Dy, Ho, Er, Tm, Tb, and Lu.

(Composition Relational Expression f0)

The composition relational expressions f0, f1, and f2 are expressions indicating a relation between the composition and the metallographic structure. Even when the amount of each of the elements is in the above-described range defined in the embodiment, unless the composition relational expressions f0, f1, and f2 are not satisfied, the desired properties of the embodiment cannot be necessarily satisfied. However, in case where the amount of each of the elements exceeds the component concentration range defined in the embodiment, basically, the above-described composition relational expressions cannot be applied.

The composition relational expression f0 affects constituent phases of metallographic structure. The sum of values obtained by multiplying the respective contents of each of P and Pb by a coefficient of 0.5 and the contents of Cu and Si as main components other than Zn and Sn is obtained. A coefficient of 75.5 is subtracted from the sum. A ratio (percentage) of the Sn content to the calculated value is the composition relational expression f0.

In order to exhibit the effect of Sn, the concentrations in which at least the sum of the contents of the main components (Cu and Si) substantially other than Zn and Sn is higher than 75.5 mass % are the subject of discussion. The numerical value of the denominator represents the contents of the main components other than Zn and Sn that effectively acts on Sn.

The ratio (percentage) of the Sn content to the value of the denominator obtained by subtracting 75.5 from the total content of the main components substantially other than Zn and Sn is the composition relational expression f0. The composition relational expression f0 being lower than 1.0 represents that Sn that is effective for corrosion resistance is not sufficiently added to κ phase, that is, the improvement of corrosion resistance is insufficient. In addition, depending on other components, problems arise in machinability. On the other hand, the composition relational expression f0 being higher than 3.7 represents that a necessary amount of Sn is contained in κ phase and the formation of γ phase is excessive. In this case, problems arise in corrosion resistance, impact resistance, and the like. Therefore, the composition relational expression f0 is 1.0 to 3.7. The lower limit of the composition relational expression f0 is preferably 1.1 or higher and more preferably 1.2 or higher. The upper limit of the composition relational expression f0 is preferably 3.4 or lower and more preferably 3.0 or lower. As, Sb, and Bi as selective elements and the inevitable impurities that are separately defined have substantially no effect on the composition relational expression f0 in consideration of the contents thereof, and thus are not defined in the composition relational expression f0.

(Composition Relational Expression f1)

The composition relational expression f1 is an expression indicating a relation between the composition and the metallographic structure. Even when the amount of each of the elements is in the above-described defined range, unless this composition relational expression f1 is not satisfied, the desired properties of the embodiment cannot be satisfied. In the composition relational expression f1, a large coefficient of −8.5 is assigned to Sn. When the composition relational expression f1 is lower than 78.5, the proportion of γ phase increases, the shape of γ phase that is present is lengthened, and corrosion resistance, impact resistance, and high temperature properties deteriorate. Accordingly, the lower limit of the composition relational expression f1 is 78.5 or higher, preferably 78.8 or higher, and more preferably 79.2 or higher. As the composition relational expression f1 approaches the more preferable range, the area ratio of γ phase decreases. Even when γ phase is present, γ phase tends to break, and corrosion resistance, impact resistance, ductility, normal-temperature strength, and high temperature properties are further improved.

On the other hand, the upper limit of the composition relational expression f1 mainly has an effect on the proportion of κ phase. When the composition relational expression f1 is higher than 83.0, the proportion of κ phase is excessively high. In addition, μ phase is likely to precipitate. When the proportion of κ phase or μ phase is excessively high, machinability deteriorates, and impact resistance, ductility, high temperature properties, hot workability, and corrosion resistance deteriorate. Accordingly, the upper limit of the composition relational expression f1 is 83.0 or lower, preferably 81.7 or lower, and more preferably 81.0 or lower.

This way, by defining the composition relational expression f1 to be in the above-described range, a copper alloy having excellent properties can be obtained. As, Sb, and Bi as selective elements and the inevitable impurities that are separately defined have substantially no effect on the composition relational expression f1 in consideration of the contents thereof, and thus are not defined in the composition relational expression f1.

(Composition Relational Expression f2)

The composition relational expression f2 is an expression indicating a relation between the composition and workability, various properties, and the metallographic structure. When the composition relational expression f2 is lower than 61.8, the proportion of γ phase in the metallographic structure increases, and other metallic phases including β phase are more likely to appear and remain. Therefore, corrosion resistance, impact resistance, cold workability, and high temperature creep properties deteriorate. In addition, during hot forging, crystal grains are coarsened, and cracking is more likely to occur. Accordingly, the lower limit of the composition relational expression f2 is 61.8 or higher, preferably 62.0 or higher, and more preferably 62.2 or higher.

On the other hand, when the value of the composition relational expression f2 is higher than 63.7, hot deformation resistance is improved, hot deformability deteriorates, and surface cracking may occur in a hot extruded material or a hot forged product. Partly depending on the hot working ratio or the extrusion ratio, but it is difficult to perform hot working such as hot extrusion or hot forging, for example, at about 630° C. (material's temperature immediately after hot working). In addition, coarse α phase having a length of more than 300 μm and a width of more than 100 μm in a direction parallel to a hot working direction are more likely to appear. As a result, machinability deteriorates, the length of the long side of γ phase that is present at a boundary between α phase and κ phase increases, and strength also deteriorates. In addition, the range of solidification temperature, that is, (from the liquidus temperature to the solidus temperature) becomes higher than 50° C., shrinkage cavities during casting become significant, and sound casting cannot be obtained. Accordingly, the upper limit of the composition relational expression f2 is 63.7 or lower, preferably 63.5 or lower, and more preferably 63.4 or lower.

This way, by defining the composition relational expression f2 to be in the above-described range, a copper alloy having excellent properties can be industrially manufactured with a high yield. As, Sb, and Bi that are selective elements and the inevitable impurities that are separately defined scarcely affect the composition relational expression f2 because the contents thereof are low, and thus are not defined in the composition relational expression f2.

(Comparison to Patent Documents)

Here, the results of comparing the compositions of the Cu—Zn—Si alloys described in Patent Documents 3 to 9 and the composition of the alloy according to the embodiment are shown in Table 1.

The embodiment and Patent Document 3 are different from each other in the Pb content and the Sn content which is a selective element. The embodiment and Patent Document 4 are different from each other in the Sn content which is a selective element. The embodiment and Patent Document 5 are different from each other in the Pb content. The embodiment and Patent Documents 6 and 7 are different from each other as to whether or not Zr is added. The embodiment and Patent Document 8 are different from each other in Cu content as well as whether or not Fe is added. The embodiment and Patent Document 9 are different from each other as to whether or not Pb is added and also whether or not Fe, Ni, and Mn are added.

As described above, the alloy according to the embodiment and the Cu—Zn—Si alloys described in Patent Documents 3 to 9 are different from each other in the composition ranges.

TABLE 1

| | Cu | Si | Pb | Sn | P | Fe | Zr | Other Essential Elements |
|---|---|---|---|---|---|---|---|---|
| First Embodiment | over 77.0-less than 81.0 | over 3.4-less than 4.1 | over 0.02-less than 0.25 | 0.07-0.28 | 0.06-0.14 | — | — | |
| Second Embodiment | 77.5-80.0 | 3.45-3.95 | 0.022-0.20 | 0.08-0.25 | 0.06-0.13 | — | — | |
| Patent Document 3 | 69-79 | 2.0-4.0 | — | 0.3-3.5 | 0.02-0.25 | — | — | |
| Patent Document 4 | 69-79 | 2.0-4.0 | 0.02-0.4 | 0.3-3.5 | 0.02-0.25 | — | — | |

TABLE 1-continued

| | Cu | Si | Pb | Sn | P | Fe | Zr | Other Essential Elements |
|---|---|---|---|---|---|---|---|---|
| Patent Document 5 | 71.5-78.5 | 2.0-4.5 | 0.005-0.02 | 0.1-1.2 | 0.01-0.2 | 0.5 or lower | — | |
| Patent Document 6 | 69-88 | 2-5 | 0.004-0.45 | 0.1-2.5 | 0.01-0.25 | — | 5 ppm-400 ppm | |
| Patent Document 7 | 69-88 | 2-5 | 0.005-0.45 | 0.05-1.5 | 0.01-0.25 | 0.3 or lower | 5 ppm-400 ppm | |
| Patent Document 8 | 74.5-76.5 | 3.0-3.5 | 0.01-0.25 | 0.05-0.2 | 0.04-0.10 | 0.11-0.2 | — | |
| Patent Document 9 | 70-83 | 1-5 | — | 0.01-2 | 0.1 or lower | 0.01-0.3 | 0.5 or lower | Ni: 0.01-0.3 Mn: 0.01-0.3 |

<Metallographic Structure>

In Cu—Zn—Si alloys, 10 or more kinds of phases are present, complicated phase change occurs, and desired properties cannot be necessarily obtained simply by defining the composition ranges and relational expressions of the elements. By specifying and determining the kinds of metallic phases that are present in a metallographic structure and the ranges thereof, desired properties can finally be obtained.

In the case of Cu—Zn—Si alloys including a plurality of metallic phases, the corrosion resistance level varies between phases. Corrosion begins and progresses from a phase having the lowest corrosion resistance, that is, a phase that is most prone to corrosion, or from a boundary between α phase having low corrosion resistance and a phase adjacent to such phase. In the case of Cu—Zn—Si alloys including three elements of Cu, Zn, and Si, for example, when corrosion resistances of α phase, α' phase, β phase (including β' phase), κ phase, γ phase (including γ' phase), and μ phase are compared, the ranking of corrosion resistance is: α phase>α' phase>κ phase>μ phase≥γ phase>β phase. The difference in corrosion resistance between κ phase and μ phase is particularly large.

Compositions of the respective phases vary depending on the composition of the alloy and the area ratios of the respective phases, and the following can be said.

With respect to the Si concentration of each phase, that of μ phase is the highest, followed by γ phase, κ phase, α phase, α' phase, and β phase. The Si concentrations in μ phase, γ phase, and κ phase are higher than the Si concentration in the alloy. In addition, the Si concentration in μ phase is about 2.5 times to about 3 times the Si concentration in α phase, and the Si concentration in γ phase is about 2 times to about 2.5 times the Si concentration in α phase.

The Cu concentration ranking is: μ phase>κ phase≥α phase>α' phase≥γ phase>β phase from highest to lowest. The Cu concentration in μ phase is higher than the Cu concentration in the alloy.

In the Cu—Zn—Si alloys described in Patent Documents 3 to 6, a large part of γ phase, which has the highest machinability-improving function, is present together with α' phase or is present at a boundary between κ phase and α phase. When used in water that is bad for copper alloys or in an environment that is harsh for copper alloys, γ phase becomes a source of selective corrosion (origin of corrosion) such that corrosion progresses. Of course, when β phase is present, β phase starts to corrode before γ phase. When μ phase and γ phase are present together, μ phase starts to corrode slightly later than or at the same time as γ phase. For example, when α phase, κ phase, γ phase, and μ phase are present together, if dezincification corrosion selectively occurs in γ phase or μ phase, the corroded γ phase or μ phase becomes a corrosion product (patina) that is rich in Cu due to dezincification. This corrosion product causes κ phase or α' phase adjacent thereto to be corroded, and corrosion progresses in a chain reaction.

The water quality of drinking water varies across the world including Japan, and this water quality is becoming one where corrosion is more likely to occur to copper alloys. For example, the concentration of residual chlorine used for disinfection for the safety of human body is increasing although the upper limit of chlorine level is regulated. That is to say, the environment where copper alloys that compose water supply devices are used is becoming one in which alloys are more likely to be corroded. The same is true of corrosion resistance in a use environment where a variety of solutions are present, for example, those where component materials for automobiles, machines, and industrial plumbing described above are used.

On the other hand, even if the amount of γ phase, or the amounts of γ phase, μ phase, and β phase are controlled, that is, the proportions of the respective phases are significantly reduced or are made to be zero, the corrosion resistance of a Cu—Zn—Si alloy including three phases of α phase, α' phase, and κ phase is not perfect. Depending on the environment where corrosion occurs, κ phase having lower corrosion resistance than α phase may be selectively corroded, and it is necessary to improve the corrosion resistance of κ phase. Further, in cases where κ phase is corroded, the corroded κ phase becomes a corrosion product that is rich in Cu. This corrosion product causes α phase to be corroded, and thus it is also necessary to improve the corrosion resistance of α phase.

In addition, γ phase is a hard and brittle phase. Therefore, when a large load is applied to a copper alloy member, the γ phase microscopically becomes a stress concentration source. Therefore, γ phase makes the alloy more vulnerable to stress corrosion cracking, deteriorates impact resistance, and further deteriorates high-temperature strength (high temperature creep strength) due to a high-temperature creep phenomenon. μ phase is mainly present at a grain boundary of α phase or at a phase boundary between α phase and κ phase. Therefore, as in the case of γ phase, μ phase microscopically becomes a stress concentration source. Due to being a stress concentration source or a grain boundary sliding phenomenon, μ phase makes the alloy more vulnerable to stress corrosion cracking, deteriorates impact resistance, and deteriorates high-temperature strength. In some cases, the presence of μ phase deteriorates these properties more than γ phase.

However, if the proportion of γ phase or the proportions of γ phase and μ phase are significantly reduced or are made to be zero in order to improve corrosion resistance and the above-mentioned properties, satisfactory machinability may not be obtained merely by containing a small amount of Pb and three phases of α phase, α' phase, and κ phase. Therefore, providing that the alloy with a small amount of Pb has excellent machinability, it is necessary that constituent phases of a metallographic structure (metallic phases or crystalline phases) are defined as follows in order to improve corrosion resistance, ductility, impact resistance, strength, and high-temperature strength in a harsh use environment.

Hereinafter, the unit of the proportion of each of the phases is area ratio (area %).

(γ Phase)

γ phase is a phase that contributes most to the machinability of Cu—Zn—Si alloys. In order to improve corrosion resistance, strength, high temperature properties, and impact resistance in a harsh environment, it is necessary to limit γ phase. In order to further improve corrosion resistance, it is necessary to add Sn, and addition of Sn further increases the proportion of γ phase. In order to obtain sufficient machinability and corrosion resistance at the same time when Sn has such contradicting effects, the Sn content, the composition relational expressions f0, f1, and f2, metallographic structure relational expressions described below, and the manufacturing process are limited.

(β Phase and Other Phases)

In order to obtain excellent corrosion resistance and high ductility, impact resistance, strength, and high-temperature strength, the proportions of β phase, γ phase, μ phase, and other phases such as ζ phase in a metallographic structure are particularly important.

The proportion of β phase needs to be at least 0% to 0.5% and is preferably 0.1% or lower, and it is most preferable that β phase is not present.

The proportion of phases such as ζ phase other than α phase, κ phase, β phase, γ phase, and μ phase is preferably 0.3% or lower and more preferably 0.1% or lower. It is most preferable that the other phases such as ζ phase are not present.

First, in order to obtain excellent corrosion resistance, it is necessary that the proportion of γ phase is 0% to 2.0% and the length of the long side of γ phase is 50 μm or less.

The length of the long side of γ phase is measured using the following method. Using a metallographic micrograph of, for example, 500-fold or 1000-fold, the maximum length of the long side of γ phase is measured in one visual field. This operation is performed in a plurality of visual fields, for example, five arbitrarily chosen visual fields as described below. The average maximum length of the long side of γ phase calculated from the lengths measured in the respective visual fields is regarded as the length of the long side of γ phase. Therefore, the length of the long side of γ phase can be referred to as the maximum length of the long side of γ phase.

The proportion of γ phase is preferably 1.5% or lower, more preferably 1.0% or lower, and most preferably 0.5% or lower. For example, in cases where the Pb content is 0.04 mass % or lower or the proportion of κ phase is 40% or lower, machinability can be better improved if the amount of γ phase is 0.1% to 0.5% because the properties such as corrosion resistance and machinability will be less affected although depending on the Pb content or the amount of κ phase.

Since the length of the long side of γ phase affects corrosion resistance, the length of the long side of γ phase is preferably 40 μm or less, more preferably 30 μm or less, and most preferably 20 μm or less.

As the amount of γ phase increases, γ phase is more likely to be selectively corroded. In addition, the longer the lengths of γ phase and a series of γ phases are, the more likely γ phase is to be selectively corroded, and the progress of corrosion in the direction away from the surface is accelerated. In addition, the larger the corroded portion is, the more affected the corrosion resistance of α' phase and κ phase or α phase present around the corroded γ phase is.

The proportion of γ phase and the length of the long side of γ phase have a large relation with the contents of Cu, Sn, and Si and the composition relational expressions f0, f1, and f2. Regarding corrosion resistance, the proportion of γ phase is preferably 0.1% to 0.5% when the composition, the influence on corrosion resistance, machinability, and the other properties are comprehensively taken into consideration. Even when a small amount of γ phase is present, the influence on corrosion resistance and the like is small, and comprehensively, it is most preferable that the proportion of γ phase is 0.1% to 0.5%.

In addition, as the proportion of γ phase increases, ductility, impact resistance, high-temperature strength, and stress corrosion cracking resistance deteriorate. Therefore, the proportion of γ phase is necessarily 2.0% or lower, preferably 1.5% or lower, more preferably 1.0% or lower, and most preferably 0.5% or lower. When a high stress is applied, γ phase present in a metallographic structure becomes as a stress concentration source. In addition, in combination with BCC as a crystal structure of γ phase, high-temperature strength, impact resistance, and stress corrosion cracking resistance deteriorate.

The shape of γ phase affects not only corrosion resistance but also the properties. γ phase in which the length of the long side is long is mainly present at a boundary between α phase and κ phase. Therefore, ductility and impact resistance deteriorate. In addition, the γ phase is likely to become a stress concentration source and promotes phase boundary sliding. Therefore, deformation caused by high temperature creep is likely to occur, and stress corrosion cracking is likely to occur.

(μ Phase)

μ phase affects corrosion resistance, ductility, impact resistance, and high temperature properties. Therefore, it is necessary that the proportion of μ phase is at least 0% to 2.0%. The proportion of μ phase is preferably 1.0% or lower and more preferably 0.3% or lower, and it is most preferable that μ phase is not present. μ phase is mainly present at a grain boundary or a phase boundary. Therefore, in a harsh environment, grain boundary corrosion occurs at a grain boundary where μ phase is present. In addition, when impact is applied, cracks are more likely to develop from hard μ phase present at a grain boundary. In addition, for example, when a copper alloy is used in a valve used around the engine of a vehicle or in a high-temperature, high-pressure gas valve, if the copper alloy is held at a high temperature of 150° C. for a long period of time, grain boundary sliding occurs, and creep is more likely to occur. Therefore, it is necessary to limit the amount of μ phase, and at the same time limit the length of the long side of μ phase that is mainly present at a grain boundary to 25 μm or less. The length of the long side of μ phase is preferably 15 μm or less, more preferably 5 μm or less, still more preferably 4 μm or less, and most preferably 2 μm or less.

The length of the long side of μ phase is measured using the same method as the method of measuring the length of the long side of γ phase. That is, by using, for example, a 500-fold or 1000-fold metallographic micrograph or using a 2000-fold or 5000-fold secondary electron micrograph (electron micrograph) according to the size of μ phase, the maximum length of the long side of μ phase in one visual field is measured. This operation is performed in a plurality of visual fields, for example, five arbitrarily chosen visual fields. The average maximum length of the long sides of μ phase calculated from the lengths measured in the respective visual fields is regarded as the length of the long side of μ phase. Therefore, the length of the long side of μ phase can be referred to as the maximum length of the long side of μ phase.

(κ Phase)

Under recent high-speed cutting conditions, the machinability of a material including cutting resistance and chip dischargeability is important. However, in order to obtain excellent machinability in a state where the proportion of γ phase having the highest machinability-improvement function is limited to be 2.0% or lower, it is necessary that the proportion of κ phase is at least 36% or higher. This κ phase refers to κ phase to which Sn is added to improve machinability. The proportion of κ phase is preferably 40% or higher and more preferably 42% or higher. In addition, when the proportion of κ phase is appropriate, corrosion resistance and high temperature properties are improved.

On the other hand, when the proportion of κ phase that is harder than α phase is excessively high, machinability deteriorates, and cold workability, ductility, impact resistance, and hot workability also deteriorate. That is, the upper limit of the proportion of κ phase is present, and an appropriate amount of α phase is necessary. Although machinability of κ phase is low, an appropriate amount of soft α phase having low machinability functions as a cushioning material such that machinability is also improved. Likewise, cold workability, ductility, impact resistance, and hot workability are also improved. Therefore, the proportion of κ phase is 72% or lower. Since κ phase is harder than α phase, a metallographic structure in which α phase and κ phase are mixed is adopted to increase strength. However, high tensile strength cannot be obtained only with hardness. Tensile strength is determined based on a balance between hardness and ductility. When the proportion of κ phase is higher than 75%, hardness increases, but ductility deteriorates. Therefore, tensile strength is saturated and deteriorates instead. The proportion of κ phase is preferably 67% or lower and more preferably 62% or lower. On the other hand, when the proportion of κ phase (κ phase ratio) is lower than 36%, tensile strength may deteriorate. Therefore, the proportion of κ phase is preferably 36% or higher and more preferably 40% or higher.

Whether or not coarse α phase appears relates to the relational expressions f0 and f2. Specifically, when the value of f2 is higher than 63.7, coarse α phase is likely to appear. When the value of f0 is lower than 1.0, coarse α phase is likely to appear. Due to the appearance of coarse α phase, tensile strength and machinability deteriorate.

(Metallographic Structure Relational Expressions f3, f4, f5, and f6)

In addition, in order to obtain excellent corrosion resistance, impact resistance, and high-temperature strength, it is necessary that the total proportion of α phase and κ phase (metallographic structure relational expression f3=(α)+(κ)) is 96.5% or higher. The value of f3 is preferably 97.5% or higher and most preferably 98% or higher. Likewise, the total proportion of α phase, κ phase, γ phase, and μ phase (metallographic structure relational expression f4=(α)+(κ)+(γ)+(μ)) is 99.4% or higher and preferably 99.6% or higher.

Further, it is necessary that the total proportion of γ phase and μ phase (f5=(γ)+(μ)) is 3.0% or lower. The value of f5 is preferably 2.0% or lower, more preferably 1.5% or lower, and most preferably 1.0% or lower.

Here, regarding the metallographic structure relational expressions f3 to f6, 10 kinds of metallic phases including α phase, μ phase, γ phase, δ phase, ε phase, ζ phase, η phase, κ phase, μ phase, and χ phase are targets, and an intermetallic compound, Pb particles, an oxide, a non-metallic inclusion, a non-melted material, and the like are not targets. In addition, it is necessary to consider the amount of intermetallic compounds that are formed by Si and inevitably incorporated elements (for example, Fe, Co, Mn, and P). In consideration of the influence on machinability and the properties, it is preferable that the area ratio of the intermetallic compounds between Fe, Co, Mn, and P and Si is 0.5% or lower and more preferably 0.3% or lower.

(Metallographic Structure Relational Expression f6)

In the alloy according to the embodiment, it is necessary that machinability is excellent while minimizing the Pb content in the Cu—Zn—Si alloy, and it is necessary that the alloy has particularly excellent corrosion resistance, impact resistance, and high-temperature strength. However, γ phase improves machinability, but it is not good to obtain excellent corrosion resistance and impact resistance.

Metallographically, it is preferable to contain a large amount of γ phase having the highest machinability. However, from the viewpoints of corrosion resistance, impact resistance, and other properties, it is necessary to reduce the amount of γ phase. It was found from experiment results that, when the proportion of γ phase is 2.0% or lower, it is necessary that the value of the metallographic structure relational expression f6 is in an appropriate range in order to obtain excellent machinability.

γ phase has the highest machinability. However, in particular, when the amount of γ phase is small, that is, the area ratio of γ phase is 2.0% or lower, a coefficient that is six times the proportion ((κ)) of κ phase is assigned to the square root value of the proportion of γ phase ((γ) (%)). In order to obtain excellent machinability, it is necessary that the metallographic structure relational expression f6 is 38 or higher. The value of f6 is preferably 42 or higher and more preferably or higher. When the value of the metallographic structure relational expression f6 is 38 to 42, in order to obtain excellent machinability, it is preferable that the Pb content is 0.022 mass % or higher or the amount of Sn in κ phase is 0.11 mass % or higher.

On the other hand, when the metallographic structure relational expression f6 is higher than 80, the amount of κ phase is likely to be excessively large, machinability deteriorates again, and impact resistance also deteriorates. Therefore, it is necessary that the metallographic structure relational expression f6 is 80 or lower. The value of f6 is preferably 72 or lower and more preferably 67 or lower.

(Amounts of Sn and P in κ Phase)

In order to improve the corrosion resistance of κ phase, it is preferable if the alloy contains 0.07 mass % to 0.28 mass % of Sn and 0.06 mass % to 0.14 mass % of P.

In the alloy according to the embodiment, when the Sn content is 0.07 to 0.28 mass %, assuming that the amount of Sn distributed in α phase is 1, the amount of Sn distributed in κ phase is about 1.5, the amount of Sn distributed in γ phase is about 15, and the amount of Sn distributed in μ phase is about 2. For example, in the case of the alloy according to the embodiment, in a Cu—Zn—Si alloy including 0.2 mass % of Sn, when the proportion of α phase is 50%, the proportion of κ phase is 49%, and the proportion of γ phase is 1%, the Sn concentration in α phase is about 0.14 mass %, the Sn concentration in κ phase is about 0.21 mass %, and the Sn concentration in γ phase is about 2.1 mass %. When the area ratio of γ phase is high, the amount of Sn consumed by γ phase is large, and the amounts of Sn distributed in κ phase and α phase are small. Accordingly, if the amount of γ phase is small, Sn is effectively used for corrosion resistance and machinability as described below.

On the other hand, assuming that the amount of P distributed in α phase is 1, the amount of P distributed in κ phase is about 2, the amount of P distributed in γ phase is about 3, and the amount of P distributed in μ phase is about 3. For example, in the case of the alloy according to the embodiment, in a Cu—Zn—Si alloy including 0.1 mass % of P, when the proportion of α phase is 50%, the proportion of κ phase is 49%, and the proportion of γ phase is 1%, the P concentration in α phase is about 0.06 mass %, the P concentration in κ phase is about 0.13 mass %, and the P concentration in γ phase is about 0.18 mass %.

Both Sn and P improve the corrosion resistance of α phase and κ phase, and the amount of Sn and the amount of P in κ phase are about 1.5 times and about 2 times the amount of Sn and the amount of P in α phase, respectively. That is, the amount of Sn in κ phase is about 1.5 times the amount of Sn in α phase, and the amount of P in κ phase is about 2 times the amount of P in α phase. Therefore, the degree of corrosion resistance improvement of κ phase is higher than that of α phase. As a result, the corrosion resistance of κ phase approaches the corrosion resistance of α phase. By adding both Sn and P, in particular, the corrosion resistance of κ phase can be improved. However, even though there is a difference in content, the contribution of Sn to corrosion resistance is higher than that of P.

When the Sn content is lower than 0.07 mass %, the corrosion resistance and dezincification corrosion resistance of κ phase are lower than the corrosion resistance and dezincification corrosion resistance of α phase. Therefore, under bad water quality, κ phase is selectively corroded. The distribution of a large amount of Sn in κ phase improves the corrosion resistance of κ phase, which is lower than the corrosion resistance of α phase, such that the corrosion resistance of κ phase including a given concentration or higher of Sn approaches the corrosion resistance of α phase. Likewise, addition of Sn to κ phase has an effect of improving the machinability-improvement function of κ phase. To that end, the Sn concentration in κ phase is preferably 0.08 mass % or higher, more preferably 0.09 mass % or higher, and still more preferably 0.11 mass % or higher. By increasing the Sn concentration in κ phase, the machinability-improvement function of κ phase is improved.

On the other hand, a large amount of Sn is distributed in γ phase. However, even when a large amount of Sn is added to γ phase, the corrosion resistance of γ phase is not substantially improved mainly because the crystal structure of γ phase is a BCC structure. On the contrary, when the proportion of γ phase is high, the amount of Sn distributed in κ phase is small. Therefore, the corrosion resistance of κ phase is not improved. When a large amount of Sn is distributed in κ phase, the machinability of κ phase is improved, and the loss of the machinability of γ phase can be compensated for. It is presumed that, by adding a predetermined amount or more of Sn to κ phase, the machinability function and chip partibility of κ phase itself are improved. However, when the Sn concentration in κ phase is higher than 0.45 mass %, the machinability of the alloy is improved, and the ductility of κ phase starts to deteriorate. Therefore, the upper limit of the Sn concentration in κ phase is preferably 0.45 mass % or lower, more preferably 0.40 mass % or lower, and still more preferably 0.36 mass % or lower.

As in the case of Sn, when a large amount of P is distributed in κ phase, corrosion resistance is improved, and the machinability of κ phase is also improved. However, when an excessive amount of P is added, P is consumed by formation of an intermetallic compound with Si such that the properties deteriorate, or if excessively solid-solubilized, impact resistance and ductility are impaired. The lower limit of the P concentration in κ phase is preferably 0.07 mass % or higher and more preferably 0.08 mass % or higher. The upper limit of the P concentration in κ phase is preferably 0.22 mass % or lower, more preferably 0.2 mass % or lower.

<Properties>

(Normal-Temperature Strength and High-Temperature Strength)

As a strength required in various fields of valves for drinking water, devices, and automobiles, a tensile strength that is a breaking stress to be applied to a pressure vessel is important. In addition, for example, a valve used in an environment near an engine room of a vehicle or a high-temperature high-pressure valve is used in a temperature environment of 150° C. at a maximum. At this time, of course, it is required that deformation is not likely to occur when a stress or a load is applied.

To that end, it is preferable that a hot extruded material or a hot forged material as a hot worked material is a high strength material having a tensile strength of 560 $N/mm^2$ or higher at a normal temperature. The tensile strength at a normal temperature is more preferably 570 $N/mm^2$ or higher and more preferably 585 $N/mm^2$ or higher. In general, cold working is not performed on the hot forged material in practice. On the other hand, the hot worked material is drawn or wire-drawn in a cold state to improve the strength. In the alloy according to the embodiment, at a cold working ratio of 15% or lower, the tensile strength increases by 12 $N/mm^2$ per 1% of cold working ratio. On the other hand, the impact resistance decreases by about 4% per 1% of cold working ratio. For example, when a hot extruded material having a tensile strength of 590 $N/mm^2$ and an impact value of 20 $J/cm^2$ is cold-drawn at a cold working ratio 5% to prepare a cold worked material, the tensile strength of the cold worked material is about 650 $N/mm^2$, and the impact value is about 16 $J/cm^2$. When the cold working ratio varies, the tensile strength and the impact value cannot be uniquely determined.

Regarding the tensile strength as a measure for strength and the impact resistance representing toughness, for example, when (tensile strength)×(1+0.12×(impact strength)$^{1/2}$) is 830 or higher, it can be said that the copper alloy has high strength, toughness, and ductility.

Regarding the high-temperature strength (high temperature creep strength), it is preferable that a creep strain after exposing the alloy at 150° C. for 100 hours in a state where a stress corresponding to 0.2% proof stress at room temperature is applied is 0.4% or lower. This creep strain is more preferably 0.3% or lower and still more preferably 0.2% or lower. In this case, the copper alloy is not likely to be deformed even when exposed to a high temperature and has high-temperature strength.

Incidentally, in the case of free-cutting brass including 60 mass % of Cu, 3 mass % of Pb with a balance including Zn and inevitable impurities, tensile strength at a normal temperature is 360 $N/mm^2$ to 400 $N/mm^2$ when formed into a hot extruded material or a hot forged product. In addition, even after the alloy is exposed to 150° C. for 100 hours in a state where a stress corresponding to 0.2% proof stress at room temperature is applied, the creep strain is about 4% to 5%. Therefore, the tensile strength and heat resistance of the alloy according to the embodiment are higher than those of conventional free-cutting brass including Pb. That is, the alloy according to the embodiment has high strength at room temperature and scarcely deforms even after being exposed to a high temperature for a long period of time. Therefore, a reduction in thickness and weight can be realized using the high strength. In particular, in the case of a forged material such as a high-pressure valve, cold working cannot be performed. Therefore, high performance and a reduction in thickness and weight can be realized using the high strength.

In the case of the alloy according to the embodiment, there is little difference in the properties under high temperature between an extruded material and a cold worked material. That is, the 0.2% proof stress increases due to cold working, but even if a load corresponding to a high 0.2% proof stress is applied, creep strain after exposing the alloy to 150° C. for 100 hours is 0.4% or lower, and the alloy has high heat resistance. Properties under high temperature are mainly affected by the area ratios of β phase, γ phase, and μ phase, and the higher the area ratios are, the worse high temperature properties are. In addition, the longer the length of the long side of μ phase or γ phase present at a grain boundary of α phase or at α phase boundary is, the worse high temperature properties are.

(Impact Resistance)

In general, when a material has high strength, the material is brittle. It is said that a material having chip partibility during cutting has some kind of brittleness. Impact resistance is contrary to machinability and strength in some aspect.

However, when the copper alloy is used in various members including drinking water supply devices such as valves or fittings, automobile components, mechanical components, and industrial plumbing components, it is necessary that the copper alloy has high strength and resistance to impact to some extent. Specifically, when a Charpy impact test is performed using a U-notch specimen, a Charpy impact test value is preferably 12 J/cm$^2$ or higher and more preferably 15 J/cm$^2$ or higher. In the alloy according to the embodiment, it is not necessary that the Charpy impact test value is higher than 50 J/cm$^2$ regardless of the use thereof regarding the alloy having excellent machinability. Conversely, when the Charpy impact test value is higher than 50 J/cm$^2$, toughness increases, that is, material stickiness increases, cutting resistance is improved, and machinability deteriorates. For example, chipping is likely to continuously occur. Therefore, the Charpy impact test value is preferably 50 J/cm$^2$ or lower.

Impact resistance of the alloy according to the embodiment also has a close relation with a metallographic structure, and γ phase deteriorates impact resistance. In addition, if μ phase is present at a grain boundary of α phase or a phase boundary between α phase, κ phase, and γ phase, the grain boundary and the phase boundary is embrittled, and impact resistance deteriorates.

As a result of a study, it was found that if μ phase having the length of the long side of more than 25 μm is present at a grain boundary or a phase boundary, impact resistance particularly deteriorates. Therefore, the length of the long side of μ phase present is 25 μm or less, preferably 15 μm or less, more preferably 5 μm or less, still more preferably 4 μm or less, and most preferably 2 μm or less. In addition, in a harsh environment, μ phase present at a grain boundary is more likely to corrode than α phase or κ phase, thus causes grain boundary corrosion and deteriorate properties under high temperature. Needless to say, the longer the long side of γ phase is, the more the impact resistance deteriorates.

In the case of μ phase, if the occupancy ratio is low, it is difficult to detect the μ phase using a metallographic microscope at a magnification of about 500-fold or 1000-fold. When observing μ phase whose length is 5 μm or less, the μ phase may be observed at a grain boundary or α phase boundary using an electron microscope at a magnification of about 2000-fold or 5000-fold, μ phase can be found at a grain boundary or a phase boundary.

<Manufacturing Process>

Next, a method of manufacturing the free-cutting copper alloy according to the first or second embodiment of the present invention will be described.

The metallographic structure of the alloy according to the embodiment varies not only depending on the composition but also depending on the manufacturing process. The metallographic structure of the alloy is affected not only by hot working temperature of hot extrusion and hot forging but also by an average cooling rate in the process of cooling after hot working. As a result of thorough investigation, it was found that the metallographic structure is largely affected by the cooling rate in a temperature range from 470° C. to 380° C. in the process of cooling after hot working. In addition, it was also found that the metallographic structure is largely affected by the temperature and heating time of a low-temperature annealing step after a working step.

(Melt Casting)

Melting is performed at a temperature of about 950° C. to about 1200° C. that is higher than the melting point (liquidus temperature) of the alloy according to the embodiment by about 100° C. to about 300° C. Casting is performed at about 900° C. to about 1100° C. that is higher than the melting point by about 50° C. to about 200° C. The alloy is cast into a predetermined mold and is cooled by some cooling means such as air cooling, slow cooling, or water cooling. After solidification, constituent phase(s) changes in various ways.

(Hot Working)

Examples of hot working include hot extrusion and hot forging.

Although depending on facility capacity, it is preferable that hot extrusion is performed at a material's temperature during actual hot working, specifically, under a condition where a temperature (hot working temperature) immediately after the material passes through an extrusion die is 600° C. to 740° C. When hot working is performed at a temperature of higher than 740° C., a large amount of β phase is formed during plastic working, and β phase may remain. In addition, a large amount of γ phase remains and has an adverse effect on a constituent phase after cooling. Specifically, the amount of γ phase increases or β phase remains as compared to hot working is performed at a temperature of 740° C. or lower. In some cases, hot working cracking occurs. The hot working temperature is preferably 690° C. or lower and more preferably 645° C. or lower. The hot working temperature is largely affected by the formation and remaining of γ phase.

During cooling, an average cooling rate in a temperature range from 470° C. to 380° C. is 2.5° C./min to 500° C./min. The average cooling rate in a temperature range from 470° C. to 380° C. is preferably 4° C./min or higher and more preferably 8° C./min or higher. As a result, an increase in the amount of μ phase is prevented.

In addition, when the hot working temperature is low, hot deformation resistance is improved. From the viewpoint of deformability, the lower limit of the hot working temperature is preferably 600° C. or higher and more preferably 605° C. or higher. When the extrusion ratio is 50 or lower, or when hot forging is performed in a relatively simple shape, hot working can be performed at 600° C. or higher. Roughly, the lower limit of the hot working temperature is preferably 605° C. Although depending on facility capacity, it is preferable that the hot working temperature is as low as possible from the viewpoint of the constituent phase of the metallographic structure.

The hot working temperature is measured as follows in consideration of a measurement position where measurement can be actually performed. In the case of hot extrusion, the temperature of the extruded material is measured about 3 seconds after extruded from an extruder, and the average temperature of the extruded material from the time when about 50% of the ingot (billet) is extruded to the end of the extrusion is defined as the hot working temperature (hot extrusion temperature). In the case of hot extrusion, whether or not extrusion can be performed to the end is important, and the material's temperature in the latter half of extrusion is important. In the case of hot forging, the temperature of the forged product about 3 seconds after forging at which actual measurement can be performed is defined as the hot working temperature (hot forging temperature). Metallographically, the temperature immediately after large plastic deformation largely affects the phase constitution and is important.

As the hot working temperature, the surface temperature of the billet may be adopted. However, in the embodiment, the surface temperature of the billet is not adopted because a difference in temperature between the surface and the inside of the billet and the time from the heating of the billet to the extrusion vary depending on the facility layout or the operational state.

Most of extruded materials are made of brass alloys including 1 to 4 mass % of Pb. In the case of the brass alloy, after hot extrusion, the extruded material is wound into a coil unless the diameter of the extruded material exceeds, for example, about 38 mm. The heat of the ingot (billet) during extrusion is taken by an extrusion device such that the temperature of the ingot decreases. The extruded material comes in contact with a winding device such that heat is taken and the temperature further decreases. A temperature decrease of 50° C. to 100° C. from the temperature of the ingot at the start of the extrusion or from the temperature of the extruded material occurs when the average cooling rate is relatively high. Although depending on the weight of the coil and the like, the wound coil is cooled in a temperature range from 470° C. to 380° C. at a relatively low average cooling rate of about ° C./min due to a heat keeping effect. After the material's temperature reaches about 300° C., the average cooling rate further declines. Therefore, water cooling is sometimes performed to facilitate the production. In the case of a brass alloy including Pb, hot extrusion is performed at about 600° C. to 800° C. In the metallographic structure immediately after extrusion, a large amount of β phase having excellent hot workability is present. When the average cooling rate after extrusion is high, a large amount of β phase remains in the cooled metallographic structure such that corrosion resistance, ductility, impact resistance, and high temperature properties deteriorate. In order to avoid the deterioration, by cooling at a relatively low average cooling rate using the heat keeping effect of the extruded coil and the like, β phase is made to transform into α phase so that the metallographic structure has abundant α phase is obtained. As described above, the average cooling rate of the extruded material is relatively high immediately after extrusion. Therefore, by performing subsequent cooling at a lower cooling rate, a metallographic structure that is rich in α phase is obtained. In particular, in order to obtain corrosion resistance or ductility, the average cooling rate is intentionally set to be lower in many cases. Patent Document 1 does not describe the average cooling rate but discloses that, in order to reduce the amount of β phase and to isolate β phase, slow cooling is performed until the temperature of an extruded material is 180° C. or lower.

On the other hand, in the embodiment, when the alloy is cooled at a low average cooling rate, the amounts of α phase and κ phase decrease, and the amount of μ phase increases unlike the alloy of the related art. Specifically, when the average cooling rate in a temperature range from 470° C. to 370° C. is low, μ phase is formed and grows around a grain boundary of α phase or a phase boundary between α phase and κ phase. Therefore, the amount of α phase decreased increases.

(Hot Forging)

As a material in hot forging, a hot extruded material is mainly used, but a continuously cast rod is also used. Since hot forging is performed in a more complex shape than that in hot extrusion, the temperature of the material before forging is high. However, the temperature of a hot forged material that is highly plastically worked and forms a main portion of a forged product, that is, the material's temperature about 3 seconds after forging is 600° C. to 740° C. like the extruded material. During cooling and after hot forging, the average cooling rate in a temperature range from 470° C. to 380° C. is 2.5° C./min to 500° C./min. The average cooling rate in a temperature range from 470° C. to 380° C. is preferably 4° C./min or 5° C./min or higher and more preferably 8° C./min or higher. As a result, an increase in the amount of μ phase is prevented.

In cases where the material of hot forging is a hot extruded rod and has a metallographic structure in which the amount of γ phase is small, even when the hot forging temperature is high, the metallographic structure is maintained.

Further, during cooling of the forged material, an average cooling rate in a temperature range from 575° C. to 510° C. is preferably 0.1° C./min to 2.5° C./min. This way, it is preferable that the forged material is cooled in the temperature range at a lower average cooling rate. As a result, the amount of γ phase is reduced, the length of the long side of γ phase is reduced, and corrosion resistance, impact resistance, and high temperature properties can be improved. The lower limit value of the average cooling rate in a temperature range from 575° C. to 510° C. is set to be 0.1° C./min or higher in consideration of economic efficiency, and when the average cooling rate is higher than 2.5° C./min, the amount of γ phase is not sufficiently reduced. As more preferable conditions, the average cooling rate in a temperature range from 575° C. to 510° C. is set to 1.5° C./min or lower, and the average cooling rate in a temperature range from 470° C. to 380° C. is set to be 4° C./min or higher and 5° C./min or higher.

Regarding the metallographic structure of the alloy according to the embodiment, one important thing in the manufacturing step is the average cooling rate in a temperature range from 470° C. to 380° C. in the process of cooling after the hot working. When the average cooling rate is lower than 2.5° C./min, the proportion of μ phase increases. μ phase is mainly formed around a grain boundary or a phase boundary. In a harsh environment, the corrosion resistance of μ phase is lower than that of α phase or κ phase. Therefore, selective corrosion of μ phase or grain boundary corrosion is caused to occur. In addition, as in the case of γ phase, μ phase becomes a stress concentration source or causes grain boundary sliding to occur such that impact resistance or high-temperature strength deteriorates. Preferably, in the process of cooling after hot working, the average cooling rate in a temperature range from 470° C. to 380° C. is 2.5° C./min or higher, preferably 4° C./min or higher, more preferably 8° C./min or higher, still more preferably 12° C./min or higher, and most preferably 15° C./min or higher. When rapid cooling from a high material's temperature of 580° C. or higher is performed after hot working at an average cooling rate of, for example, higher than 500° C./min, a large amount of β phase or γ phase remains. Therefore, the average cooling rate in a temperature range from 470° C. to 380° C. is necessarily 500° C./min or lower. The average cooling rate in this temperature range is preferably 300° C./min or lower and more preferably 200° C./min or lower.

When the metallographic structure is observed using a 2000-fold or 5000-fold electron microscope, an average cooling rate at a boundary at which μ phase is about to be present is about 8° C./min in a temperature range from 470° C. to 380° C. In particular, a critical average cooling rate having a large effect on the properties is 2.5° C./min or 4° C./min in a temperature range from 470° C. to 380° C.

That is, when the average cooling rate in a temperature range from 470° C. to 380° C. is lower than 8° C./min, the length of the long side of μ phase precipitated at a grain boundary is more than about 1 μm, and μ phase further grows as the average cooling rate becomes lower. When the average cooling rate is lower than about 4° C./min, the length of the long side of μ phase is more than about 4 μm or 5 μm, and corrosion resistance, impact resistance, and high temperature properties may be affected. When the average cooling rate is lower than about 2.5° C./min, the length of the long side of μ phase is more than about 10 or 15 μm and, in some cases, is more than about 25 μm. When the length of the long side of μ phase reaches about 10 μm, μ phase can be distinguished from a grain boundary and can be observed using a 1000-fold metallographic microscope. On the other hand, the upper limit of the average cooling rate varies depending on the hot working temperature or the like. When the average cooling rate is excessively high, a constituent phase that is formed under high temperature is maintained as it is even under normal temperature, the amount of κ phase increases, and the amounts of β phase and γ phase having an effect on corrosion resistance and impact resistance increase. Therefore, mainly, the average cooling rate in a temperature range from 580° C. or higher is important, but the average cooling rate in a temperature range from 470° C. to 380° C. is necessarily 500° C./min or lower. This average cooling rate is preferably 300° C./min or lower.

(Cold Working Step)

In order to improve the dimensional accuracy or to straighten the extruded coil, cold working may be performed on the hot extruded material. Specifically, the hot extruded material or the heat treated material is cold-drawn at a working ratio of about 2% to about 20%, preferably about 2% to about 15% and more preferably about 2% to about 10% and then is corrected (combined operation of drawing and straightness correction). In addition, the hot extruded material or the heat treated material is wire-drawn in a cold state at a working ratio of about 2% to about 20%, preferably about 2% to about 15%, and more preferably about 2% to about 10%. Although the cold working ratio is substantially zero, the straightness of the rod material can be improved using a straightness correction facility.

(Low-Temperature Annealing)

A rod material or a forged product may be annealed at a low temperature which is lower than the recrystallization temperature in order to remove residual stress or to correct the straightness of rod material. As low-temperature annealing conditions, it is desired that the material's temperature is 240° C. to 350° C. and the heating time is 10 minutes to 300 minutes. Further, it is preferable that the low-temperature annealing is performed so that the relation of $150 \leq (T-220) \times (t)^{1/2} \leq 1200$, wherein the temperature (material's temperature) of the low-temperature annealing is represented by T (° C.) and the heating time is represented by t (min), is satisfied. Note that the heating time t (min) is counted (measured) from when the temperature is 10° C. lower (T−10) than a predetermined temperature T (° C.).

When the low-temperature annealing temperature is lower than 240° C., residual stress is not removed sufficiently, and straightness correction is not sufficiently performed. When the low-temperature annealing temperature is higher than 350° C., μ phase is formed around a grain boundary or a phase boundary. When the low-temperature annealing time is shorter than 10 minutes, residual stress is not removed sufficiently. When the low-temperature annealing time is longer than 300 minutes, the amount of μ phase increases. As the low-temperature annealing temperature increases or the low-temperature annealing time increases, the amount of μ phase increases, and corrosion resistance, impact resistance, and high-temperature strength deteriorate. However, as long as low-temperature annealing is performed, precipitation of μ phase is not avoidable. Therefore, how precipitation of μ phase can be minimized while removing residual stress is the key.

The lower limit of the value of $(T-220) \times (t)^{1/2}$ is 150, preferably 180 or higher, and more preferably 200 or higher. In addition, the upper limit of the value of $(T-220) \times (t)^{1/2}$ is 1200, preferably 1100 or lower, and more preferably 1000 or lower.

Using this manufacturing method, the free-cutting copper alloy according to the first or second embodiment of the present invention is manufactured. The manufacturing method is not particularly limited as long as any one of the hot working step and the low-temperature annealing step satisfies the above-described conditions, and both the hot working step and the low-temperature annealing step may be performed under the above-described conditions.

In the free-cutting alloy according to the first or second embodiment of the present invention having the above-described constitution, the alloy composition, the composition relational expressions, the metallographic structure, and the metallographic structure relational expressions are defined as described above. Therefore, corrosion resistance in a harsh environment, impact resistance, and high-temperature strength are excellent. In addition, even if the Pb content is low, excellent machinability can be obtained.

The embodiments of the present invention are as described above. However, the present invention is not limited to the embodiments, and appropriate modifications can be made within a range not deviating from the technical requirements of the present invention.

EXAMPLES

The results of an experiment that was performed to verify the effects of the present invention are as described below. The following Examples are shown in order to describe the effects of the present invention, and the requirements for composing the example alloys, processes, and conditions included in the descriptions of the Examples do not limit the technical range of the present invention.

Example 1

<Experiment on the Actual Production Line>

Using a low-frequency melting furnace and a semi-continuous casting machine on the actual production line, a trial manufacture test of copper alloy was performed. Table 2 shows alloy compositions. Since the equipment used was the one on the actual production line, impurities were also measured in the alloys shown in Table 2. In addition, manufacturing steps were performed under the conditions shown in Tables 5 to 7.

(Steps No. A1 to A6 and AH1 to AH5)

Using the low-frequency melting furnace and the semi-continuous casting machine on the actual production line, a billet having a diameter of 240 mm was manufactured. As to raw materials, those used for actual production were used. The billet was cut into a length of 800 mm and was heated. Then hot extruded into a round bar shape having a diameter of 25.5 mm, and the round bar was wound into a coil (extruded material). During a period from the time when about 50% of the billet was hot-extruded to the time when the billet was extruded to the end, the temperature was measured using a radiation thermometer. About 3 seconds is required to wind the billet into a coil from the extruder. At this time, the material's temperature was measured, and the average extrusion temperature from the middle of extrusion to the end of extrusion was obtained. As the average extrusion temperature, the hot working temperature (hot extrusion temperature) was used. A radiation thermometer DS-06DF (manufactured by Daido Steel Co., Ltd.) was used.

It was verified that the average temperature of the extruded material was within ±5° C. of a temperature shown in Table 5 (in a range of (temperature shown in Table 5)−5° C. to (temperature shown in Table 5)+5° C.)

The average cooling rate in a temperature range from 575° C. to 510° C. and the average cooling rate in a temperature range from 470° C. to 380° C. were adjusted to conditions shown in Table 5, for example, by adjusting a cooling fan and maintaining the temperature of the winding coil material.

The obtained round bar having a diameter of 25.5 mm was cold-drawn at a cold working ratio of about 5% and was corrected to obtain a diameter of 25 mm (combined drawing and correction).

In the following tables, a case where the combined drawing and correction were performed is represented by "○", and a case where the combined drawing and correction were not performed is represented by "-".

(Steps No. B1 to B3 and BH1 to BH3)

A rod material obtained in Step No. A1 was cut into a length of 3 m. Next, the rod material was set in a mold having an H-shape in cross-section and having a bottom surface with high flatness (a curvature of 0.1 mm or lower per 1 m) and was annealed at a low temperature for correction. The low-temperature annealing was performed under conditions shown in Table 5. A value of a conditional expression in the tables was a value of the following expression.

$$(\text{Conditional Expression})=(T-220)\times(t)^{1/2}$$

T: temperature (material's temperature) (° C.)

t: heating time (min)

(Steps No. C1, C2, and CH1)

Using the low-frequency melting furnace and the semi-continuous casting machine used on the actual production line, an ingot (billet) having a diameter of 240 mm was manufactured. As to raw materials, raw materials corresponding to those used for actual production were used. The billet was cut into a length of 500 mm and was heated. Hot extrusion was performed to obtain a round bar-shaped extruded material having a diameter of 50 mm. This extruded material was extruded to an extrusion table in a linear rod shape. This hot extrusion was performed at an extrusion temperature of any one of three conditions shown in Table 5. The temperature was measured using a radiation thermometer. The temperature was measured about 3 seconds after the billet was extruded from the extruder. During a period from the time when 50% of the billet was extruded to the end of extrusion, the temperature of the extruded material was measured, and the average extrusion temperature from the middle of extrusion to the end of extrusion was obtained. As the average extrusion temperature, the hot working temperature (hot extrusion temperature) was used.

It was verified that the average temperature of the extruded material was within ±5° C. of a temperature shown in Table 5 (in a range of (temperature shown in Table 5)−5° C. to (temperature shown in Table 5)+5° C.)

After the extrusion, the average cooling rate in a temperature range from 575° C. to 510° C. was 25° C./min, and the average cooling rate in a temperature range from 470° C. to 380° C. was 15° C./min (extruded material).

(Steps No. D1 to D8 and DH1 and DH2, Hot Forging)

Each of round bars having a diameter of 50 mm obtained in Step No. C1 to C2 and CH1 was cut into a length of 200 mm. This round bar was horizontally set and was forged into a thickness of 16 mm using a press machine having a hot forging press capacity of 150 ton. About 3 seconds immediately after hot forging the material into a predetermined thickness, the temperature was measured using the radiation thermometer.

It was verified that the hot forging temperature (hot working temperature) was within ±5° C. of a temperature shown in Table 6 (in a range of (temperature shown in Table 6)−5° C. to (temperature shown in Table 6)+5° C.). Hot forging was performed while fixing the forging temperature and making the average cooling rate in a temperature range from 575° C. to 510° C. and the average cooling rate in a temperature range from 470° C. to 380° C. to vary. In Step No. D7, after hot forging, low-temperature annealing was performed under conditions shown in Table 6 in order to remove residual stress.

(Step No. G)

By performing hot extrusion, a hexagonal bar having a distance of 17.8 mm between parallel sides was obtained. This hexagonal bar was extruded to an extrusion table as in Step No. C1. Next, by performing drawing and correction, a hexagonal bar having a distance of 17 mm between parallel sides was obtained. As shown in Table 7, the extrusion temperature was 640° C., the average cooling rate in a temperature range from 575° C. to 510° C. was 20° C./min, and the average cooling rate in a temperature range from 470° C. to 380° C. was 25° C./min.

<Laboratory Experiment>

Using a laboratory facility, a trial manufacture test of copper alloy was performed. Tables 3 and 4 show alloy compositions. The balance refers to Zn and inevitable impurities. The copper alloys having the compositions shown in Table 2 were also used in the laboratory experiment. In addition, manufacturing steps were performed under the conditions shown in Tables 8 to 9.

(Steps No. E1 and E2)

In a laboratory, raw materials were melted at a predetermined component ratio, the melt was cast into a mold having a diameter of 100 mm and a length of 180 mm, and was cut into a diameter of 95 mm to prepare a billet. This billet was heated and was extruded into a round bar having a diameter of 25 mm or 40 mm. About 3 seconds after the start of extrusion, the temperature of the material was measured using the radiation thermometer. During a period from the time when 50% of the billet was extruded to the end of extrusion, the temperature of the extruded material was measured, and the average extrusion temperature from the middle of extrusion to the end of extrusion was obtained. As shown in Table 8, the average cooling rate in a temperature range from 575° C. to 510° C. was ° C./min or 20° C./min. The average cooling rate in a temperature range from 470° C. to 380° C. was 20° C./min or 15° C./min. Next, the extruded material was corrected.

(Step No. F1)

A round bar (copper alloy bar) having a diameter of 40 mm obtained in Step No. E2 was cut into a length of 200 mm. This round bar was horizontally set and was forged into a thickness of 16 mm using a press machine having a hot forging press capacity of 150 ton. About 3 seconds immediately after hot forging the material into a predetermined thickness, the temperature was measured using the radiation thermometer. It was verified that the hot forging temperature was within ±5° C. of a temperature shown in Table 9 (in a range of (temperature shown in Table 9)−5° C. to (temperature shown in Table 9)+5° C.). The average cooling rate in a temperature range from 575° C. to 510° C. was 20° C./min. The average cooling rate in a temperature range from 470° C. to 380° C. was 20° C./min.

(Step No. F2)

The continuously cast rod having a diameter of 40 mm was hot-forged under the same conditions as in Step No. F1.

TABLE 2

| Alloy | Component Composition (mass %) | | | | | | Impurities (mass %) | | | | Composition Relational Expression | | |
|---|---|---|---|---|---|---|---|---|---|---|---|---|---|
| No. | Cu | Si | Pb | Sn | P | Zn | Element | Amount | Element | Amount | f0 | f1 | f2 |
| S01 | 77.5 | 3.50 | 0.042 | 0.17 | 0.09 | Balance | Fe | 0.02 | Ni | 0.04 | 3.05 | 79.0 | 62.5 |
| | | | | | | | Al | 0.002 | Ag | 0.02 | | | |
| | | | | | | | Cr | 0.001 | Mg | 0.001 | | | |
| | | | | | | | Se | 0.001 | Co | 0.003 | | | |
| | | | | | | | Mo | 0.001 | B | 0.002 | | | |
| S02 | 78.4 | 3.70 | 0.033 | 0.22 | 0.10 | Balance | Fe | 0.04 | Ni | 0.01 | 3.30 | 79.6 | 62.6 |
| | | | | | | | Al | 0.001 | Ag | 0.006 | | | |
| | | | | | | | Zr | 0.003 | Mg | 0.001 | | | |
| | | | | | | | Bi | 0.007 | Rare Earth Element | 0.001 | | | |
| | | | | | | | Te | 0.001 | S | 0.0004 | | | |
| S03 | 78.7 | 3.64 | 0.050 | 0.10 | 0.08 | Balance | Fe | 0.03 | Ni | 0.03 | 1.45 | 80.9 | 63.2 |
| | | | | | | | Al | 0.001 | Ag | 0.01 | | | |
| | | | | | | | Cr | 0.006 | B | 0.004 | | | |
| | | | | | | | Se | 0.001 | Co | 0.001 | | | |

TABLE 3

| Alloy | Component Composition (mass %) | | | | | | | Composition Relational Expression | | |
|---|---|---|---|---|---|---|---|---|---|---|
| No. | Cu | Si | Pb | Sn | P | Others | Zn | f0 | f1 | f2 |
| S11 | 78.3 | 3.53 | 0.090 | 0.07 | 0.06 | | Balance | 1.09 | 80.6 | 63.3 |
| S12 | 78.6 | 3.52 | 0.022 | 0.19 | 0.09 | | Balance | 2.85 | 79.9 | 63.5 |
| S13 | 79.8 | 3.96 | 0.048 | 0.26 | 0.11 | | Balance | 3.12 | 80.9 | 62.8 |
| S14 | 78.9 | 3.83 | 0.033 | 0.24 | 0.11 | | Balance | 3.29 | 80.1 | 62.5 |
| S15 | 77.4 | 3.49 | 0.050 | 0.13 | 0.09 | | Balance | 2.38 | 79.2 | 62.5 |
| S16 | 78.8 | 3.55 | 0.045 | 0.20 | 0.08 | | Balance | 2.89 | 80.0 | 63.6 |
| S17 | 78.6 | 3.89 | 0.040 | 0.16 | 0.13 | | Balance | 2.26 | 80.5 | 61.9 |
| S18 | 78.7 | 3.52 | 0.022 | 0.19 | 0.09 | | Balance | 2.80 | 80.0 | 63.6 |
| S19 | 77.7 | 3.48 | 0.050 | 0.14 | 0.09 | | Balance | 2.43 | 79.4 | 62.8 |
| S20 | 77.5 | 3.42 | 0.040 | 0.19 | 0.08 | | Balance | 3.47 | 78.7 | 62.9 |
| S21 | 79.0 | 3.66 | 0.030 | 0.10 | 0.09 | | Balance | 1.39 | 81.2 | 63.4 |
| S22 | 77.6 | 3.63 | 0.042 | 0.17 | 0.11 | | Balance | 2.93 | 79.2 | 62.0 |
| S23 | 77.8 | 3.46 | 0.042 | 0.10 | 0.07 | | Balance | 1.72 | 79.8 | 63.1 |
| S24 | 77.9 | 3.45 | 0.042 | 0.12 | 0.12 | | Balance | 2.02 | 79.8 | 63.1 |
| S25 | 78.3 | 3.87 | 0.026 | 0.21 | 0.09 | | Balance | 3.12 | 79.7 | 61.8 |
| S26 | 79.0 | 3.60 | 0.044 | 0.25 | 0.09 | | Balance | 3.49 | 79.9 | 63.7 |
| S27 | 78.2 | 3.41 | 0.030 | 0.07 | 0.08 | | Balance | 1.14 | 80.4 | 63.7 |
| S28 | 77.0 | 3.41 | 0.030 | 0.13 | 0.10 | | Balance | 2.61 | 78.7 | 62.4 |
| S29 | 78.3 | 3.58 | 0.033 | 0.12 | 0.11 | | Balance | 1.86 | 80.3 | 63.0 |
| S30 | 80.1 | 3.94 | 0.048 | 0.15 | 0.11 | | Balance | 1.74 | 82.1 | 63.3 |

TABLE 3-continued

| Alloy | Component Composition (mass %) | | | | | | | Composition Relational Expression | | |
|---|---|---|---|---|---|---|---|---|---|---|
| No. | Cu | Si | Pb | Sn | P | Others | Zn | f0 | f1 | f2 |
| S51 | 78.3 | 3.65 | 0.037 | 0.21 | 0.09 | Sb: 0.04 | Balance | 3.22 | 79.5 | 62.7 |
| S52 | 77.4 | 3.54 | 0.028 | 0.14 | 0.08 | Sb: 0.03, As: 0.03, Bi: 0.03 | Balance | 2.55 | 79.1 | 62.3 |
| S53 | 79.3 | 3.91 | 0.033 | 0.23 | 0.08 | Sb: 0.05, As: 0.03 | Balance | 2.96 | 80.6 | 62.6 |
| S54 | 79.9 | 3.93 | 0.060 | 0.15 | 0.11 | Sb: 0.03 | Balance | 1.78 | 81.9 | 63.1 |
| S55 | 77.3 | 3.42 | 0.028 | 0.12 | 0.08 | Sb: 0.05, Bi: 0.03 | Balance | 2.28 | 79.1 | 62.7 |
| S56 | 78.5 | 3.57 | 0.025 | 0.19 | 0.09 | Sb: 0.04 | Balance | 2.87 | 79.8 | 63.2 |
| S57 | 77.8 | 3.45 | 0.050 | 0.08 | 0.07 | Sb: 0.03 | Balance | 1.38 | 80.0 | 63.1 |
| S58 | 78.3 | 3.54 | 0.050 | 0.12 | 0.09 | Sb: 0.03, As: 0.03 | Balance | 1.87 | 80.2 | 63.2 |

TABLE 4

| Alloy | Component Composition (mass %) | | | | | | | Composition Relational Expression | | |
|---|---|---|---|---|---|---|---|---|---|---|
| No. | Cu | Si | Pb | Sn | P | Others | Zn | f0 | f1 | f2 |
| S101 | 77.6 | 3.48 | 0.050 | 0.12 | 0.19 | | Balance | 2.11 | 79.6 | 62.5 |
| S102 | 78.5 | 3.66 | 0.044 | 0.19 | 0.03 | | Balance | 2.84 | 79.9 | 63.0 |
| S103 | 78.1 | 3.68 | 0.050 | 0.36 | 0.10 | | Balance | 5.66 | 78.1 | 62.3 |
| S104-1 | 78.0 | 3.45 | 0.070 | 0.35 | 0.10 | | Balance | 5.80 | 77.9 | 63.1 |
| S104-2 | 77.2 | 3.30 | 0.033 | 0.25 | 0.08 | | Balance | 4.94 | 77.8 | 63.1 |
| S105 | 77.1 | 3.41 | 0.032 | 0.07 | 0.08 | | Balance | 1.39 | 79.3 | 62.6 |
| S106 | 77.8 | 3.86 | 0.050 | 0.27 | 0.10 | | Balance | 4.33 | 78.7 | 61.3 |
| S107 | 76.7 | 3.57 | 0.030 | 0.22 | 0.13 | | Balance | 4.54 | 77.8 | 61.3 |
| S108 | 77.1 | 3.14 | 0.044 | 0.18 | 0.09 | As: 0.04, Bi: 0.04 | Balance | 3.74 | 78.2 | 63.6 |
| S109 | 76.0 | 3.25 | 0.050 | 0.13 | 0.10 | | Balance | 3.40 | 77.6 | 62.1 |
| S110 | 77.6 | 3.45 | 0.050 | 0.04 | 0.03 | | Balance | 0.72 | 80.1 | 63.0 |
| S111 | 79.9 | 3.43 | 0.062 | 0.20 | 0.08 | | Balance | 2.53 | 81.1 | 65.2 |
| S112 | 77.6 | 3.35 | 0.045 | 0.27 | 0.07 | | Balance | 4.90 | 78.1 | 63.3 |
| S113 | 79.9 | 3.94 | 0.012 | 0.11 | 0.08 | Sb: 0.04 | Balance | 1.31 | 82.2 | 63.1 |
| S114 | 78.0 | 3.09 | 0.028 | 0.10 | 0.09 | | Balance | 1.77 | 79.7 | 64.8 |
| S115 | 77.6 | 3.45 | 0.035 | 0.05 | 0.08 | | Balance | 0.90 | 80.0 | 62.9 |
| S116 | 78.0 | 3.55 | 0.035 | 0.10 | 0.04 | | Balance | 1.64 | 80.0 | 63.0 |
| S117 | 78.5 | 3.60 | 0.004 | 0.04 | 0.07 | | Balance | 0.60 | 81.1 | 63.2 |
| S118 | 78.6 | 3.45 | 0.062 | 0.12 | 0.08 | | Balance | 1.81 | 80.5 | 63.9 |
| S119 | 77.2 | 3.79 | 0.050 | 0.19 | 0.10 | | Balance | 3.41 | 78.7 | 61.0 |
| S120 | 80.6 | 4.22 | 0.048 | 0.18 | 0.09 | | Balance | 1.92 | 82.6 | 62.6 |
| S121 | 80.8 | 4.08 | 0.034 | 0.12 | 0.08 | | Balance | 1.27 | 83.1 | 63.4 |
| S122 | 76.8 | 3.06 | 0.038 | 0.19 | 0.06 | | Balance | 4.32 | 77.7 | 63.8 |
| S123 | 77.0 | 3.18 | 0.034 | 0.17 | 0.09 | | Balance | 3.61 | 78.2 | 63.4 |
| S124 | 77.2 | 3.23 | 0.044 | 0.11 | 0.09 | Sb: 0.04, As: 0.04 | Balance | 2.20 | 79.0 | 63.4 |
| S125 | 76.5 | 3.42 | 0.035 | 0.12 | 0.10 | | Balance | 2.67 | 78.3 | 61.9 |
| S126 | 77.5 | 3.50 | 0.038 | 0.40 | 0.10 | As: 0.03, Bi: 0.03 | Balance | 7.18 | 77.0 | 62.4 |
| S127 | 77.3 | 3.30 | 0.031 | 0.41 | 0.10 | | Balance | 7.94 | 76.6 | 63.0 |
| S128 | 78.6 | 3.40 | 0.028 | 0.23 | 0.09 | | Balance | 3.51 | 79.5 | 64.0 |
| S129 | 77.1 | 3.65 | 0.028 | 0.14 | 0.09 | | Balance | 2.64 | 78.9 | 61.5 |
| S130 | 75.5 | 3.11 | 0.035 | 0.11 | 0.09 | | Balance | 3.50 | 77.2 | 62.2 |
| S131 | 75.8 | 2.93 | 0.018 | 0.30 | 0.08 | | Balance | 9.15 | 75.7 | 63.2 |
| S132 | 73.8 | 2.94 | 0.015 | 0.13 | 0.07 | | Balance | 10.14 | 75.1 | 61.2 |
| S133 | 77.7 | 3.45 | 0.035 | 0 | 0 | | Balance | 0 | 80.5 | 63.2 |
| S134 | 73.1 | 3.38 | 0 | 0 | 0.08 | | Balance | 0 | 75.9 | 58.7 |
| S135 | 73.2 | 2.55 | 0 | 0.33 | 0.10 | | Balance | 110 | 72.5 | 62.1 |
| S136 | 77.5 | 3.41 | 0.028 | 0.15 | 0.06 | Fe: 0.11 | Balance | 2.75 | 79.0 | 63.0 |
| S137 | 76.3 | 3.20 | 0 | 0.14 | 0.07 | Fe: 0.18 | Balance | 3.47 | 77.7 | 62.7 |
| S138 | 75.0 | 3.03 | 0 | 0.09 | 0.07 | Fe: 0.12 | Balance | 3.51 | 76.7 | 62.1 |

TABLE 5

| Step No. | Hot Extrusion: Temperature (° C.) | Hot Extrusion: Cooling Rate from 575° C. to 510° C. (° C./min) | Hot Extrusion: Cooling Rate from 470° C. to 380° C. (° C./min) | Diameter of Extruded Material (mm) | Combined Operation of Drawing and Straightness Correction | Low-Temperature Annealing: Temperature (° C.) | Low-Temperature Annealing: Time (min) | Conditional Expression Value |
|---|---|---|---|---|---|---|---|---|
| A1 | 640 | 20 | 25 | 25.5 | ° | — | — | — |
| A2 | 680 | 20 | 25 | 25.5 | ° | — | — | — |
| A3 | 710 | 20 | 25 | 25.5 | ° | — | — | — |
| A4 | 640 | 12 | 11 | 25.5 | ° | — | — | — |
| A5 | 640 | 12 | 7.5 | 25.5 | ° | — | — | — |
| A6 | 640 | 10 | 3.5 | 25.5 | ° | — | — | — |
| AH1 | 760 | 20 | 25 | 25.5 | ° | — | — | — |
| AH2 | 680 | 600 | 600 | 25.5 | ° | — | — | — |
| AH3 | 680 | 8 | 1.9 | 25.5 | ° | — | — | — |
| AH4 | 680 | 8 | 1.2 | 25.5 | ° | — | — | — |
| AH5 | 590 | 12 | 20 | 25.5 | Unable to be extruded to the end | | | |
| B1 | 640 | 20 | 25 | 25.5 | ° | 275 | 180 | 738 |
| B2 | 640 | 20 | 25 | 25.5 | ° | 320 | 75 | 866 |
| B3 | 640 | 20 | 25 | 25.5 | ° | 290 | 75 | 606 |
| BH1 | 640 | 20 | 25 | 25.5 | ° | 220 | 120 | — |
| BH2 | 640 | 20 | 25 | 25.5 | ° | 370 | 20 | — |
| BH3 | 640 | 20 | 25 | 25.5 | ° | 320 | 180 | 1342 |
| C1 | 640 | 25 | 15 | 50 | — | — | — | — |
| C2 | 680 | 25 | 15 | 50 | — | — | — | — |
| CH1 | 760 | 25 | 15 | 50 | — | — | — | — |

TABLE 6

| Step No. | Hot Extrusion: Temperature (° C.) | Hot Extrusion: Cooling Rate from 575° C. to 510° C. (° C./min) | Hot Extrusion: Cooling Rate from 470° C. to 380° C. (° C./min) | Diameter of Extruded Material (mm) | Hot Forging: Temperature (° C.) | Hot Forging: Cooling Rate from 575° C. to 510° C. (° C./min) | Hot Forging: Cooling Rate from 470° C. to 380° C. (° C./min) | Low-Temperature Annealing: Temperature (° C.) | Low-Temperature Annealing: Time (min) | Conditional Expression Value |
|---|---|---|---|---|---|---|---|---|---|---|
| D1 | 640 | 25 | 15 | 50 | 690 | 20 | 20 | — | — | — |
| D2 | 640 | 25 | 15 | 50 | 690 | 3.5 | 20 | — | — | — |
| D3 | 640 | 25 | 15 | 50 | 690 | 1.5 | 20 | — | — | — |
| D4 | 640 | 25 | 15 | 50 | 690 | 10 | 8 | — | — | — |
| D5 | 640 | 25 | 15 | 50 | 690 | 6 | 3.6 | — | — | — |
| D6 | 680 | 25 | 15 | 50 | 690 | 20 | 20 | — | — | — |
| D7 | 640 | 25 | 15 | 50 | 690 | 20 | 20 | 290 | 75 | 606 |
| D8 | 760 | 25 | 15 | 50 | 690 | 20 | 20 | — | — | — |
| DH1 | 640 | 25 | 15 | 50 | 690 | 6 | 1.8 | — | — | — |
| DH2 | 680 | 25 | 15 | 50 | 690 | 600 | 600 | — | — | — |

TABLE 7

| Step No. | Hot Extrusion: Temperature (° C.) | Hot Extrusion: Cooling Rate from 575° C. to 510° C. (° C./min) | Hot Extrusion: Cooling Rate from 470° C. to 380° C. (° C./min) | Distance between Parallel sides of Extruded Material (mm) | Combined Operation of Drawing and Straightness Correction | Low-Temperature Annealing: Temperature (° C.) | Low-Temperature Annealing: Time (min) | Conditional Expression Value |
|---|---|---|---|---|---|---|---|---|
| G | 640 | 20 | 25 | 17.8 | ○ | — | — | — |

TABLE 8

| | Hot Extrusion | | | | | Low-Temperature Annealing | | |
|---|---|---|---|---|---|---|---|---|
| Step No. | Temperature (° C.) | Cooling Rate from 575° C. to 510° C. (° C./min) | Cooling Rate from 470° C. to 380° C. (° C./min) | Diameter of Extruded Material (mm) | Combined Operation of Drawing and Straightness Correction | Temperature (° C.) | Time (min) | Conditional Expression Value |
| E1 | 640 | 25 | 20 | 25 | ○ | — | — | — |
| E2 | 640 | 20 | 15 | 40 | — | — | — | — |

TABLE 9

| | Hot Extrusion | | | | Hot Forging | | | Low-Temperature Annealing | | |
|---|---|---|---|---|---|---|---|---|---|---|
| Step No. | Temperature (° C.) | Cooling Rate from 575° C. to 510° C. (° C./min ) | Cooling Rate from 470° C. to 380° C. (° C./min ) | Diameter of Extruded Material (mm) | Temperature (° C.) | Cooling Rate from 575° C. to 510° C. (° C./min) | Cooling Rate from 470° C. to 380° C. (° C./min) | Temperature (° C.) | Time (min) | Conditional Expression Value |
| F1 | 640 | 20 | 15 | 40 | 690 | 20 | 20 | — | — | — |
| F2 | — | — | — | — | 690 | 20 | 20 | — | — | — |

Regarding the above-described test materials, the metallographic structure observed, corrosion resistance (dezincification corrosion test/dipping test), and machinability were evaluated in the following procedure.

(Observation of Metallographic Structure)

The metallographic structure was observed using the following method and area ratios (%) of α phase, κ phase, β phase, γ phase, and μ phase were measured by image analysis. Note that α' phase, β' phase, and γ' phase were included in α phase, β phase, and γ phase respectively.

Each of the test materials, rod material or forged product, was cut in a direction parallel to the longitudinal direction or parallel to the flowing direction of the metallographic structure. Next, the surface was polished (mirror-polished) and was etched with a mixed solution of hydrogen peroxide and ammonia water. For etching, an aqueous solution obtained by mixing 3 mL of 3 vol % hydrogen peroxide water and 22 mL of 14 vol % ammonia water was used. At room temperature of about 15° C. to about 25° C., the metal's polished surface was dipped in the aqueous solution for about 2 seconds to about 5 seconds.

Using a metallographic microscope, the metallographic structure was observed mainly at a magnification of 500-fold and, depending on the conditions of the metallographic structure, at a magnification of 1000-fold. The metallographic structure exhibited in micrographs of five or ten visual fields were binarized using image processing software "WinROOF 2013" to obtain the area ratios of the respective phases. Specifically, the average value of the area ratios of the five or ten visual fields for each phase was calculated and regarded as the proportion of the phase. Thus, the total of the area ratios of all the constituent phases was 100%.

The lengths of the long sides of γ phase and μ phase were measured using the following method. Using a 500-fold or 1000-fold metallographic micrograph, the maximum length of the long side of γ phase was measured in one visual field. This operation was performed in arbitrarily selected five visual fields, and the average maximum length of the long side of γ phase calculated from the lengths measured in the five visual fields was regarded as the length of the long side of γ phase. Likewise, by using a 500-fold or 1000-fold metallographic micrograph or using a 2000-fold or 5000-fold secondary electron micrograph (electron micrograph) according to the size of μ phase, the maximum length of the long side of μ phase in one visual field was measured. This operation was performed in arbitrarily selected five visual fields, and the average maximum length of the long sides of γ phase calculated from the lengths measured in the five visual fields was regarded as the length of the long side of μ phase.

Specifically, the evaluation was performed using an image that was printed out in a size of about 70 mm×about 90 mm. In the case of a magnification of 500-fold, the size of an observation field was 276 μm×220 μm.

When it was difficult to identify a phase, the phase was identified using an electron backscattering diffraction pattern (FE-SEM-EBSP) method at a magnification of 500-fold or 2000-fold.

In addition, in Examples in which the average cooling rates were made to vary, in order to determine whether or not γ phase, which mainly precipitates at a grain boundary, was present, a secondary electron image was obtained using JSM-7000F (manufactured by JEOL Ltd.), and the metallographic structure was observed at a magnification of 2000-fold or 5000-fold. In cases where μ phase was able to be observed using the 2000-fold or 5000-fold secondary electron image but was not able to be observed using the 500-fold or 1000-fold metallographic micrograph, the γ phase was not included in the calculation of the area ratio. That is, μ phase that was able to be observed using the 2000-fold or 5000-fold secondary electron image but was not able to be observed using the 500-fold or 1000-fold metallographic micrograph was not included in the area ratio of μ phase. The reason for this is that, in most cases, the length of the long side of μ phase that is not able to be observed using the metallographic microscope is about 5 μm or less, and the width of such μ phase is about 0.5 μm or less. Therefore, such μ phase scarcely affects the area ratio.

Note that when μ phase was not able to be observed at a magnification of 500-fold or 1000-fold but the length of the long side of μ phase was measured at a higher magnification, in the measurement result columns of the tables, the area ratio of μ phase is indicated as 0%, but the length of the long side of μ phase is filled in.

(Observation of μ Phase)

Using a field emission electron microscope "JSM-7000F" (manufactured by JEOL Ltd.), μ phase was observed. The observation was performed under conditions of acceleration voltage: 15 kV, current value (set value): 15, and magnification: 2000-fold or 5000-fold.

When cooling was performed in a temperature range of 470° C. to 380° C. at an average cooling rate of 8° C./min or lower after hot extrusion, the presence of μ phase was able to be verified. FIG. 1 shows an example of a secondary electron image of Test No. T05 (Alloy No. S01/Step No. A5) at a magnification of 5000-fold. It was verified that μ phase was precipitated at a grain boundary of α phase (elongated grey white phase). The length of the long side of μ phase was determined by visual inspection in any five visual fields and was measured using the above-described method.

(Amounts of Sn and P in κ Phase)

The amount of Sn and the amount of P contained in κ phase were measured using an X-ray microanalyzer. The measurement was performed using "JXA-8200" (manufactured by JEOL Ltd.) under the conditions of acceleration voltage: 20 kV and current value: $3.0\times10^{-8}$ A.

Regarding Test No. T01 (Alloy No. S01/Step No. A1), Test No. T17 (Alloy No. S01/Step No. BH3), Test No. T437 (Alloy No. S123/Step No. E1), the quantitative analysis of the concentrations of Sn, Cu, Si, and P in the respective phases was performed using the X-ray microanalyzer, and the results thereof are shown in Tables 10 to 12.

Regarding μ phase, a portion in which the length of the short side in the visual field was long was measured.

TABLE 10

Test No. T01 (Alloy No. S01: 77.5Cu—3.50Si—0.17Sn—0.09P/Step No. A1) (mass %)

| | Cu | Si | Sn | P | Zn |
|---|---|---|---|---|---|
| α Phase | 77.5 | 2.7 | 0.12 | 0.07 | Balance |
| α' Phase | 77.0 | 2.5 | 0.11 | 0.05 | Balance |
| κ Phase | 78.0 | 4.4 | 0.18 | 0.12 | Balance |
| γ Phase | 73.0 | 5.6 | 1.8 | 0.16 | Balance |
| μ Phase | — | — | — | — | — |

TABLE 11

Test No. T17 (Alloy No. S01: 77.5Cu—3.50Si—0.17Sn—0.09P/Step No. BH3) (mass %)

| | Cu | Si | Sn | P | Zn |
|---|---|---|---|---|---|
| α Phase | 77.5 | 2.6 | 0.12 | 0.06 | Balance |
| α' Phase | 77.5 | 2.5 | 0.10 | 0.05 | Balance |
| κ Phase | 78.0 | 4.2 | 0.19 | 0.12 | Balance |
| γ Phase | 73.5 | 5.6 | 1.7 | 0.16 | Balance |
| μ Phase | 81.5 | 7.5 | 0.25 | 0.20 | Balance |

TABLE 12

Test No. T437 (Alloy No. S123: 77.0Cu—3.18Si—0.17Sn—0.09P/Step No. E1) (mass %)

| | Cu | Si | Sn | P | Zn |
|---|---|---|---|---|---|
| α Phase | 77.0 | 2.6 | 0.10 | 0.06 | Balance |
| α' Phase | 76.0 | 2.4 | 0.09 | 0.04 | Balance |
| κ Phase | 77.5 | 4.1 | 0.15 | 0.10 | Balance |
| γ Phase | 72.5 | 5.8 | 1.5 | 0.15 | Balance |

Based on the above-described measurement results, the following findings were obtained.

1) The concentrations distributed in the respective phases vary depending on the alloy compositions.

2) The amount of Sn distributed in κ phase is about 1.5 times that in α phase.

3) The Sn concentration in γ phase is about 15 times the Sn concentration in α phase.

4) The Si concentrations in κ phase, γ phase, and μ phase are about 1.6 times, about 2.1 times, and about 2.8 times the Si concentration in α phase, respectively.

5) The Cu concentration in μ phase is higher than that in α phase, κ phase, or γ phase.

6) As the proportion of γ phase increases, the Sn concentration in α phase or κ phase necessarily decreases. Specifically, assuming that the Sn content was the same, when the proportion of γ phase was about 1%, the Sn concentration in α phase or κ phase was about 20% (1.2 times) as compared to a case where the proportion of γ phase was about 3.7%. Further, it is presumed that, as the proportion of γ phase increases, the Sn concentration in α phase and κ phase decreases.

7) The amount of P distributed in κ phase is about 2 times that in α phase.

8) The P concentrations in γ phase is about 3 times the P concentration in α phase.

(Mechanical Properties)

(Tensile Strength)

Each of the test materials was processed into a No. specimen according to JIS Z 2241, and the tensile strength thereof was measured. If the tensile strength of a hot extruded material or hot forged material is 560 N/mm$^2$ or higher and preferably 570 N/mm$^2$ or higher, more preferably 585 N/mm$^2$ or higher, the material can be regarded as a free-cutting copper alloy of the highest quality, and with such a material, a reduction in the thickness and weight of members used in various fields can be realized.

The finished surface roughness of the tensile test specimen affects elongation and tensile strength. Therefore, the tensile test specimen was prepared so that surface roughness for a standard length of 4 mm at any arbitrarily selected position between gauge marks on the tensile test specimen satisfy the following conditions. For the tensile test, universal tester "AG-X" manufactured by Shimadzu Corporation was used.

(Conditions of Surface Roughness of Tensile Test Specimen)

The difference between the maximum value and the minimum value on the Z-axis is 2 μm or less in a cross-sectional curve corresponding to a standard length of 4 mm at any position between gauge marks on the tensile test specimen. The cross-sectional curve refers to a curve obtained by applying a low-pass filter of a cut-off value λs to a measured cross-sectional curve.

(High Temperature Creep)

A flanged specimen having a diameter of 10 mm according to JIS Z 2271 was prepared from each of the specimens. In a state where a load corresponding to 0.2% proof stress at room temperature was applied to the specimen, a creep strain after being kept for 100 hours at 150° C. was measured. If the creep strain is 0.4% or lower after the test piece is held at 150° C. for 100 hours in a state where a load corresponding to 0.2% plastic deformation is applied, the specimen is regarded to have good high-temperature creep. In the case where this creep strain is 0.3% or lower, the alloy is regarded to be of the highest quality among copper alloys, and such material can be used as a highly reliable material in, for example, valves used under high temperature or in automobile components used in a place close to the engine room.

(Impact Resistance)

In an impact test, a U-notched specimen (notch depth: 2 mm, notch bottom radius: 1 mm) according to JIS Z 2242 was taken from each of the extruded rod materials, the forged materials, and alternate materials thereof, the cast materials, and the continuously cast rod materials. Using an impact blade having a radius of 2 mm, a Charpy impact test was performed to measure the impact value.

The relation between the impact value obtained from the V-notched specimen and the impact value obtained from the U-notched specimen is described below as a reference since V-notched specimen is also used. It is substantially as follows.

$$(\text{V-Notch Impact Value})=0.8\times(\text{U-Notch Impact Value})-3$$

(Machinability)

The machinability was evaluated as follows in a machining test using a lathe.

Hot extruded rod materials having a diameter of 50 mm, 40 mm, or 25 mm and a cold drawn material having a diameter of 25 mm were machined to prepare test materials having a diameter of 18 mm. A forged material was machined to prepare a test material having a diameter of 14.5 mm. A point nose straight tool, in particular, a tungsten carbide tool not equipped with a chip breaker was attached to the lathe. Using this lathe, the circumference of the test material having a diameter of 18 mm or 14.5 mm was machined under dry conditions at rake angle: −6 degrees, nose radius: 0.4 mm, machining speed: 150 m/min, machining depth: 1.0 mm, and feed rate: 0.11 mm/rev.

A signal emitted from a dynamometer (AST tool dynamometer AST-TL1003, manufactured by Mihodenki Co., Ltd.) that is composed of three portions attached to the tool was electrically converted into a voltage signal, and this voltage signal was recorded on a recorder. Next, this signal was converted into cutting resistance (N). Accordingly, the machinability of the alloy was evaluated by measuring the cutting resistance, in particular, the principal component of cutting resistance showing the highest value during machining.

Concurrently, chips were collected, and the machinability was evaluated based on the chip shape. The most serious problem during actual machining is that chips become entangled with the tool or become bulky. Therefore, when all the chips that were generated had a chip shape with one winding or less, it was evaluated as "○" (good). When the chips had a chip shape with more than one winding and three windings or less, it was evaluated as "Δ" (fair). When a chip having a shape with more than three windings was included, it was evaluated as "X" (poor). This way, the evaluation was performed in three grades.

The cutting resistance depends on the strength of the material, for example, shear stress, tensile strength, or 0.2% proof stress, and as the strength of the material increases, the cutting resistance tends to increase. Cutting resistance that is higher than the cutting resistance of a free-cutting brass rod including 1% to 4% of Pb by about 10% to about 20%, the cutting resistance is sufficiently acceptable for practical use. In the embodiment, the cutting resistance was evaluated based on whether it has 130 N (boundary value). Specifically, when the cutting resistance is lower than 130 N, the machinability was evaluated as excellent (evaluation: ○). When the cutting resistance is 130 N or higher and lower than 145 N, the machinability was evaluated as "acceptable (Δ)". When the cutting resistance was 145 N or higher, the machinability was evaluated as "unacceptable (X)". Incidentally, when Step No. F1 was performed on a 58 mass % Cu-42 mass % Zn alloy to prepare a sample and this sample was evaluated, the cutting resistance was 185 N.

(Hot Working Test)

The rod material having a diameter of 50 mm or 25.5 mm was cut to prepare a test material having a diameter of 15 mm and a length of 25 mm. First, the test material was held at 720° C. or 635° C. for 10 minutes. The material's temperature was held in a range of ±3° C. of any one of two conditions 720° C. and 635° C. (in the case of 720° C., in a range of 717° C. to 723° C.; and in the case of 635° C., in a range of 632° C. to 638° C.) for 10 minutes. Next, the test material was horizontally set and was compressed into a thickness of 5 mm at a high temperature using an Amsler testing machine having a hot compression capacity of 10 ton and provided with an electric furnace at a strain rate of 0.04/sec and a working ratio of 80%.

As the test material, an A step material, a C step material, or an E step material was used. In addition, a continuously cast rod used as a material for hot forging in Step No. F2 will be called "F2 step product" and was used as a test material. For example, in Test No. T34 (Step No. F2), the hot workability of the continuously cast rod used as the material for hot forging instead of the final product was evaluated.

When cracks having an opening of 0.2 mm or more were observed using a magnifying glass at a magnification of 10-fold, the hot workability was evaluated based on the occurrence of cracking. A case where cracking did not occur under two conditions of 720° C. and 635° C. was evaluated as "○" (good). A case where cracking occurred at 720° C. and did not occur at 635° C. was evaluated as "Δ" (fair). A case where cracking did not occur at 720° C. and occurred at 635° C. was evaluated as "▲" (fair). A case where cracking occurred under two conditions of 720° C. and 635° C. was evaluated as "X" (poor).

When cracking did not occur under two conditions of 720° C. and 635° C., even when the material's temperature decreases to some extent during actual hot extrusion or hot forging, or when the material comes into instant contact with a mold or a die such that the material's temperature decreases, there is no problem as long as the temperature is in an appropriate range. When cracking occurred at either temperature of 720° C. or 635° C., although there is a limit in practice, it is determined that hot working can be performed in a temperature range controlled to be narrower. When cracking occurred at both temperatures of 720° C. and 635° C., it is determined that there is a problem in practice.

(Dezincification Corrosion Tests 1 and 2)

When the test material was an extruded material, the test material was embedded in a phenol resin material such that an exposed sample surface of the test material was perpendicular to the extrusion direction. When the test material was a cast material (cast rod), the test material was embedded in a phenol resin material such that an exposed sample surface of the test material was perpendicular to the longitudinal direction of the cast material. When the test material was a forged material, the test material was embedded in a phenol resin material such that an exposed sample surface of the test material was perpendicular to the flowing direction of forging.

The sample surface was polished with emery paper up to grit 1200, was ultrasonically cleaned in pure water, and then was dried with a blower. Next, each of the samples was dipped in a prepared dipping solution.

After the end of the test, the samples were embedded in a phenol resin material again such that the exposed surface is maintained to be perpendicular to the extrusion direction, the longitudinal direction, or the flowing direction of forging. Next, the sample was cut such that the cross-section of a corroded portion was the longest cut portion. Next, the sample was polished.

Using a metallographic microscope, corrosion depth was observed in 10 visual fields (arbitrarily selected 10 visual fields) of the microscope at a magnification of 500-fold. The deepest corrosion point was recorded as the maximum dezincification corrosion depth.

In the dezincification corrosion test 1, the following test solution 1 was prepared as the dipping solution, and the above-described operation was performed. In the dezincification corrosion test 2, the following test solution 2 was prepared as the dipping solution, and the above-described operation was performed.

The test solution 1 is a solution for performing an accelerated test in a harsh corrosion environment simulating an environment in which an excess amount of a disinfectant which acts as an oxidant is added such that pH is significantly low. When this solution is used, it is presumed that this test is an about 75 to 100 times accelerated test performed in such a harsh corrosion environment. If the maximum corrosion depth is 100 μm or less, corrosion resistance is excellent. In a case where extraordinarily excellent corrosion resistance is required, it is presumed that the maximum corrosion depth is preferably 70 μm or less and more preferably 50 μm or less.

The test solution 2 is a solution for performing an accelerated test simulating a harsh corrosion environment that makes corrosion advance fast in which the chloride ion concentration is high, pH is low, and hardness is low. When this solution is used, it is presumed that corrosion is accelerated about 30 to 50 times in such a harsh corrosion environment. If the maximum corrosion depth is μm or less, corrosion resistance is excellent. When extraordinarily excellent corrosion resistance is required, it is presumed that the maximum corrosion depth is preferably 35 μm or less and more preferably 25 μm or less. The Examples of the instant invention were evaluated based on these presumed values.

In the dezincification corrosion test 1, hypochlorous acid water (concentration: 30 ppm, pH=6.8, water temperature: 40° C.) was used as the test solution 1. Using the following method, the test solution 1 was adjusted. Commercially available sodium hypochlorite (NaClO) was added to 40 L of distilled water and was adjusted such that the residual chlorine concentration measured by iodometric titration was 30 mg/L. Residual chlorine decomposes and decreases in amount over time. Therefore, while continuously measuring the residual chlorine concentration using a voltammetric method, the amount of sodium hypochlorite added was electronically controlled using an electromagnetic pump. In order to reduce pH to 6.8, carbon dioxide was added while adjusting the flow rate thereof. The water temperature was adjusted to 40° C. using a temperature controller. While maintaining the residual chlorine concentration, pH, and the water temperature to be constant, the sample was held in the test solution 1 for 2 months. Next, the sample was taken out from the aqueous solution, and the maximum value (maximum dezincification corrosion depth) of the dezincification corrosion depth was measured.

In the dezincification corrosion test 2, a test water including components shown in Table 13 was used as the test solution 2. The test solution 2 was adjusted by adding a commercially available chemical agent to distilled water. Simulating highly corrosive tap water, 80 mg/L of chloride ions, 40 mg/L of sulfate ions, and 30 mg/L of nitrate ion were added. The alkalinity and hardness were adjusted to 30 mg/L and 60 mg/L, respectively, based on Japanese general tap water. In order to reduce pH to 6.3, carbon dioxide was added while adjusting the flow rate thereof. In order to saturate the dissolved oxygen concentration, oxygen gas was continuously added. The water temperature was adjusted to 25° C. which is the same as room temperature. While maintaining pH and the water temperature to be constant and maintaining the dissolved oxygen concentration in the saturated state, the sample was held in the test solution 2 for 3 months. Next, the sample was taken out from the aqueous solution, and the maximum value (maximum dezincification corrosion depth) of the dezincification corrosion depth was measured.

TABLE 13

(Units of Items other than pH: mg/L)

| Mg | Ca | Na | K | $NO^{3-}$ | $SO_4^{2-}$ | Cl | Alkalinity | Hardness | pH |
|---|---|---|---|---|---|---|---|---|---|
| 10.1 | 7.3 | 55 | 19 | 30 | 40 | 80 | 30 | 60 | 6.3 |

(Dezincification Corrosion Test 3: Dezincification Corrosion Test According to ISO 6509)

This test is adopted in many countries as a dezincification corrosion test method and is defined by JIS H 3250 of JIS Standards.

As in the case of the dezincification corrosion tests 1 and 2, the test material was embedded in a phenol resin material. The sample surface was polished with emery paper up to grit 1200, was ultrasonically cleaned in pure water, and then was dried.

Each of the samples was dipped in an aqueous solution (12.7 g/L) of 1.0% cupric chloride dihydrate ($CuCl_2.2H_2O$) and was held under a temperature condition of 75° C. for 24 hours. Next, the sample was taken out from the aqueous solution.

The samples were embedded in a phenol resin material again such that the exposed surfaces are maintained to be perpendicular to the extrusion direction, the longitudinal direction, or the flowing direction of forging. Next, the samples were cut such that a cross-section of a corroded portion was obtained as the longest cut portion. Next, the sample was polished.

Using a metallographic microscope, corrosion depth was observed in 10 visual fields of the microscope at a magnification of 100-fold to 500-fold. The deepest corrosion point was recorded as the maximum dezincification corrosion depth.

When the maximum corrosion depth in the test according to ISO 6509 is 200 μm or less, there was no problem for practical use regarding corrosion resistance. When particularly excellent corrosion resistance is required, it is presumed that the maximum corrosion depth is preferably 100 μm or less and more preferably 50 μm or less.

In this test, when the maximum corrosion depth was more than 200 μm, it was evaluated as "X" (poor). When the maximum corrosion depth was more than 50 μm and 200 μm or less, it was evaluated as "Δ" (fair). When the maximum corrosion depth was 50 μm or less, it was strictly evaluated as "○" (good). In the embodiment, a strict evaluation criterion was adopted because the alloy was assumed to be used in a harsh corrosion environment.

(Stress Corrosion Cracking Test)

In order to determine whether or not the material was able to endure a harsh stress corrosion cracking environment, a stress corrosion cracking test was performed in the following procedure.

As a test solution, a solution having pH 10.3 adjusted assuming the harshest environment was used using a method defined in ASTM-B858. A sample was exposed to this solution for 24 hours and 96 hours under conditions controlled to 25° C. In ASTM-B858, the exposure time is defined as 24 hours. However, the alloy according to the embodiment was also exposed for 96 hours in order to obtain higher reliability.

After the test, the specimen was cleaned with dilute sulfuric acid, and an end surface thereof was observed with a magnifying glass at 25-fold to determine whether or not cracking occurred in the end surface. A specimen in which cracking did not occur after 96 hours was evaluated to have excellent stress corrosion cracking resistance and evaluated as "○" (good). A specimen in which cracking occurred after 96 hours but did not occur after 24 hours was evaluated to have good stress corrosion cracking resistance and evaluated as "Δ" (fair). In the evaluation of Δ, there is a problem in cases where higher reliability is required. A specimen in which cracking occurred after hours was evaluated to have poor stress corrosion cracking resistance in a harsh environment and evaluated as "X" (poor).

By cutting a hexagonal test bar (Tests No. T31, T70, and T110) having an opposite side distance of 17 mm manufactured in Step G as a specimen, a hexagonal nut and a hexagonal bolt were prepared as tapered plumbing fittings of R1/4. The hexagonal nut was fastened into the hexagonal bolt at a fastening torque of 50 Nm. Using a specimen in which the hexagonal nut was fastened into the hexagonal bolt, the above-described stress corrosion cracking test was performed.

The alloy according to the embodiment is positioned as copper alloy having high reliability regarding stress corrosion cracking resistance. Therefore, regarding the fastening torque, a torque corresponding to three times the torque: 16±2 Nm (14 to 18 Nm) defined in JIS B 8607 (Flare type and brazing type fittings for refrigerants) was applied in the test. That is, the corrosion environment, the load stress, and the time as factors for stress corrosion cracking were actually evaluated under extremely harsh conditions.

The evaluation results are shown in Tables 14 to 37. Tests No. T01 to T34, T40 to T73, and T80 to T113 are the results of the experiment performed on the actual production line. Tests No. T201 to T233 and T301 to T315 are the results corresponding to Examples in the laboratory experiment. Tests No. T401 to T446 and T501 to T514 are the results corresponding to Comparative Examples in the laboratory experiment.

"*1", "*2", and "*3" described in Step No. of the tables represent the following matters.

*1) Flaky defects (flaky cracks) were formed on the surface of the extruded material, and the next step (test) was not performed

*2) Flaky defects were formed on the surface of the extruded material. However, the defects were removed, and the next test was performed

*3) Side surface cracking occurred during hot forging. However, the evaluation was partially performed except for the cracked portions.

TABLE 14

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Amount of Sn in κ Phase (mass %) | Amount of P in κ Phase (mass %) |
|---|---|---|---|---|---|---|---|---|---|---|---|---|---|---|
| T01 | S01 | A1 | 44.7 | 1.0 | 0 | 0 | 99.0 | 100 | 1.0 | 50.7 | 24 | 0 | 0.18 | 0.12 |
| T02 | S01 | A2 | 43.2 | 1.3 | 0 | 0 | 98.7 | 100 | 1.3 | 50.0 | 28 | 0 | 0.18 | 0.11 |
| T03 | S01 | A3 | 42.8 | 1.5 | 0 | 0 | 98.5 | 100 | 1.5 | 50.1 | 32 | 0 | 0.17 | 0.11 |
| T04 | S01 | A4 | 45.3 | 1.1 | 0 | 0 | 98.9 | 100 | 1.1 | 51.6 | 26 | 0.5 | 0.18 | 0.11 |
| T05 | S01 | A5 | 45.0 | 1.2 | 0 | 0 | 98.8 | 100 | 1.2 | 51.6 | 30 | 2 | 0.18 | 0.11 |
| T06 | S01 | A6 | 44.5 | 1.2 | 0 | 0.7 | 98.1 | 100 | 1.9 | 51.4 | 30 | 12 | 0.18 | 0.11 |
| T07 | S01 | AH1 | 44.7 | 2.0 | 0.5 | 0 | 97.5 | 99.5 | 2.0 | 53.2 | 48 | 0 | 0.16 | 0.11 |
| T08 | S01 | AH2 | 43.8 | 1.7 | 0.8 | 0 | 97.5 | 99.2 | 1.7 | 51.6 | 36 | 0 | 0.17 | 0.11 |
| T09 | S01 | AH3 | 43.3 | 1.2 | 0 | 1.8 | 97.0 | 100 | 3.0 | 50.8 | 30 | 30 | 0.18 | 0.12 |
| T10 | S01 | AH4 | 42.3 | 1.0 | 0 | 5.0 | 94.0 | 100 | 6.0 | 50.8 | 30 | 40 or more | 0.18 | 0.12 |
| T11 | S01 | AH5 | Extrusion unable to be performed to the end | | | | | | | | | | | |
| T12 | S01 | B1 | 45.5 | 1.0 | 0 | 0 | 99.0 | 100 | 1.0 | 51.5 | 22 | 1 | 0.18 | 0.11 |
| T13 | S01 | B2 | 45.7 | 0.9 | 0 | 0 | 99.1 | 100 | 0.9 | 51.4 | 20 | 1.5 | 0.18 | 0.11 |
| T14 | S01 | B3 | 45.4 | 1.1 | 0 | 0 | 98.9 | 100 | 1.1 | 51.7 | 24 | 1 | 0.18 | 0.11 |
| T15 | S01 | BH1 | 45.5 | 1.0 | 0 | 0 | 99.0 | 100 | 1.0 | 51.5 | 24 | 0.5 | 0.18 | 0.11 |
| T16 | S01 | BH2 | 44.3 | 0.9 | 0 | 2.5 | 96.6 | 100 | 3.4 | 51.2 | 22 | 26 | 0.19 | 0.12 |
| T17 | S01 | BH3 | 44.6 | 1.0 | 0 | 3.0 | 96.0 | 100 | 4.0 | 52.1 | 24 | 40 or more | 0.19 | 0.12 |

TABLE 15

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Stress Corrosion Cracking | Impact Value (J/cm$^2$) | Tensile Strength (N/mm$^2$) | 150° C. Creep Strain (%) |
|---|---|---|---|---|---|---|---|---|---|---|---|---|
| T01 | S01 | A1 | 111 | ○ | ○ | 46 | 26 | ○ | | 16.2 | 638 | 0.18 |
| T02 | S01 | A2 | 112 | ○ | ○ | 62 | 36 | | | 15.4 | 632 | 0.23 |
| T03 | S01 | A3 | 113 | ○ | ○ | 70 | 42 | | | 14.9 | 629 | 0.32 |
| T04 | S01 | A4 | 114 | ○ | ○ | 50 | 32 | | | 15.9 | 636 | 0.23 |
| T05 | S01 | A5 | 112 | ○ | ○ | 64 | 38 | ○ | | 15.5 | 634 | 0.25 |
| T06 | S01 | A6 | 113 | ○ | ○ | 84 | 48 | ○ | | 13.5 | 622 | 0.36 |
| T07 | S01 | AH1 | 117 | ○ | ○ | 106 | 72 | Δ | | 12.0 | 620 | 0.50 |
| T08 | S01 | AH2 | 118 | ○ | ○ | 98 | 66 | Δ | | 12.5 | 625 | 0.57 |
| T09 | S01 | AH3 | 113 | ○ | ○ | 112 | 66 | ○ | | 11.6 | 603 | 0.50 |
| T10 | S01 | AH4 | 113 | ○ | ○ | 144 | 98 | Δ | | 8.1 | 551 | 0.70 |
| T11 | S01 | AH5 | Extrusion unable to be performed to the end | | | | | | | | | |
| T12 | S01 | B1 | 113 | ○ | | 48 | 26 | ○ | | 16.2 | 638 | 0.19 |
| T13 | S01 | B2 | 111 | ○ | | 46 | 24 | | | 16.4 | 639 | 0.18 |
| T14 | S01 | B3 | 115 | ○ | | 50 | 28 | | | 15.9 | 636 | 0.21 |
| T15 | S01 | BH1 | 113 | ○ | | 48 | 28 | | | 16.2 | 638 | 0.19 |
| T16 | S01 | BH2 | 114 | ○ | | 102 | 58 | ○ | | 11.9 | 596 | 0.50 |
| T17 | S01 | BH3 | 112 | ○ | | 120 | 70 | ○ | | 10.1 | 586 | 0.58 |

TABLE 16

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Amount of Sn in κ Phase (mass %) | Amount of P in κ Phase (mass %) |
|---|---|---|---|---|---|---|---|---|---|---|---|---|---|---|
| T18 | S01 | C1 | 45.0 | 1.1 | 0 | 0 | 98.9 | 100 | 1.1 | 51.3 | 24 | 0 | 0.18 | 0.11 |
| T19 | S01 | C2 | 46.2 | 1.6 | 0 | 0 | 98.4 | 100 | 1.6 | 53.8 | 30 | 0 | 0.17 | 0.11 |
| T20 | S01 | CH1 | 45.3 | 2.2 | 0 | 0 | 97.8 | 100 | 2.2 | 54.2 | 54 | 0 | 0.16 | 0.11 |
| T21 | S01 | D1 | 45.0 | 1.1 | 0 | 0 | 98.9 | 100 | 1.1 | 51.3 | 24 | 0 | 0.19 | 0.11 |
| T22 | S01 | D2 | 45.8 | 0.9 | 0 | 0 | 99.1 | 100 | 0.9 | 51.5 | 26 | 0 | 0.19 | 0.11 |
| T23 | S01 | D3 | 48.0 | 0.5 | 0 | 0 | 99.5 | 100 | 0.5 | 52.2 | 20 | 0 | 0.19 | 0.11 |
| T24 | S01 | D4 | 45.3 | 1.2 | 0 | 0 | 98.8 | 100 | 1.2 | 51.9 | 26 | 1 | 0.19 | 0.11 |
| T25 | S01 | D5 | 45.5 | 1.1 | 0 | 0 | 98.9 | 100 | 1.1 | 51.8 | 26 | 6 | 0.19 | 0.11 |
| T26 | S01 | D6 | 44.2 | 1.5 | 0 | 0 | 98.5 | 100 | 1.5 | 51.5 | 30 | 0 | 0.18 | 0.11 |
| T27 | S01 | D7 | 45.0 | 1.0 | 0 | 0 | 99.0 | 100 | 1.0 | 51.0 | 22 | 1 | 0.19 | 0.11 |
| T28 | S01 | D8 | 45.5 | 1.6 | 0 | 0 | 98.4 | 100 | 1.6 | 53.1 | 38 | 0 | 0.17 | 0.11 |
| T29 | S01 | DH1 | 45.5 | 0.9 | 0 | 1.0 | 98.1 | 100 | 1.9 | 51.7 | 28 | 25 | 0.19 | 0.11 |
| T30 | S01 | DH2 | 45.0 | 1.3 | 0.4 | 0 | 98.3 | 99.6 | 1.3 | 51.8 | 42 | 0 | 0.18 | 0.11 |
| T31 | S01 | G | 46.0 | 1.2 | 0 | 0 | 98.8 | 100 | 1.2 | 52.6 | 24 | 0 | 0.18 | 0.11 |
| T32 | S01 | E1 | 45.1 | 1.2 | 0 | 0 | 98.8 | 100 | 1.2 | 51.7 | 28 | 0 | 0.18 | 0.11 |
| T33 | S01 | F1 | 44.8 | 1.0 | 0 | 0 | 99.0 | 100 | 1.0 | 50.8 | 30 | 0 | 0.17 | 0.11 |
| T34 | S01 | F2 | 44.8 | 1.5 | 0 | 0 | 98.5 | 100 | 1.5 | 52.1 | 34 | 0 | 0.17 | 0.11 |

TABLE 17

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Stress Corrosion Cracking | Impact Value (J/cm$^2$) | Tensile Strength (N/mm$^2$) | 150° C. Creep Strain (%) |
|---|---|---|---|---|---|---|---|---|---|---|---|---|
| T18 | S01 | C1 | 110 | ○ | ○ | 52 | 24 | | | 19.7 | 574 | 0.20 |
| T19 | S01 | C2 | 111 | ○ | ○ | 68 | 38 | ○ | | 18.0 | 568 | 0.27 |
| T20 | S01 | CH1 | 110 | ○ | ○ | 110 | 62 | ○ | | 16.1 | 554 | 0.45 |
| T21 | S01 | D1 | 114 | ○ | | 46 | 28 | ○ | | 19.7 | 579 | 0.19 |
| T22 | S01 | D2 | 113 | ○ | | 42 | 24 | | | 20.4 | 582 | 0.17 |
| T23 | S01 | D3 | 114 | ○ | | 34 | 20 | | | 21.5 | 589 | 0.13 |
| T24 | S01 | D4 | 113 | ○ | | 46 | 28 | | | 19.3 | 577 | 0.21 |
| T25 | S01 | D5 | 114 | ○ | | 62 | 30 | ○ | | 19.1 | 579 | 0.27 |
| T26 | S01 | D6 | 112 | ○ | | 64 | 36 | ○ | | 18.4 | 572 | 0.25 |
| T27 | S01 | D7 | 114 | ○ | | 52 | 26 | | | 20.0 | 581 | 0.21 |
| T28 | S01 | D8 | 112 | ○ | | 92 | 48 | ○ | | 17.7 | 570 | 0.28 |
| T29 | S01 | DH1 | 112 | ○ | | 100 | 56 | ○ | | 15.6 | 565 | 0.43 |
| T30 | S01 | DH2 | 115 | ○ | | 90 | 58 | Δ | | 17.5 | 575 | 0.44 |
| T31 | S01 | G | | | | 54 | 32 | ○ | ○ | 14.3 | 669 | 0.22 |
| T32 | S01 | E1 | 114 | ○ | ○ | 56 | 30 | ○ | | 19.4 | 572 | 0.23 |
| T33 | S01 | F1 | 114 | ○ | | 52 | 28 | ○ | | 20.1 | 581 | 0.18 |
| T34 | S01 | F2 | 112 | ○ | ○ | 68 | 44 | ○ | | 18.4 | 572 | 0.26 |

TABLE 18

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Amount of Sn in κ Phase (mass %) | Amount of P in κ Phase (mass %) |
|---|---|---|---|---|---|---|---|---|---|---|---|---|---|---|
| T40 | S02 | A1 | 54.3 | 0.8 | 0 | 0 | 99.2 | 100 | 0.8 | 59.7 | 20 | 0 | 0.23 | 0.12 |
| T41 | S02 | A2 | 52.2 | 1.1 | 0 | 0 | 98.9 | 100 | 1.1 | 58.5 | 20 | 0 | 0.23 | 0.12 |
| T42 | S02 | A3 | 52.4 | 1.4 | 0 | 0 | 98.6 | 100 | 1.4 | 59.5 | 28 | 0 | 0.23 | 0.12 |
| T43 | S02 | A4 | 55.0 | 0.9 | 0 | 0 | 99.1 | 100 | 0.9 | 60.7 | 18 | 0 | 0.23 | 0.12 |
| T44 | S02 | A5 | 54.5 | 0.9 | 0 | 0 | 99.1 | 100 | 0.9 | 60.2 | 20 | 1 | 0.23 | 0.12 |
| T45 | S02 | A6 | 54.0 | 1.0 | 0 | 0.5 | 98.5 | 100 | 1.5 | 60.3 | 24 | 8 | 0.23 | 0.12 |
| T46 | S02 | AH1 | 55.6 | 1.6 | 0.5 | 0 | 97.9 | 99.5 | 1.6 | 63.2 | 46 | 0 | 0.21 | 0.12 |
| T47 | S02 | AH2 | 54.3 | 1.3 | 0.9 | 0 | 97.8 | 99.1 | 1.3 | 61.1 | 34 | 0 | 0.22 | 0.12 |
| T48 | S02 | AH3 | 54.0 | 0.9 | 0 | 2.2 | 96.9 | 100 | 3.1 | 60.8 | 24 | 40 or more | 0.24 | 0.12 |
| T49 | S02 | AH4 | 51.3 | 0.7 | 0 | 6.5 | 92.8 | 100 | 7.2 | 59.6 | 24 | 40 or more | 0.24 | 0.13 |
| T50 | S02 | AH5 | Extrusion unable to be performed to the end | | | | | | | | | | | |
| T51 | S02 | B1 | 54.5 | 0.9 | 0 | 0 | 99.1 | 100 | 0.9 | 60.2 | 20 | 1 | 0.23 | 0.12 |
| T52 | S02 | B2 | 54.3 | 0.9 | 0 | 0 | 99.1 | 100 | 0.9 | 60.0 | 20 | 1.5 | 0.23 | 0.12 |
| T53 | S02 | B3 | 54.5 | 0.8 | 0 | 0 | 99.2 | 100 | 0.8 | 59.9 | 16 | 1 | 0.23 | 0.12 |
| T54 | S02 | BH1 | 54.0 | 0.8 | 0 | 0 | 99.2 | 100 | 0.8 | 59.4 | 18 | 0 | 0.23 | 0.12 |
| T55 | S02 | BH2 | 53.2 | 0.7 | 0 | 3.0 | 96.3 | 100 | 3.7 | 59.7 | 20 | 40 or more | 0.24 | 0.12 |
| T56 | S02 | BH3 | 53.3 | 0.8 | 0 | 1.8 | 97.4 | 100 | 2.6 | 59.6 | 20 | 22 | 0.24 | 0.12 |

TABLE 19

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Stress Corrosion Cracking | Impact Value ($J/cm^2$) | Tensile Strength ($N/mm^2$) | 150° C. Creep Strain (%) |
|---|---|---|---|---|---|---|---|---|---|---|---|---|
| T40 | S02 | A1 | 115 | ○ | ○ | 34 | 18 | ○ | | 13.4 | 656 | 0.15 |
| T41 | S02 | A2 | 113 | ○ | | 40 | 22 | | | 12.7 | 651 | 0.19 |
| T42 | S02 | A3 | 115 | ○ | ○ | 60 | 38 | ○ | | 12.0 | 646 | 0.24 |
| T43 | S02 | A4 | 114 | ○ | ○ | 37.8 | 16 | | | 13.1 | 653 | |
| T44 | S02 | A5 | 116 | ○ | | 40 | 22 | ○ | | 13.1 | 657 | 0.20 |
| T45 | S02 | A6 | 116 | ○ | | 56 | 36 | ○ | | 12.3 | 644 | 0.31 |
| T46 | S02 | AH1 | 120 | ○ | | 106 | 60 | Δ | | 11.0 | 642 | 0.50 |
| T47 | S02 | AH2 | 122 | Δ | | 118 | 76 | Δ | | 11.8 | 648 | 0.60 |
| T48 | S02 | AH3 | 115 | ○ | | 108 | 58 | ○ | | 8.8 | 616 | 0.55 |
| T49 | S02 | AH4 | 116 | Δ | | 128 | 92 | Δ | | 5.7 | 543 | 0.68 |
| T50 | S02 | AH5 | Extrusion unable to be performed to the end | | | | | | | | | |
| T51 | S02 | B1 | 114 | ○ | | 36 | 18 | ○ | | 13.1 | 655 | 0.18 |
| T52 | S02 | B2 | 116 | ○ | | 38 | 18 | ○ | | 13.0 | 660 | 0.18 |
| T53 | S02 | B3 | 118 | ○ | | 34 | 14 | | | 13.3 | 658 | |
| T54 | S02 | BH1 | 117 | ○ | | 32 | 16 | | | 13.4 | 656 | 0.13 |
| T55 | S02 | BH2 | 118 | ○ | | 106 | 54 | ○ | | 8.5 | 605 | 0.51 |
| T56 | S02 | BH3 | 117 | ○ | | 94 | 48 | ○ | | 10.5 | 624 | 0.44 |

TABLE 20

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Amount of Sn in κ Phase (mass %) | Amount of P in κ Phase (mass %) |
|---|---|---|---|---|---|---|---|---|---|---|---|---|---|---|
| T57 | S02 | C1 | 53.5 | 1.0 | 0 | 0 | 99.0 | 100 | 1.0 | 59.5 | 22 | 0 | 0.23 | 0.12 |
| T58 | S02 | C2 | 54.0 | 1.4 | 0 | 0 | 98.6 | 100 | 1.4 | 61.1 | 30 | 0 | 0.22 | 0.12 |
| T59 | S02 | CH1 | 52.5 | 1.8 | 0 | 0 | 98.2 | 100 | 1.8 | 60.5 | 50 | 0 | 0.21 | 0.12 |
| T60 | S02 | D1 | 54.5 | 0.8 | 0 | 0 | 99.2 | 100 | 0.8 | 59.9 | 18 | 0 | 0.24 | 0.12 |
| T61 | S02 | D2 | 55.0 | 0.7 | 0 | 0 | 99.3 | 100 | 0.7 | 60.0 | 18 | 0 | 0.24 | 0.12 |
| T62 | S02 | D3 | 56.8 | 0.3 | 0 | 0 | 99.7 | 100 | 0.3 | 60.1 | 14 | 0 | 0.25 | 0.12 |
| T63 | S02 | D4 | 54.8 | 0.8 | 0 | 0 | 99.2 | 100 | 0.8 | 60.2 | 18 | 1 | 0.24 | 0.12 |
| T64 | S02 | D5 | 54.0 | 0.7 | 0 | 0 | 99.3 | 100 | 0.7 | 59.0 | 18 | 3.5 | 0.24 | 0.12 |
| T65 | S02 | D6 | 54.8 | 1.1 | 0 | 0 | 98.9 | 100 | 1.1 | 61.1 | 24 | 0 | 0.23 | 0.12 |
| T66 | S02 | D7 | 54.7 | 0.9 | 0 | 0 | 99.1 | 100 | 0.9 | 60.4 | 22 | 1 | 0.24 | 0.12 |
| T67 | S02 | D8 | 54.3 | 1.3 | 0 | 0 | 98.7 | 100 | 1.3 | 61.1 | 34 | 0 | 0.22 | 0.12 |
| T68 | S02 | DH1 | 54.0 | 0.9 | 0 | 2.2 | 96.9 | 100 | 3.1 | 60.8 | 26 | 28 | 0.24 | 0.12 |
| T69 | S02 | DH2 | 54.3 | 1.2 | 0.3 | 0 | 98.5 | 99.7 | 1.2 | 60.9 | 36 | 0 | 0.23 | 0.12 |
| T70 | S02 | G | 54.5 | 0.9 | 0 | 0 | 99.1 | 100 | 0.9 | 60.2 | 22 | 0 | | 0.12 |
| T71 | S02 | E1 | 53.5 | 1.1 | 0 | 0 | 98.9 | 100 | 1.1 | 59.8 | 26 | 0 | 0.23 | 0.12 |

TABLE 20-continued

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Amount of Sn in κ Phase (mass %) | Amount of P in κ Phase (mass %) |
|---|---|---|---|---|---|---|---|---|---|---|---|---|---|---|
| T72 | S02 | F1 | 54.5 | 0.7 | 0 | 0 | 99.3 | 100 | 0.7 | 59.5 | 22 | 0 | 0.22 | 0.12 |
| T73 | S02 | F2 | 55.0 | 1.3 | 0 | 0 | 98.7 | 100 | 1.3 | 61.8 | 34 | 0 | 0.22 | 0.12 |

TABLE 21

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Stress Corrosion Cracking | Impact Value (J/cm$^2$) | Tensile Strength (N/mm$^2$) | 150° C. Creep Strain (%) |
|---|---|---|---|---|---|---|---|---|---|---|---|---|
| T57 | S02 | C1 | 115 | ○ | ○ | 40 | 22 | ○ | | 15.9 | 593 | 0.18 |
| T58 | S02 | C2 | 115 | ○ | ○ | 52 | 30 | | | 14.9 | 584 | |
| T59 | S02 | CH1 | 112 | ○ | ○ | 106 | 56 | ○ | | 13.8 | 572 | 0.40 |
| T60 | S02 | D1 | 116 | ○ | | 36 | 20 | | | 16.5 | 599 | 0.16 |
| T61 | S02 | D2 | 116 | ○ | | 32 | 18 | ○ | | 16.8 | 601 | 0.15 |
| T62 | S02 | D3 | 115 | ○ | | 28 | 12 | | | 17.9 | 604 | 0.11 |
| T63 | S02 | D4 | 117 | ○ | | 36 | 20 | | | 16.4 | 598 | |
| T64 | S02 | D5 | 115 | ○ | | 40 | 20 | | | 16.5 | 600 | 0.19 |
| T65 | S02 | D6 | 116 | ○ | | 44 | 28 | ○ | | 15.7 | 593 | 0.24 |
| T66 | S02 | D7 | 116 | ○ | | 38 | 24 | | | 16.1 | 598 | |
| T67 | S02 | D8 | 117 | ○ | | 76 | 48 | ○ | | 13.0 | 591 | 0.29 |
| T68 | S02 | DH1 | 116 | ○ | | 92 | 50 | ○ | | 11.8 | 559 | 0.45 |
| T69 | S02 | DH2 | 117 | ○ | | 88 | 46 | ○ | | 12.7 | 592 | 0.44 |
| T70 | S02 | G | | | | 46 | 22 | | ○ | 12.2 | 690 | 0.20 |
| T71 | S02 | E1 | 115 | ○ | ○ | 42 | 28 | ○ | | 15.7 | 593 | 0.18 |
| T72 | S02 | F1 | 116 | ○ | | 34 | 22 | ○ | | 16.8 | 601 | |
| T73 | S02 | F2 | 116 | ○ | ○ | 54 | 34 | ○ | | 15.1 | 591 | 0.25 |

TABLE 22

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Amount of Sn in κ Phase (mass %) | Amount of P in κ Phase (mass %) |
|---|---|---|---|---|---|---|---|---|---|---|---|---|---|---|
| T80 | S03 | A1 | 51.4 | 0.3 | 0 | 0 | 99.7 | 100 | 0.3 | 54.7 | 16 | 0 | 0.11 | 0.10 |
| T81 | S03 | A2 | 50.2 | 0.4 | 0 | 0 | 99.6 | 100 | 0.4 | 54.0 | 18 | 0 | 0.11 | 0.10 |
| T82 | S03 | A3 | 49.8 | 0.6 | 0 | 0 | 99.4 | 100 | 0.6 | 54.4 | 22 | 0 | 0.11 | 0.10 |
| T83 | S03 | A4 | 51.6 | 0.3 | 0 | 0 | 99.7 | 100 | 0.3 | 54.9 | 18 | 0 | 0.11 | 0.10 |
| T84 | S03 | A5 | 51.0 | 0.3 | 0 | 0 | 99.7 | 100 | 0.3 | 54.3 | 18 | 2 | 0.11 | 0.10 |
| T85 | S03 | A6 | 51.0 | 0.4 | 0 | 1.0 | 98.6 | 100 | 1.4 | 55.3 | 24 | 12 | 0.11 | 0.10 |
| T86 | S03 | AH1 | 52.2 | 0.8 | 0.5 | 0 | 98.7 | 99.5 | 0.8 | 57.6 | 36 | 0 | 0.11 | 0.10 |
| T87 | S03 | AH2 | 51.2 | 0.5 | 0.2 | 0 | 99.3 | 99.8 | 0.5 | 55.4 | 30 | 0 | 0.11 | 0.10 |
| T88 | S03 | AH3 | 50.0 | 0.3 | 0 | 1.7 | 98.0 | 100 | 2.0 | 54.1 | 20 | 30 | 0.12 | 0.10 |
| T89 | S03 | AH4 | 48.6 | 0.2 | 0 | 4.8 | 95.0 | 100 | 5.0 | 53.7 | 20 | 40 or more | 0.12 | 0.10 |
| T90 | S03 | AH5 | Extrusion unable to be performed to the end | | | | | | | | | | | |
| T91 | S03 | B1 | 53.0 | 0.3 | 0 | 0 | 99.7 | 100 | 0.3 | 56.3 | 18 | 1 | 0.11 | 0.10 |
| T92 | S03 | B2 | 52.8 | 0.3 | 0 | 0 | 99.7 | 100 | 0.3 | 56.1 | 18 | 1.5 | 0.11 | 0.10 |
| T93 | S03 | B3 | 53.0 | 0.3 | 0 | 0 | 99.7 | 100 | 0.3 | 56.3 | 16 | 0.5 | 0.11 | 0.10 |
| T94 | S03 | BH1 | 52.5 | 0.2 | 0 | 0 | 99.8 | 100 | 0.2 | 55.2 | 14 | 0 | 0.12 | 0.10 |
| T95 | S03 | BH2 | 51.8 | 0.3 | 0 | 1.8 | 97.9 | 100 | 2.1 | 56.0 | 16 | 30 | 0.12 | 0.10 |
| T96 | S03 | BH3 | 52.2 | 0.3 | 0 | 2.2 | 97.5 | 100 | 2.5 | 56.6 | 16 | 25 | 0.12 | 0.10 |

TABLE 23

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Stress Corrosion Cracking | Impact Value (J/cm$^2$) | Tensile Strength (N/mm$^2$) | 150° C. Creep Strain (%) |
|---|---|---|---|---|---|---|---|---|---|---|---|---|
| T80 | S03 | A1 | 116 | ○ | ○ | 34 | 14 | ○ | | 15.5 | 661 | 0.10 |
| T81 | S03 | A2 | 118 | ○ | | 38 | 20 | | | 15.3 | 659 | 0.11 |
| T82 | S03 | A3 | 117 | ○ | ○ | 48 | 28 | | | 14.8 | 655 | |
| T83 | S03 | A4 | 118 | ○ | ○ | 32 | 16 | ○ | | 15.5 | 661 | |
| T84 | S03 | A5 | 116 | ○ | | 50 | 22 | ○ | | 15.4 | 661 | |

TABLE 23-continued

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Stress Corrosion Cracking | Impact Value (J/cm$^2$) | Tensile Strength (N/mm$^2$) | 150° C. Creep Strain (%) |
|---|---|---|---|---|---|---|---|---|---|---|---|---|
| T85 | S03 | A6 | 116 | ○ | | 62 | 36 | ○ | | 13.5 | 641 | |
| T86 | S03 | AH1 | 122 | Δ | | 88 | 58 | Δ | | 14.0 | 652 | |
| T87 | S03 | AH2 | 119 | ○ | | 68 | 46 | | | 14.9 | 657 | 0.30 |
| T88 | S03 | AH3 | 116 | ○ | | 114 | 62 | ○ | | 11.8 | 631 | 0.42 |
| T89 | S03 | AH4 | 117 | ○ | | 140 | 94 | ○ | | 8.4 | 578 | 0.56 |
| T90 | S03 | AH5 | | | | Extrusion unable to be performed to the end | | | | | | |
| T91 | S03 | B1 | 120 | ○ | | 36 | 18 | ○ | | 15.5 | 661 | 0.10 |
| T92 | S03 | B2 | 120 | ○ | | 36 | 18 | | | 15.4 | 664 | |
| T93 | S03 | B3 | 121 | ○ | | 32 | 14 | | | 15.5 | 661 | |
| T94 | S03 | BH1 | 122 | ○ | | 30 | 12 | | | 15.8 | 662 | |
| T95 | S03 | BH2 | 118 | ○ | | 110 | 60 | ○ | | 11.7 | 629 | |
| T96 | S03 | BH3 | 117 | ○ | | 106 | 56 | ○ | | 11.7 | 622 | 0.37 |

TABLE 24

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Amount of Sn in κ Phase (mass %) | Amount of P in κ Phase (mass %) |
|---|---|---|---|---|---|---|---|---|---|---|---|---|---|---|
| T97 | S03 | C1 | 52.0 | 0.4 | 0 | 0 | 99.6 | 100 | 0.4 | 55.8 | 22 | 0 | 0.11 | 0.10 |
| T98 | S03 | C2 | 52.4 | 0.7 | 0 | 0 | 99.3 | 100 | 0.7 | 57.4 | 26 | 0 | 0.11 | 0.10 |
| T99 | S03 | CH1 | 51.2 | 1.0 | 0.3 | 0 | 98.7 | 99.7 | 1.0 | 57.2 | 38 | 0 | 0.11 | 0.10 |
| T100 | S03 | D1 | 53.2 | 0.3 | 0 | 0 | 99.7 | 100 | 0.3 | 56.5 | 18 | 0 | 0.11 | 0.10 |
| T101 | S03 | D2 | 53.4 | 0.2 | 0 | 0 | 99.8 | 100 | 0.2 | 56.1 | 18 | 0 | 0.12 | 0.10 |
| T102 | S03 | D3 | 55.6 | 0.1 | 0 | 0 | 99.9 | 100 | 0.1 | 57.5 | 14 | 0 | 0.11 | 0.09 |
| T103 | S03 | D4 | 53.3 | 0.3 | 0 | 0 | 99.7 | 100 | 0.3 | 56.6 | 18 | 1 | 0.11 | 0.10 |
| T104 | S03 | D5 | 52.6 | 0.3 | 0 | 0 | 99.7 | 100 | 0.3 | 55.9 | 20 | 4 | 0.11 | 0.10 |
| T105 | S03 | D6 | 53.4 | 0.4 | 0 | 0 | 99.6 | 100 | 0.4 | 57.2 | 22 | 0 | 0.11 | 0.10 |
| T106 | S03 | D7 | 53.5 | 0.3 | 0 | 0 | 99.7 | 100 | 0.3 | 56.8 | 20 | 1.5 | 0.11 | 0.10 |
| T107 | S03 | D8 | 53.4 | 0.8 | 0 | 0 | 99.2 | 100 | 0.8 | 58.8 | 24 | 0 | 0.11 | 0.09 |
| T108 | S03 | DH1 | 52.7 | 0.4 | 0 | 1.2 | 98.4 | 100 | 1.6 | 57.1 | 28 | 18 | 0.11 | 0.10 |
| T109 | S03 | DH2 | 51.0 | 0.6 | 0 | 0 | 99.4 | 100 | 0.6 | 55.6 | 34 | 0 | 0.11 | 0.10 |
| T110 | S03 | G | 54.0 | 0.4 | 0 | 0 | 99.6 | 100 | 0.4 | 57.8 | 20 | 0 | | 0.10 |
| T111 | S03 | E1 | 52.6 | 0.6 | 0 | 0 | 99.4 | 100 | 0.6 | 57.2 | 22 | 0 | 0.11 | 0.10 |
| T112 | S03 | F1 | 53.3 | 0.4 | 0 | 0 | 99.6 | 100 | 0.4 | 57.1 | 20 | 0 | 0.11 | 0.10 |
| T113 | S03 | F2 | 53.3 | 0.7 | 0 | 0 | 99.3 | 100 | 0.7 | 58.3 | 30 | 0 | 0.11 | 0.10 |

TABLE 25

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Stress Corrosion Cracking | Impact Value (J/cm$^2$) | Tensile Strength (N/mm$^2$) | 150° C. Creep Strain (%) |
|---|---|---|---|---|---|---|---|---|---|---|---|---|
| T97 | S03 | C1 | 114 | ○ | ○ | 40 | 24 | | | 18.9 | 599 | |
| T98 | S03 | C2 | 115 | ○ | ○ | 48 | 30 | | | 18.0 | 591 | |
| T99 | S03 | CH1 | 118 | ○ | ○ | 90 | 46 | ○ | | 16.8 | 583 | |
| T100 | S03 | D1 | 117 | ○ | | 34 | 20 | ○ | | 19.2 | 604 | 0.10 |
| T101 | S03 | D2 | 116 | ○ | | 32 | 18 | ○ | | 19.5 | 605 | 0.07 |
| T102 | S03 | D3 | 114 | ○ | | 28 | 12 | | | 19.8 | 607 | |
| T103 | S03 | D4 | 116 | ○ | | 44 | 20 | | | 19.1 | 604 | |
| T104 | S03 | D5 | 117 | ○ | | 44 | 26 | | | 18.8 | 604 | 0.13 |
| T105 | S03 | D6 | 116 | ○ | | 40 | 24 | | | 18.9 | 602 | 0.10 |
| T106 | S03 | D7 | 116 | ○ | | 40 | 20 | ○ | | 19.0 | 604 | |
| T107 | S03 | D8 | 114 | ○ | | 54 | 34 | | | 17.7 | 595 | |
| T108 | S03 | DH1 | 118 | ○ | | 82 | 50 | ○ | | 15.9 | 581 | |
| T109 | S03 | DH2 | 116 | ○ | | 68 | 42 | | | 18.3 | 598 | |
| T110 | S03 | G | | | | 50 | 26 | | ○ | 13.9 | 694 | 0.11 |
| T111 | S03 | E1 | 116 | ○ | ○ | 42 | 28 | | | 18.3 | 599 | |
| T112 | S03 | F1 | 118 | ○ | | 38 | 24 | ○ | | 18.9 | 602 | |
| T113 | S03 | F2 | 116 | ○ | ○ | 56 | 36 | ○ | | 18.0 | 597 | 0.17 |

TABLE 26

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Amount of Sn in κ Phase (mass %) | Amount of P in κ Phase (mass %) |
|---|---|---|---|---|---|---|---|---|---|---|---|---|---|---|
| T201 | S11 | E1 | 44.2 | 0.5 | 0 | 0 | 99.5 | 100 | 0.5 | 48.5 | 22 | 0 | 0.08 | 0.08 |
| T202 | S11 | F1 | 44.3 | 0.3 | 0 | 0 | 99.7 | 100 | 0.3 | 47.6 | 18 | 0 | 0.08 | 0.08 |
| T203 | S12 | E1 | 44.7 | 0.9 | 0 | 0 | 99.1 | 100 | 0.9 | 50.5 | 28 | 0 | 0.20 | 0.12 |
| T204 | S12 | F1 | 45.5 | 1.0 | 0 | 0 | 99.0 | 100 | 1.0 | 51.5 | 36 | 0 | 0.20 | 0.11 |
| T205 | S13 | E1 | 67.4 | 0.5 | 0 | 0 | 99.5 | 100 | 0.5 | 71.6 | 20 | 0 | 0.28 | 0.12 |
| T206 | S13 | F1 | 68.3 | 0.5 | 0 | 0 | 99.5 | 100 | 0.5 | 72.5 | 18 | 0 | 0.28 | 0.12 |
| T207 | S14 | E1 | 58.8 | 1.0 | 0 | 0 | 99.0 | 100 | 1.0 | 64.9 | 24 | 0 | 0.25 | 0.13 |
| T208 | S14 | F1 | 59.3 | 0.8 | 0 | 0 | 99.2 | 100 | 0.8 | 64.7 | 22 | 0 | 0.25 | 0.13 |
| T209 | S14 | F2 | 59.2 | 1.1 | 0 | 0 | 98.9 | 100 | 1.1 | 65.5 | 28 | 0 | 0.25 | 0.13 |
| T210 | S15 | E1 | 45.8 | 1.3 | 0 | 0 | 98.7 | 100 | 1.3 | 52.6 | 36 | 0 | 0.14 | 0.11 |
| T211 | S15 | F1 | 46.6 | 1.4 | 0 | 0 | 98.6 | 100 | 1.4 | 53.7 | 38 | 0 | 0.13 | 0.11 |
| T212 | S16 | E1 | 43.8 | 0.9 | 0 | 0 | 99.1 | 100 | 0.9 | 49.4 | 34 | 0 | 0.22 | 0.10 |
| T213 | S17 | E1 | 70.1 | 0.7 | 0 | 0 | 99.3 | 100 | 0.7 | 75.1 | 28 | 0 | 0.16 | 0.14 |
| T214 | S18 | E1 | 43.5 | 1.0 | 0 | 0 | 99.0 | 100 | 1.0 | 49.5 | 36 | 0 | 0.21 | 0.12 |
| T215 | S18 | F1 | 44.6 | 1.2 | 0 | 0 | 98.8 | 100 | 1.2 | 51.2 | 38 | 0 | 0.21 | 0.12 |
| T216 | S18 | F2 | 44.2 | 1.3 | 0 | 0 | 98.7 | 100 | 1.3 | 51.0 | 36 | 0 | 0.21 | 0.12 |
| T217 | S19 | F2 | 44.8 | 1.3 | 0 | 0 | 98.7 | 100 | 1.3 | 51.6 | 32 | 0 | 0.15 | 0.11 |

TABLE 27

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | 150° C. Creep Strain (%) |
|---|---|---|---|---|---|---|---|---|---|---|---|
| T201 | S11 | E1 | 123 | ○ | ○ | 80 | 40 | ○ | 21.0 | 588 | 0.12 |
| T202 | S11 | F1 | 125 | Δ | | 78 | 42 | ○ | 21.8 | 590 | 0.10 |
| T203 | S12 | E1 | 116 | ○ | ○ | 50 | 22 | ○ | 19.3 | 577 | 0.23 |
| T204 | S12 | F1 | 116 | ○ | | 54 | 22 | ○ | 19.3 | 575 | 0.25 |
| T205 | S13 | E1 | 124 | ○ | ○ | 32 | 12 | ○ | 13.1 | 622 | 0.10 |
| T206 | S13 | F1 | | | | 26 | 10 | | 13.0 | 626 | |
| T207 | S14 | E1 | 117 | ○ | ○ | 44 | 22 | ○ | 14.2 | 602 | 0.14 |
| T208 | S14 | F1 | | | | 36 | 20 | ○ | 14.5 | | |
| T209 | S14 | F2 | 118 | ○ | ○ | 46 | 28 | | 14.0 | 602 | 0.16 |
| T210 | S15 | E1 | 115 | ○ | ○ | 68 | 46 | | 19.3 | 572 | 0.24 |
| T211 | S15 | F1 | | | | 70 | 40 | | 18.9 | 570 | |
| T212 | S16 | E1 | 118 | ○ | ○ | 46 | 22 | ○ | 19.3 | 584 | 0.16 |
| T213 | S17 | E1 | 129 | Δ | ○ | 40 | 24 | ○ | 13.2 | 610 | 0.14 |
| T214 | S18 | E1 | 118 | ○ | ○ | 54 | 28 | | 20.3 | 581 | 0.16 |
| T215 | S18 | F1 | 117 | ○ | | 58 | 36 | | 20.0 | 581 | |
| T216 | S18 | F2 | 117 | ○ | ○ | 60 | 38 | | 19.8 | 581 | 0.19 |
| T217 | S19 | F2 | 115 | ○ | ○ | 62 | 34 | ○ | 19.5 | 571 | 0.20 |

TABLE 28

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Amount of Sn in κ Phase (mass %) | Amount of P in κ Phase (mass %) |
|---|---|---|---|---|---|---|---|---|---|---|---|---|---|---|
| T218 | S20 | E1 | 38.8 | 1.8 | 0 | 0 | 98.2 | 100 | 1.8 | 46.8 | 48 | 0 | 0.19 | 0.11 |
| T219 | S20 | F1 | 38.6 | 1.4 | 0 | 0 | 98.6 | 100 | 1.4 | 45.7 | 38 | 0 | 0.19 | 0.11 |
| T220 | S21 | E1 | 53.8 | 0.3 | 0 | 0 | 99.7 | 100 | 0.3 | 57.1 | 24 | 0 | 0.11 | 0.11 |
| T221 | S22 | E1 | 55.0 | 1.7 | 0 | 0 | 98.3 | 100 | 1.7 | 62.9 | 42 | 0 | 0.16 | 0.13 |
| T222 | S23 | E1 | 44.9 | 0.9 | 0 | 0 | 99.1 | 100 | 0.9 | 50.6 | 30 | 0 | 0.11 | 0.09 |
| T223 | S24 | E1 | 43.5 | 1.0 | 0 | 0 | 99.0 | 100 | 1.0 | 49.5 | 32 | 0 | 0.13 | 0.16 |
| T224 | S24 | F1 | 42.8 | 0.8 | 0 | 0 | 99.2 | 100 | 0.8 | 48.2 | 26 | 0 | 0.14 | 0.16 |
| T225 | S24 | F2 | 44.3 | 1.0 | 0 | 0 | 99.0 | 100 | 1.0 | 50.3 | 32 | 0 | 0.13 | 0.15 |
| T226 | S25 | E1 | 65.2 | 1.4 | 0 | 0 | 98.6 | 100 | 1.4 | 72.2 | 44 | 0 | 0.20 | 0.10 |
| T227 | S26 | E1 | 45.3 | 1.0 | 0 | 0 | 99.0 | 100 | 1.0 | 51.3 | 36 | 0 | 0.27 | 0.11 |
| T228 | S27 | E1 | 38.9 | 0.4 | 0 | 0 | 99.6 | 100 | 0.4 | 42.7 | 26 | 0 | 0.08 | 0.11 |
| T229 | S27 | F1 | 39.1 | 0.3 | 0 | 0 | 99.7 | 100 | 0.3 | 42.4 | 22 | 0 | 0.08 | 0.11 |
| T230 | S28 | E1 | 38.6 | 1.9 | 0 | 0 | 98.1 | 100 | 1.9 | 46.9 | 44 | 0 | 0.13 | 0.13 |
| T231 | S29 | E1 | 50.3 | 0.6 | 0 | 0 | 99.4 | 100 | 0.6 | 54.9 | 22 | 0 | 0.13 | 0.14 |
| T232 | S29 | F1 | 51.4 | 0.7 | 0 | 0 | 99.3 | 100 | 0.7 | 56.4 | 26 | 0 | 0.13 | 0.14 |
| T233 | S30 | E1 | 66.8 | 0.2 | 0 | 0 | 99.8 | 100 | 0.2 | 69.5 | 16 | 0 | 0.17 | 0.12 |

TABLE 29

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | 150° C. Creep Strain (%) |
|---|---|---|---|---|---|---|---|---|---|---|---|
| T218 | S20 | E1 | 114 | ○ | ○ | 88 | 46 | ○ | 19.1 | 561 | 0.35 |
| T219 | S20 | F1 | 116 | | | 78 | 40 | | 21.4 | 570 | |
| T220 | S21 | E1 | 118 | ○ | ○ | 50 | 28 | | 18.6 | 601 | 0.13 |
| T221 | S22 | E1 | 112 | ○ | ○ | 86 | 46 | | 15.1 | 574 | 0.30 |
| T222 | S23 | E1 | 119 | ○ | ○ | 68 | 44 | | 21.4 | 576 | 0.17 |
| T223 | S24 | E1 | 116 | ○ | ○ | 60 | 40 | ○ | 21.2 | 574 | |
| T224 | S24 | F1 | | | | 52 | 36 | | 22.3 | 579 | |
| T225 | S24 | F2 | 117 | ○ | ○ | 58 | 40 | ○ | 21.2 | 574 | 0.17 |
| T226 | S25 | E1 | 125 | ○ | Δ | 88 | 42 | ○ | 12.5 | 598 | 0.35 |
| T227 | S26 | E1 | 119 | ○ | ▲ | 64 | 34 | ○ | 17.8 | 585 | 0.25 |
| T228 | S27 | E1 | 128 | Δ | ▲ | 82 | 44 | ○ | 23.9 | 579 | 0.14 |
| T229 | S27 | F1 | 129 | Δ | | 78 | 40 | | 24.7 | | |
| T230 | S28 | E1 | 115 | ○ | ○ | 94 | 46 | ○ | 18.8 | 561 | 0.35 |
| T231 | S29 | E1 | 117 | ○ | ○ | 40 | 22 | | 19.6 | 590 | 0.13 |
| T232 | S29 | F1 | | | | 44 | 26 | | 19.2 | | |
| T233 | S30 | E1 | 123 | ○ | ○ | 24 | 10 | | 13.8 | 625 | 0.10 |

TABLE 30

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Amount of Sn in κ Phase (mass %) | Amount of P in κ Phase (mass %) |
|---|---|---|---|---|---|---|---|---|---|---|---|---|---|---|
| T301 | S51 | E1 | 48.6 | 1.1 | 0 | 0 | 98.9 | 100 | 1.1 | 54.9 | 28 | 0 | 0.22 | 0.11 |
| T302 | S51 | F1 | 49.2 | 1.0 | 0 | 0 | 99.0 | 100 | 1.0 | 55.2 | 26 | 0 | 0.21 | 0.11 |
| T303 | S51 | F2 | 50.4 | 1.2 | 0 | 0 | 98.8 | 100 | 1.2 | 57.0 | 30 | 0 | 0.21 | 0.11 |
| T304 | S52 | E1 | 48.0 | 1.5 | 0 | 0 | 98.5 | 100 | 1.5 | 55.3 | 38 | 0 | 0.14 | 0.10 |
| T305 | S52 | F1 | 48.3 | 1.3 | 0 | 0 | 98.7 | 100 | 1.3 | 55.1 | 32 | 0 | 0.14 | 0.10 |
| T306 | S53 | E1 | 64.8 | 0.6 | 0 | 0 | 99.4 | 100 | 0.6 | 69.4 | 22 | 0 | 0.24 | 0.09 |
| T307 | S53 | F1 | 65.7 | 0.7 | 0 | 0 | 99.3 | 100 | 0.7 | 70.7 | 20 | 0 | 0.24 | 0.09 |
| T308 | S54 | F2 | 66.6 | 0.3 | 0 | 0 | 99.7 | 100 | 0.3 | 69.9 | 14 | 0 | 0.17 | 0.12 |
| T309 | S55 | E1 | 38.6 | 1.7 | 0 | 0 | 98.3 | 100 | 1.7 | 46.4 | 40 | 0 | 0.12 | 0.11 |
| T310 | S55 | F1 | 40.0 | 1.5 | 0 | 0 | 98.5 | 100 | 1.5 | 47.3 | 32 | 0 | 0.12 | 0.11 |
| T311 | S56 | F2 | 48.1 | 1.1 | 0 | 0 | 98.9 | 100 | 1.1 | 54.4 | 30 | 0 | 0.20 | 0.11 |
| T312 | S57 | F2 | 43.8 | 0.7 | 0 | 0 | 99.3 | 100 | 0.7 | 48.8 | 34 | 0 | 0.09 | 0.09 |
| T313 | S58 | E1 | 46.5 | 1.0 | 0 | 0 | 99.0 | 100 | 1.0 | 52.5 | 30 | 0 | 0.13 | 0.11 |
| T314 | S58 | F1 | 47.2 | 0.9 | 0 | 0 | 99.1 | 100 | 0.9 | 52.9 | 26 | 0 | 0.13 | 0.11 |
| T315 | S58 | F2 | 47.8 | 1.1 | 0 | 0 | 98.9 | 100 | 1.1 | 54.1 | 30 | 0 | 0.13 | 0.11 |

TABLE 31

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | 150° C. Creep Strain (%) |
|---|---|---|---|---|---|---|---|---|---|---|---|
| T301 | S51 | E1 | 114 | ○ | ○ | 52 | 36 | | 16.0 | 584 | 0.18 |
| T302 | S51 | F1 | | | | 46 | 30 | | 16.3 | | |
| T303 | S51 | F2 | 115 | ○ | ○ | 52 | 32 | | 16.0 | 584 | |
| T304 | S52 | E1 | 112 | ○ | ○ | 78 | 46 | ○ | 17.3 | 572 | 0.32 |
| T305 | S52 | F1 | | | | 68 | 42 | ○ | 17.3 | 570 | 0.27 |
| T306 | S53 | E1 | 121 | ○ | ○ | 38 | 22 | | 13.4 | 614 | 0.13 |
| T307 | S53 | F1 | | | | 36 | 20 | | 13.2 | | |
| T308 | S54 | F2 | 129 | ○ | ○ | 46 | 28 | | 14.1 | 626 | |
| T309 | S55 | E1 | 114 | ○ | ○ | 86 | 44 | | 19.5 | 562 | 0.33 |
| T310 | S55 | F1 | 116 | ○ | | 76 | 40 | | 20.1 | 561 | |
| T311 | S56 | F2 | 116 | ○ | ○ | 54 | 36 | ○ | 18.2 | 581 | 0.13 |
| T312 | S57 | F2 | 123 | ○ | ○ | 84 | 48 | ○ | 22.3 | 579 | 0.18 |
| T313 | S58 | E1 | 114 | ○ | ○ | 62 | 40 | | 18.8 | 579 | |
| T314 | S58 | F1 | 116 | ○ | | 54 | 34 | ○ | 19.8 | 584 | 0.16 |
| T315 | S58 | F2 | 115 | ○ | ○ | 58 | 40 | ○ | 19.5 | 582 | 0.20 |

TABLE 32

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Amount of Sn in κ Phase (mass %) | Amount of P in κ Phase (mass %) |
|---|---|---|---|---|---|---|---|---|---|---|---|---|---|---|
| T401 | S101 | E1 | 41.8 | 1.4 | 0 | 0 | 98.6 | 100 | 1.4 | 48.9 | 46 | 0 | 0.11 | 0.23 |
| T402 | S101 | F1 | 42.5 | 1.3 | 0 | 0 | 98.7 | 100 | 1.3 | 49.3 | 42 | 0 | 0.11 | 0.23 |
| T403 | S102 | E1 | 51.8 | 1.2 | 0 | 0 | 98.8 | 100 | 1.2 | 58.4 | 38 | 0 | 0.20 | 0.04 |
| T404 | S102 | F1 | 52.5 | 1.3 | 0 | 0 | 98.7 | 100 | 1.3 | 59.3 | 34 | 0 | 0.19 | 0.04 |
| T405 | S103 | E1 | 52.0 | 3.3 | 0 | 0 | 96.7 | 100 | 3.3 | 62.9 | 86 | 0 | 0.30 | 0.12 |
| T406 | S103 | F1 | 52.0 | 3.0 | 0 | 0 | 97.0 | 100 | 3.0 | 62.4 | 64 | 0 | 0.31 | 0.12 |
| T407 | S103 | F2 | 52.0 | 3.4 | 0 | 0 | 96.6 | 100 | 3.4 | 63.1 | 70 | 0 | 0.29 | 0.12 |
| T408 | S104-1 | F2 | 41.0 | 3.9 | 0 | 0 | 96.1 | 100 | 3.9 | 52.8 | 92 | 0 | 0.28 | 0.12 |
| T409 | S104-2 | E1 | 32.7 | 4.5 | 0 | 0 | 95.5 | 100 | 4.5 | 45.4 | 110 | 0 | 0.19 | 0.10 |
| T410 | S104-2 | F1 | 34.0 | 3.6 | 0 | 0 | 96.4 | 100 | 3.6 | 45.4 | 82 | 0 | 0.21 | 0.10 |
| T411 | S105 | E1 | 38.2 | 1.2 | 0 | 0 | 98.8 | 100 | 1.2 | 44.8 | 38 | 0 | 0.07 | 0.10 |
| T412 | S105 | F1 | 39.3 | 1.1 | 0 | 0 | 98.9 | 100 | 1.1 | 45.6 | 34 | 0 | 0.07 | 0.10 |
| T413 | S106 | E1 | 65.0 | 3.0 | 0 | 0 | 97.0 | 100 | 3.0 | 75.4 | 84 | 0 | 0.22 | 0.11 |
| T414 | S106 | F1 | 66.7 | 2.7 | 0 | 0 | 97.3 | 100 | 2.7 | 76.6 | 56 | 0 | 0.23 | 0.11 |
| T415 | S106 | F2 | 66.7 | 2.9 | 0 | 0 | 97.1 | 100 | 2.9 | 76.9 | 60 | 0 | 0.22 | 0.11 |
| T416 | S107 | E1 | 50.0 | 5.3 | 3.0 | 0 | 91.7 | 97.0 | 5.3 | 63.8 | 140 | 0 | 0.15 | 0.15 |
| T417 | S108 | E1 | 26.8 | 3.5 | 0 | 0 | 96.5 | 100 | 3.5 | 38.0 | 86 | 0 | 0.15 | 0.12 |
| T418 | S109 | E1 | 33.8 | 4.6 | 0 | 0 | 95.4 | 100 | 4.6 | 46.7 | 124 | 0 | 0.10 | 0.13 |
| T419 | S110 | E1 | 42.3 | 0.1 | 0 | 0 | 99.9 | 100 | 0.1 | 44.2 | 28 | 0 | 0.05 | 0.04 |
| T420 | S110 | F1 | 41.7 | 0.2 | 0 | 0 | 99.8 | 100 | 0.2 | 44.4 | 30 | 0 | 0.05 | 0.04 |
| T421 | S111 | E1(*1) | 40.2 | 1.0 | 0 | 3 | 96.0 | 100 | 4.0 | 47.7 | 58 | 40 or more | 0.22 | 0.11 |
| T422 | S112 | E1 | 33.3 | 3.5 | 0 | 0 | 96.5 | 100 | 3.5 | 44.5 | 106 | 0 | 0.23 | 0.09 |
| T423 | S113 | E1 | 70.7 | 0.1 | 0 | 0 | 99.9 | 100 | 0.1 | 72.6 | 24 | 0 | 0.12 | 0.09 |

TABLE 33

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | 150° C. Creep Strain (%) |
|---|---|---|---|---|---|---|---|---|---|---|---|
| T401 | S101 | E1 | 125 | ○ | ○ | 78 | 46 | ○ | 11.5 | 558 | 0.35 |
| T402 | S101 | F1 | 124 | ○ | | 72 | 38 | ○ | 11.9 | 557 | 0.33 |
| T403 | S102 | E1 | 115 | ○ | ○ | 104 | 58 | Δ | 16.1 | 586 | |
| T404 | S102 | F1 | 116 | ○ | | 100 | 52 | ○ | 15.7 | 585 | 0.17 |
| T405 | S103 | E1 | 109 | ○ | ○ | 124 | 74 | ○ | 10.0 | 540 | 0.52 |
| T406 | S103 | F1 | | | | 112 | 70 | | 11.0 | | |
| T407 | S103 | F2 | | | | 116 | 76 | | 10.5 | | |
| T408 | S104-1 | F2 | 108 | ○ | ○ | 122 | 80 | ○ | 12.9 | 522 | 0.50 |
| T409 | S104-2 | E1 | 109 | ○ | ○ | 130 | 98 | ○ | 13.8 | 490 | 0.57 |
| T410 | S104-2 | F1 | | | | 116 | 76 | | 14.9 | 500 | |
| T411 | S105 | E1 | 126 | Δ | ○ | 98 | 68 | | 21.7 | 543 | |
| T412 | S105 | F1 | 123 | ○ | | 92 | 64 | | 22.0 | 540 | 0.40 |
| T413 | S106 | E1 | 116 | ○ | Δ | 114 | 76 | Δ | 9.1 | 552 | 0.75 |
| T414 | S106 | F1 | | | | 108 | 70 | ○ | 9.8 | | |
| T415 | S106 | F2 | | | | 110 | 72 | | | | |
| T416 | S107 | E1 | 105 | ○ | Δ | 160 | 128 | X | 5.5 | 488 | 1.20 |
| T417 | S108 | E1 | 122 | ○ | ○ | 110 | 70 | Δ | | | |
| T418 | S109 | E1 | 107 | ○ | ○ | 140 | 116 | Δ | 13.9 | 488 | 0.64 |
| T419 | S110 | E1 | 126 | Δ | ○ | 102 | 70 | ○ | 23.6 | 575 | 0.25 |
| T420 | 5110 | F1 | 127 | Δ | | 104 | 66 | | 24.0 | 574 | |
| T421 | S111 | E1(*1) | | | | 128 | 80 | | | | |
| T422 | S112 | E1 | 116 | ○ | ○ | 110 | 80 | ○ | 17.5 | 524 | |
| T423 | S113 | E1 | 137 | X | ▲ | 62 | 36 | | 13.4 | 574 | |

TABLE 34

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Amount of Sn in κ Phase (mass %) | Amount of P in κ Phase (mass %) |
|---|---|---|---|---|---|---|---|---|---|---|---|---|---|---|
| T424 | S114 | E1(*2) | 22.5 | 0.8 | 0 | 1.5 | 97.7 | 100 | 2.3 | 28.6 | 48 | 20 | 0.12 | 0.14 |
| T425 | S115 | E1 | 44.3 | 0.9 | 0 | 0 | 99.1 | 100 | 1.1 | 50.0 | 38 | 0 | 0.05 | 0.10 |
| T427 | S116 | E1 | 47.0 | 0.9 | 0 | 0 | 99.1 | 100 | 0.9 | 52.7 | 40 | 0 | 0.11 | 0.05 |
| T428 | S116 | F1 | 48.8 | 0.8 | 0 | 0 | 99.2 | 100 | 0.9 | 54.2 | 34 | 0 | 0.11 | 0.05 |
| T429 | S117 | E1 | 50.8 | 0.1 | 0 | 0 | 99.9 | 100 | 0.1 | 52.7 | 20 | 0 | 0.05 | 0.09 |

TABLE 34-continued

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Amount of Sn in κ Phase (mass %) | Amount of P in κ Phase (mass %) |
|---|---|---|---|---|---|---|---|---|---|---|---|---|---|---|
| T430 | S118 | E1 | 40.1 | 0.5 | 0 | 0 | 99.5 | 100 | 0.5 | 44.3 | 46 | 0 | 0.14 | 0.10 |
| T431 | S119 | E1 | 55.4 | 3.7 | 7.0 | 0 | 89.3 | 93.0 | 3.7 | 66.9 | 82 | 0 | 0.15 | 0.12 |
| T432 | S119 | F1(*3) | 54.6 | 3.4 | 8.5 | 0 | 88.1 | 91.5 | 3.4 | 65.7 | 62 | 0 | 0.15 | 0.12 |
| T433 | S120 | E1(*2) | 81.8 | 0.2 | 0 | 0 | 99.8 | 100 | 0.2 | 84.5 | 18 | 0 | 0.19 | 0.09 |
| T434 | S121 | E1 | 73.8 | 0.0 | 0 | 2.2 | 97.8 | 100 | 2.2 | 74.9 | 0 | 30 | 0.13 | 0.09 |
| T435 | S122 | E1 | 22.1 | 3.8 | 0 | 0 | 96.2 | 100 | 3.8 | 33.8 | 92 | 0 | 0.15 | 0.09 |
| T436 | S122 | F1 | 23.8 | 3.4 | 0 | 0 | 96.6 | 100 | 3.4 | 34.9 | 78 | 0 | 0.15 | 0.08 |
| T437 | S123 | E1 | 29.5 | 3.7 | 0 | 0 | 96.3 | 100 | 3.7 | 41.0 | 72 | 0 | 0.15 | 0.12 |
| T438 | S123 | F1 | 31.2 | 3.3 | 0 | 0 | 96.7 | 100 | 3.3 | 42.1 | 56 | 0 | 0.15 | 0.12 |
| T439 | S123 | F2 | 30.8 | 3.4 | 0 | 0 | 96.6 | 100 | 3.4 | 41.9 | 68 | 0 | 0.15 | 0.12 |
| T440 | S124 | E1 | 31.5 | 1.5 | 0 | 0 | 98.5 | 100 | 1.5 | 38.8 | 50 | 0 | 0.12 | 0.12 |
| T441 | S125 | E1 | 42.1 | 2.9 | 0 | 0 | 97.1 | 100 | 2.9 | 52.3 | 56 | 0 | 0.11 | 0.12 |
| T442 | S126 | E1 | 42.0 | 4.2 | 0 | 0 | 95.8 | 100 | 4.2 | 54.3 | 76 | 0 | 0.31 | 0.12 |
| T443 | S126 | F1 | 43.5 | 4.4 | 0 | 0 | 95.6 | 100 | 4.4 | 56.1 | 80 | 0 | 0.31 | 0.12 |
| T444 | S127 | E1 | 32.8 | 4.8 | 0 | 0 | 95.2 | 100 | 4.8 | 45.9 | 88 | 0 | 0.31 | 0.13 |
| T445 | S128 | E1(*2) | 37.4 | 1.3 | 0 | 1.5 | 97.2 | 100 | 2.8 | 45.0 | 52 | 20 | 0.12 | 0.12 |
| T446 | S129 | E1 | 54.8 | 1.9 | 2.0 | 0 | 96.1 | 98.0 | 1.9 | 63.1 | 56 | 0 | 0.12 | 0.11 |
| T447 | S130 | E1 | 28.7 | 5.9 | 0 | 0 | 94.1 | 100 | 2.7 | 43.3 | 150 or more | 0 | 0.07 | 0.12 |

TABLE 35

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | 150° C. Creep Strain (%) |
|---|---|---|---|---|---|---|---|---|---|---|---|
| T424 | S114 | E1(*2) | 140 | X | ▲ | 114 | 80 | ○ | 37.0 | 512 | 0.45 |
| T425 | S115 | E1 | 124 | ○ | ○ | 106 | 52 | ○ | 21.1 | 570 | 0.16 |
| T427 | S116 | E1 | 119 | ○ | ○ | 96 | 58 | ○ | 18.6 | 580 | 0.19 |
| T428 | S116 | F1 | | | | 94 | 52 | | | | |
| T429 | S117 | E1 | 131 | Δ | ○ | 88 | 58 | ○ | 17.4 | 601 | 0.12 |
| T430 | S118 | E1 | 130 | Δ | ▲ | 80 | 52 | ○ | 21.8 | 582 | 0.11 |
| T431 | S119 | E1 | 114 | ○ | Δ | 168 | 140 | X | 9.7 | 551 | 1.50 |
| T432 | S119 | F1(*3) | | | | 196 | 152 | X | | | |
| T433 | 3120 | E1(*2) | 153 | X | X | 54 | 22 | | 9.3 | 638 | |
| T434 | S121 | E1 | 142 | Δ | ▲ | 96 | 50 | ○ | 11.0 | 614 | 0.35 |
| T435 | S122 | E1 | 127 | Δ | ▲ | 118 | 78 | ○ | 28.8 | 518 | 0.47 |
| T436 | 3122 | F1 | | | | 110 | 70 | | | | |
| T437 | S123 | E1 | 118 | ○ | ○ | 114 | 78 | | 24.0 | 524 | |
| T438 | S123 | F1 | 117 | ○ | | 106 | 74 | | 22.1 | 524 | |
| T439 | 3123 | F2 | 117 | ○ | ○ | 108 | 72 | | 22.9 | 524 | 0.41 |
| T440 | S124 | E1 | 127 | Δ | ○ | 100 | 66 | | 28.8 | 545 | 0.44 |
| T441 | 3125 | E1 | 108 | ○ | ○ | 124 | 84 | | 15.4 | 539 | 0.46 |
| T442 | 3126 | E1 | 105 | ○ | ○ | 108 | 76 | ○ | 10.4 | 522 | 0.60 |
| T443 | S126 | F1 | 104 | ○ | | 110 | 78 | | 10.0 | | |
| T444 | 3127 | E1 | 108 | ○ | ○ | 112 | 80 | ○ | 11.2 | 498 | 0.62 |
| T445 | S128 | E1(*2) | 123 | ○ | ▲ | 102 | 66 | ○ | 17.2 | 539 | 0.40 |
| T446 | S129 | E1 | 110 | ○ | Δ | 124 | 80 | Δ | 11.6 | 547 | 0.55 |
| T447 | S130 | E1 | 111 | ○ | ○ | 164 | 130 | | 13.0 | 518 | 0.42 |

TABLE 36

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Amount of Sn in κ Phase (mass %) | Amount of P in κ Phase (mass %) |
|---|---|---|---|---|---|---|---|---|---|---|---|---|---|---|
| T501 | S131 | E1 | 10.2 | 10.8 | 0 | 0 | 89.2 | 100 | 10.8 | 29.9 | 100 | 0 | 0.17 | 0.12 |
| T502 | S131 | F1 | 10.9 | 10.1 | 0 | 0 | 89.9 | 100 | 10.1 | 30.0 | 120 | 0 | 0.17 | 0.12 |
| T503 | S132 | E1 | 5.0 | 16.2 | 3.0 | 0 | 80.8 | 97.0 | 16.2 | 29.1 | 150 or more | 0 | 0.05 | 0.10 |
| T504 | S132 | F1 | 5.5 | 16.5 | 3.5 | 0 | 80.0 | 96.5 | 16.5 | 29.9 | 150 or more | 0 | 0.05 | 0.10 |
| T505 | S133 | E1 | 42.8 | 0 | 0 | 0 | 100 | 100 | 0 | 42.8 | 0 | 0 | 0 | 0 |
| T506 | S134 | E1 | 0 | 14.0 | 5.0 | 0 | 81.0 | 95.0 | 14.0 | 22.4 | 150 or more | 0 | 0 | 0.13 |

TABLE 36-continued

| Test No. | Alloy No. | Step No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Amount of Sn in κ Phase (mass %) | Amount of P in κ Phase (mass %) |
|---|---|---|---|---|---|---|---|---|---|---|---|---|---|---|
| T507 | S135 | E1 | 0 | 16.0 | 0 | 0 | 84.0 | 100 | 16.0 | 24.0 | 150 or more | 0 | 0 | 0.15 |
| T508 | S135 | F1 | 0 | 17.2 | 0 | 0 | 82.8 | 100 | 17.2 | 24.9 | 150 or more | 0 | 0 | 0.15 |
| T509 | S136 | E1 | 35.1 | 1.7 | 0 | 0 | 98.3 | 100 | 1.7 | 42.9 | 64 | 0 | 0.14 | 0.07 |
| T510 | S136 | F2 | 35.9 | 1.9 | 0 | 0 | 98.1 | 100 | 1.9 | 44.2 | 70 | 0 | 0.14 | 0.07 |
| T511 | S137 | E1 | 24.8 | 3.9 | 0 | 0 | 96.1 | 100 | 3.9 | 36.6 | 94 | 0 | 0.11 | 0.07 |
| T512 | S137 | F1 | 25.6 | 4.1 | 0 | 0 | 95.9 | 100 | 4.1 | 37.7 | 96 | 0 | 0.11 | 0.07 |
| T513 | S138 | E1 | 20.1 | 4.4 | 0 | 0 | 95.6 | 100 | 4.4 | 32.7 | 100 | 0 | 0.07 | 0.08 |
| T514 | S138 | F1 | 20.8 | 4.6 | 0 | 0 | 95.4 | 100 | 4.6 | 33.7 | 108 | 0 | 0.07 | 0.08 |

TABLE 37

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) | Impact Value (J/cm$^2$) | Tensile Strength (N/mm$^2$) | 150° C. Creep Strain (%) |
|---|---|---|---|---|---|---|---|---|---|---|---|
| T501 | S131 | E1 | 115 | ○ | ○ | 146 | 130 | Δ | 5.0 | 448 | 1.00 |
| T502 | S131 | F1 | | | | 148 | 122 | | | | |
| T503 | S132 | E1 | 112 | ○ | ○ | 180 | 148 | X | 5.1 | 452 | 1.44 |
| T504 | S132 | F1 | 111 | ○ | | 186 | 152 | X | | | |
| T505 | S133 | E1 | 132 | Δ | ○ | 96 | 58 | Δ | 23.8 | 582 | 0.12 |
| T506 | S134 | E1 | 118 | ○ | Δ | 138 | 170 | X | 4.6 | 465 | 1.50 |
| T507 | S135 | E1 | 118 | ○ | ○ | 190 | 150 | Δ | 6.4 | 453 | 1.25 |
| T508 | S135 | F1 | 117 | ○ | | 188 | 146 | Δ | | | |
| T509 | S136 | E1 | 132 | Δ | ○ | 102 | 64 | | 12.6 | 536 | 0.52 |
| T510 | S136 | F2 | | | | 104 | 70 | | | | |
| T511 | S137 | E1 | 129 | Δ | ○ | 146 | 112 | | 12.9 | 495 | 0.64 |
| T512 | S137 | F1 | | | | 150 | 118 | | 12.7 | | |
| T513 | S138 | E1 | 130 | Δ | ○ | 158 | 122 | ○ | 13.4 | 470 | 0.60 |
| T514 | S138 | F1 | 131 | Δ | | 160 | 128 | ○ | 13.1 | 466 | 0.60 |

The above-described experiment results are summarized as follows.

1) It was able to be verified that, by satisfying the composition according to the embodiment, the composition relational expressions f0, f1, and f2, the requirements of the metallographic structure, and the metallographic structure relational expressions f3, f4, f5, and f6, excellent machinability can be obtained with addition of a small amount of Pb, and a hot extruded material or a hot forged material having excellent hot workability and excellent corrosion resistance in a harsh environment and stress corrosion cracking resistance and having high strength and excellent impact resistance and high temperature properties can be obtained (an example in which any one of Steps No. A1 to A6, B1 to B3, C1, C2, D1 to D7, E1, E2 F1, F2, and G was performed any one of Alloys No. S12 to S30, S51 to S58, and S105).

2) It was able to be verified that addition of Sb and As further improves corrosion resistance under harsh conditions (Alloys No. S51 to S58).

3) It was able to be verified that the cutting resistance further deteriorates due to addition of Bi (Alloys No. S52 and S55).

4) When the Cu content was low, the amount of γ phase increased, and machinability was excellent. However, corrosion resistance, impact resistance, and high temperature properties deteriorated. Conversely, when the Cu content was high, machinability and hot workability deteriorated. In addition, impact resistance deteriorated (Alloys No. 5107, 5109, 5120, 5125, 5131, 5132, 5134, and S135). When the Cu content was 77.5 mass % to 80.0 mass %, the properties were further improved.

5) When the Sn content was higher than 0.28 mass %, the area ratio of γ phase was higher than 2.0%. Therefore, machinability was excellent, but corrosion resistance, impact resistance, and high temperature properties deteriorated (Alloys S103, S104, S126, S127, S131, and S135). On the other hand, when the Sn content was lower than 0.07 mass %, the dezincification corrosion depth in a harsh environment was large (Alloys No. S110, S115, S117, S133, and S134). When the Sn content was 0.08 mass % to 0.25 mass %, the properties were further improved.

6) When the P content was high, impact resistance deteriorated. In addition, cutting resistance was slightly high (Alloy No. S101). On the other hand, when the P content was low, the dezincification corrosion depth in a harsh environment was large (Alloys No. S102, S110, S116, S133, and S138).

7) It was able to be verified that, even if inevitable impurities are contained to the extent contained in alloys manufactured in the actual production, there is not much influence on the properties (Alloys No. S01, S02, and S03). It is presumed that, when Fe was added such that the content thereof was outside of the composition according to the embodiment, or was the composition of the boundary value but higher than the limit of the inevitable impurities, an intermetallic compound of Fe and Si or Fe and P was formed. As a result, the Si concentration or the P concentration in the effective range decreased, corrosion resistance deteriorated, and machinability slightly deteriorated due to the formation of the intermetallic compound (Alloys No. S136, S137, and S138).

8) When the value of the composition relational expression f0 was low, the dezincification corrosion depth in a harsh environment was large, and cutting resistance was slightly high (Alloys No. S11, S110, 5115, S117, S133, and S134). When the value of the composition relational expression f0 was high, the amount of γ phase increased, and dezincification corrosion resistance, impact resistance, and high temperature properties deteriorated (Alloys No. S103, S104, S106 to S108, S112, S122, S123, S126, S127, S131, S132, and S135).

9) When the value of the composition relational expression f1 was low, the amount of γ phase increased, and machinability was excellent. However, corrosion resistance, impact resistance, and high temperature properties deteriorated (Alloys No. S103, S104, S107 to S109, S112, S122, S123, S125 to S127, S131, S132, S134, S135, S137, and S138). When the value of the composition relational expression f1 was high, the amount of κ phase increased, and machinability, hot workability, and impact resistance deteriorated (Alloy No. S121).

10) When the value of the composition relational expression f2 was low, the amount of γ phase increased, β phase appeared in some cases, and machinability was excellent. However, high-temperature hot workability, corrosion resistance, impact resistance, and high temperature properties deteriorated (Alloys No. S106, S107, S119, S129, S132, and S134). When the value of the composition relational expression f2 was high, hot workability deteriorated, and there was a problem in hot extrusion. In addition, machinability and impact resistance deteriorated (Alloys No. S114, S118, S122, and S128).

11) When the area ratio of γ phase in the metallographic structure was higher than 2.0%, or when the length of the long side of γ phase was longer than 50 μm, machinability was excellent, but corrosion resistance, impact resistance, and high temperature properties deteriorated. In particular, when the amount of γ phase was large, selective corrosion of γ phase occurred in the dezincification corrosion test in a harsh environment (Tests No. T20, T405 to T410, T413 to T418, T422, T431, T432, T435 to T439, T441 to T444, T501 to T504, and T506 to T514).

When the area ratio of μ phase was higher than 2%, corrosion resistance, impact resistance, high temperature properties, and strength index deteriorated. In the dezincification corrosion test in a harsh environment, grain boundary corrosion or selective corrosion of μ phase occurred (Tests No. T48, T49, T55, T68, T89, T96, T421, and T434).

When the area ratio of β phase was higher than 0.5%, corrosion resistance, impact resistance, and high temperature properties deteriorated (Tests No. T08, T47, T416, T431, T432, T503, T504, and T506).

When the area ratio of κ phase was higher than 72%, machinability, impact resistance, and hot workability deteriorated (Tests No. T433 and T434). On the other hand, when the area ratio of κ phase was lower than 36%, machinability deteriorated (Tests No. T417, T424, T435, T440, T509, T511, T513, and T514).

12) When the metallographic structure relational expression f5 was 3.0% or lower, corrosion resistance, impact resistance, and high temperature properties were improved (Alloys No. S01, S02, S03, S14, and S103).

When the value of the metallographic structure relational expression $f5=(\gamma)+(\mu)$ was higher than 3%, or when the value of $f3=(\alpha)+(\kappa)$ was lower than 96.5%, corrosion resistance, impact resistance, and high temperature properties deteriorated (Tests No. T10, T16, T17, T48, T49, T55, T68, T89, T405, T407 to T410, T416, T418, T421, T422, T431, T432, T435, T442 to T444, T446, T501 to T504, T506 to T508, and T511 to T514).

When the value of the metallographic structure relational expression $f6=(\kappa)+6\times(\gamma)^{1/2}+0.5\times(\mu)$ was higher than 80 or was lower than 38, machinability deteriorated (Tests No. T424, T433, T435, T511 to T513, and T514).

In cases where the value of f6 was lower than 38, when the area ratio of γ phase was 2.0 or higher, cutting resistance was low, and the shapes of many chips were excellent (for example, Alloys No. S103, S104, and S106 to S109).

13) When the amount of Sn in κ phase is lower than 0.08 mass %, the dezincification corrosion depth in a harsh environment was large, and the corrosion of κ phase occurred. In addition, cutting resistance was also slightly high (for example, Alloys No. S105, S110, and S115 and Tests No. T411, T412, T419, T420, T425, T429, T503 to T506, T513, and T514).

When the proportion of γ phase was high, the amount of Sn in κ phase was less than the amount of Sn in the alloy (Alloys No. S221, S104, S122, and S123). It was verified that stress corrosion cracking resistance was excellent (Tests No. T31, T70, and T110).

Even in cases where the area ratio of γ phase was about 0.1% to about 1.0%, by adjusting the area ratio of κ phase to be 36% or higher, adding 0.022% to 0.20% of Pb, and adjusting the Sn concentration in κ phase to be 0.08 mass % or higher, excellent machinability can be secured, and excellent corrosion resistance and high temperature properties and high strength can be obtained (Alloys No. S01, S16, and S29).

14) When the amount of P in κ phase is lower than 0.07 mass %, the dezincification corrosion depth in a harsh environment was large, and the corrosion of κ phase occurred (for example, Alloys No. S102, S110, and S116 and Tests No. T403, T404, T419, T420, T427, T428, and T505).

15) As long as the requirements of the composition and the requirements of the metallographic structure were satisfied, the tensile strength was 560 $N/mm^2$ or higher, and the creep strain after holding the material at 150° C. for 100 hours in a state where a load corresponding to 0.2% proof stress at room temperature was applied was 0.4% or lower. In substantially all the alloys satisfying the requirements of the composition and the requirements of the metallographic structure, the tensile strength was 570 $N/mm^2$ or higher, the creep strain after holding the material at 150° C. for 100 hours was 0.3% or lower, and excellent strength and high temperature properties were obtained.

As long as the requirements of the composition and the requirements of the metallographic structure were satisfied, the Charpy impact test value of the U-notched specimen was 12 $J/cm^2$ or higher. When the length of the long side of μ phase that was not able to be observed at a microscopic magnification was long, impact resistance and high temperature properties deteriorated (Alloy No. S01, Steps No. A5 and D5, and Tests No. T09, T10, T16, T17, T48, T49, T55, T68, T88, and T89).

16) In the evaluation of the materials using the mass-production facility and the materials prepared in the laboratory, substantially the same results were obtained (Alloys No. S01 and S02 and Steps No. C1, C2, E1, and F1).

17) Regarding manufacturing conditions, it was able to be verified that, by performing each of the steps under the following conditions, a hot extruded material or a hot forged material having excellent corrosion resistance in a harsh environment and stress corrosion cracking resistance and having excellent impact resistance and high temperature properties can be obtained (Alloy No. S01 and Steps No. A1 to A6 and D1 to D8).

(Conditions) Hot working is performed at a hot working temperature of 600° C. to 740° C., and cooling is performed after hot working in a temperature range from 470° C. to 380° C. at an average cooling rate of 2.5° C./min to 500° C./min. Preferably, hot working is performed at a hot working temperature of 600° C. to 690° C., and cooling is performed after hot working in a temperature range from 470° C. to 380° C. at an average cooling rate of 4° C./min to 300° C./min. More preferably, hot working is performed at a hot working temperature of 605° C. to 645° C., and cooling is performed after hot working in a temperature range from 470° C. to 380° C. at an average cooling rate of 8° C./min to 200° C./min.

When the hot extrusion temperature was low, the proportion of γ phase was low, the length of the long side of γ phase was short, and corrosion resistance, impact resistance, tensile strength, and high temperature properties were excellent (Steps No. A1 and A3).

When the cooling rate in a temperature range from 470° C. to 380° C. after hot working was high, the proportion of μ phase was low, the length of the long side of μ phase was short, and corrosion resistance, impact resistance, tensile strength, and high temperature properties were excellent (Steps No. A1 and A6).

When the hot extrusion temperature of the extruded material was low, the proportion of γ phase after hot forging was low, and the length of the long side of γ phase was short (Steps No. D1 and D8).

When the average cooling rate in a temperature range from 575° C. to 510° C. after hot forging was 1.5° C./min, the proportion of γ phase after hot forging was low, and the length of the long side of γ phase was short (Step No. D3).

Even when the continuously cast rod was used as a material for hot forging, excellent properties were obtained (Step No. F2).

18) When low-temperature annealing was performed under the following conditions after cold working or hot working, a cold worked material or a hot worked material having excellent corrosion resistance in a harsh environment and having excellent impact resistance and high temperature properties was obtained (Alloy No. S01 and Steps No. B1 to B3).

(Conditions) Heating is performed at a temperature of 240° C. to 350° C. for 10 minutes to 300 minutes, and the relation of $150 \leq (T-220) \times (t)^{1/2} \leq 1200$, wherein the heating temperature is represented by T° C. and the heating time is represented by t min, is satisfied.

19) When Step No. AH5 was performed on Alloys No. S01 to S03, extrusion was not able to be finished due to their high deformation resistance. Therefore, the subsequent evaluation was stopped.

In addition, in Step No. BH1, straightness was not corrected sufficiently, and low-temperature annealing was not performed appropriately, and there was a problem in quality.

20) In Alloy No. S111, flaky defects were formed on the extruded surface. Therefore, the evaluation of the corrosion resistance was performed, but the other evaluations were stopped.

In Alloys No. S114, S120, and S128, flaky defects were formed on the extruded surface. However, the defects were removed, and the subsequent evaluation was performed.

In Alloy No. S119, side surface cracking occurred during hot forging. Therefore, the subsequent evaluation was performed except for the cracked portions.

Regarding the evaluation results of the dezincification corrosion test 3 (dezincification corrosion test according to ISO 6509), an alloy including 3% or higher of β phase or 10% or higher of γ phase was evaluated as poor, and an alloy including 3% to 5% of γ phase was evaluated as fair or good. This shows that the corrosion environments (dezincification corrosion test 1 and 2) used in the embodiment simulated a harsh environment. The dezincification corrosion test 3 (dezincification corrosion test according to ISO 6509) was a test simulating a general corrosion environment, and it is difficult to determine dezincification corrosion in a harsh corrosion environment.

As described above, in the alloy according to the embodiment in which the contents of the respective additive elements, the respective composition relational expressions, the metallographic structure, and the respective metallographic structure relational expressions are in the appropriate ranges, hot workability (hot extrusion, hot forging) is excellent, and corrosion resistance and machinability are also excellent. In addition, the alloy according to the embodiment can obtain excellent properties by adjusting the manufacturing conditions in hot extrusion and hot forging so that they fall in the appropriate ranges.

Example 2

Regarding an alloy according to Comparative Example of the embodiment, a Cu—Zn—Si copper alloy casting (Test No. T601/Alloy No. S201) which had been used in a harsh water environment for 8 years was prepared. There was no detailed data on the water quality of the environment where the casting had been used and the like. Using the same method as in Example 1, the composition and the metallographic structure of Test No. T601 were analyzed. In addition, a corroded state of a cross-section was observed using the metallographic microscope. Specifically, the sample was embedded in a phenol resin material such that the exposed surface was maintained to be perpendicular to the longitudinal direction. Next, the sample was cut such that a cross-section of a corroded portion was obtained as the longest cut portion. Next, the sample was polished. The cross-section was observed using the metallographic microscope. In addition, the maximum corrosion depth was measured.

Next, a similar alloy casting was prepared with the same composition and under the same preparation conditions of Test No. T601 (Test No. T602/Alloy No. S202). Regarding the similar alloy casting (Test No. T602), the analysis of the composition and the metallographic structure, the evaluation (measurement) of the mechanical properties and the like, and the dezincification corrosion tests 1 to 3 were performed as described in Example 1. By comparing the corrosion of Test No. T601 which developed in actual water environment and that of Test No. T602 in the accelerated tests of the dezincification corrosion tests 1 to 3 to each other, the appropriateness of the accelerated tests of the dezincification corrosion tests 1 to 3 was verified.

In addition, by comparing the evaluation result (corroded state) of the dezincification corrosion test 1 of the alloy according to the embodiment described in Example 1 (Test No. T01/Alloy No. S01/Step No. A1) and the corroded state of Test No. T601 or the evaluation result (corroded state) of the dezincification corrosion test 1 of Test No. T602 to each other, the corrosion resistance of Test No. T01 was examined.

Test No. T602 was prepared using the following method.

Raw materials were dissolved to obtain substantially the same composition as that of Test No. T601 (Alloy No.

S201), and the melt was cast into a mold having an inner diameter ϕ of 40 mm at a casting temperature of 1000° C. to prepare a casting. Next, the casting was cooled in the temperature range of 575° C. to 510° C. at an average cooling rate of about 20° C./min, and subsequently was cooled in the temperature range from 470° C. to 380° C. at an average cooling rate of about 15° C./min. As a result, a sample of Test No. T602 was prepared.

The analysis method of the composition and the metallographic structure, the measurement method of the mechanical properties and the like, and the methods of the dezincification corrosion tests 1 to 3 were as described in Example 1.

Figure 2:
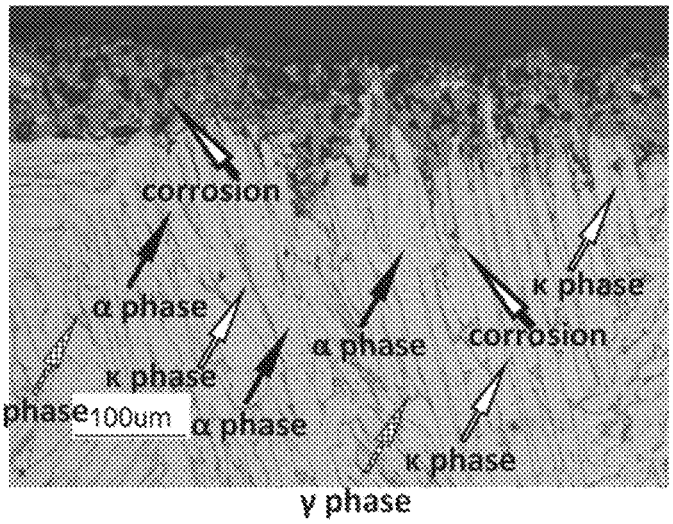
FIG. 2A is a metallographic micrograph of a cross-section of Test No. T601 according to Example 2 after use in a harsh water environment for 8 years.
FIG. 2B is a metallographic micrograph of a cross-section of Test No. T602 after a dezincification corrosion test 1.
FIG. 2C is a metallographic micrograph of a cross-section of Test No. T01 after the dezincification corrosion test 1.
Figure 2:
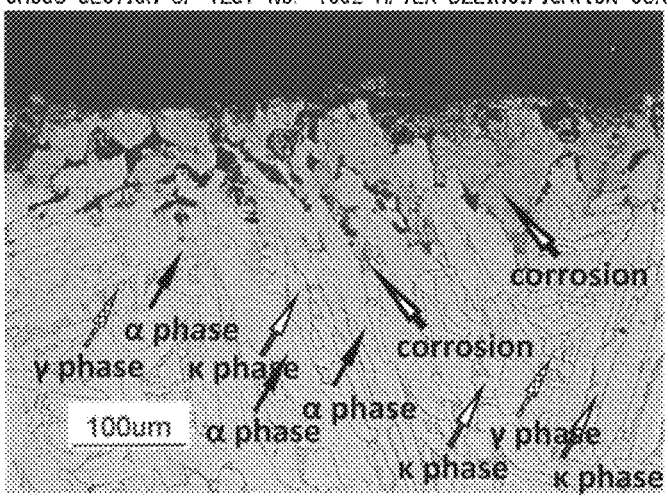
Figure 2:
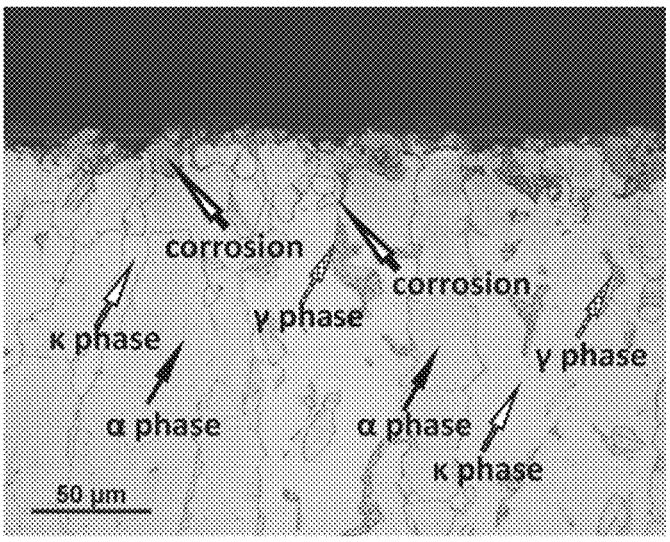

The obtained results are shown in Tables 38 to 40 and FIGS. 2A to 2C.

TABLE 38

| Alloy | Component Composition (mass %) | | | | | | | Composition Relational Expression | | |
|---|---|---|---|---|---|---|---|---|---|---|
| No. | Cu | Si | Pb | Sn | P | Others | Zn | f0 | f1 | f2 |
| S201 | 75.4 | 3.01 | 0.037 | 0.01 | 0.04 | Fe: 0.02, Ni: 0.01, Ag: 0.02 | Balance | 0.34 | 77.8 | 62.7 |
| S202 | 75.4 | 3.01 | 0.033 | 0.01 | 0.04 | Fe: 0.02, Ni: 0.02, Ag: 0.02 | Balance | 0.34 | 77.8 | 62.7 |

TABLE 39

| Test No. | Alloy No. | κ Phase Area Ratio (%) | γ Phase Area Ratio (%) | β Phase Area Ratio (%) | μ Phase Area Ratio (%) | f3 | f4 | f5 | f6 | Length of Long side of γ Phase (μm) | Length of Long side of μ Phase (μm) | Amount of Sn in κ Phase (mass %) | Amount of P in κ Phase (mass %) |
|---|---|---|---|---|---|---|---|---|---|---|---|---|---|
| T601 | S201 | 27.4 | 3.9 | 0 | 0 | 96.1 | 100 | 3.9 | 39.2 | 110 | 0 | 0.01 | 0.06 |
| T602 | S202 | 28.0 | 3.8 | 0 | 0 | 96.2 | 100 | 3.8 | 39.7 | 120 | 0 | 0.01 | 0.06 |

TABLE 40

| Test No. | Alloy No. | Maximum Corrosion Depth (μm) | Corrosion Test 1 (μm) | Corrosion Test 2 (μm) | Corrosion Test 3 (ISO 6509) |
|---|---|---|---|---|---|
| T601 | S201 | 138 | | | |
| T602 | S202 | | 146 | 102 | ○ |

In the copper alloy casting used in a harsh water environment for 8 years (Test No. T601), at least the contents of Sn and P were out of the ranges of the embodiment.

FIG. 2A shows a metallographic micrograph of the cross-section of Test No. T601.

Test No. T601 was used in a harsh water environment for 8 years, and the maximum corrosion depth of corrosion caused by the use environment was 138 μm.

In a surface of a corroded portion, dezincification corrosion occurred irrespective of whether it was α phase or κ phase (average depth of about 100 μm from the surface).

In the corroded portion where α phase and κ phase were corroded, more solid α phase was present at deeper locations.

The corrosion depth of α phase and κ phase was uneven without being uniform. Roughly, corrosion occurred only in γ phase from a boundary portion of α phase and κ phase to the inside (a depth of about 40 μm from the corroded boundary between α phase and κ phase towards the inside: local corrosion of only γ phase).

FIG. 2B shows a metallographic micrograph of a cross-section of Test No. T602 after the dezincification corrosion test 1.

The maximum corrosion depth was 146 μm

In a surface of a corroded portion, dezincification corrosion occurred irrespective of whether it was α phase or κ phase (average depth of about 100 μm from the surface).

In the corroded portion, more solid α phase was present at deeper locations.

The corrosion depth of α phase and κ phase was uneven without being uniform. Roughly, corrosion occurred only in γ phase from a boundary portion of α phase and κ phase to the inside (the length of corrosion that locally occurred only to γ phase from the corroded boundary between α phase and κ phase was about 45 μm).

It was found that the corrosion shown in FIG. 2A occurred in the harsh water environment for 8 years and the corrosion shown in FIG. 2B occurred in the dezincification corrosion test 1 were substantially the same in terms of corrosion form. In addition, because the amount of Sn and the amount of P did not fall within the ranges of the embodiment, both α phase and κ phase were corroded in a portion in contact with water or the test solution, and γ phase was selectively corroded here and there at deepest point of the corroded portion. The Sn concentration and the P concentration in κ phase were low.

The maximum corrosion depth of Test No. T601 was slightly less than the maximum corrosion depth of Test No. T602 in the dezincification corrosion test 1. However, the maximum corrosion depth of Test No. T601 was slightly more than the maximum corrosion depth of Test No. T602 in the dezincification corrosion test 2. Although the degree of corrosion in the actual water environment is affected by the water quality, the results of the dezincification corrosion tests 1 and 2 substantially matched the corrosion result in the actual water environment regarding both corrosion form and corrosion depth. Accordingly, it was found that the conditions of the dezincification corrosion tests 1 and 2 are appropriate and the evaluation results obtained in the dezincification corrosion tests 1 and 2 are substantially the same as the corrosion result in the actual water environment.

In addition, the acceleration rates of the accelerated tests of the dezincification corrosion tests 1 and 2 substantially matched that of the corrosion in the actual harsh water environment. This presumably shows that the dezincification corrosion tests 1 and 2 simulated a harsh environment.

The result of Test No. T602 in the dezincification corrosion test 3 (the dezincification corrosion test according to ISO6509) was "○" (good). Therefore, the result of the dezincification corrosion test 3 did not match the corrosion result in the actual water environment.

The test time of the dezincification corrosion test 1 was 2 months, and the dezincification corrosion test 1 was an about 75 to 100 times accelerated test. The test time of the dezincification corrosion test 2 was 3 months, and the dezincification corrosion test 2 was an about 30 to 50 times accelerated test. On the other hand, the test time of the dezincification corrosion test 3 (dezincification corrosion test according to ISO 6509) was 24 hours, and the dezincification corrosion test 3 was an about 1000 times or more accelerated test.

It is presumed that, by performing the test for a long period of time of 2 or 3 months using the test solution close to the actual water environment as in the dezincification corrosion tests 1 and 2, substantially the same evaluation results as the corrosion result in the actual water environment were obtained.

In particular, in the corrosion result of Test No. T601 in the harsh water environment for 8 years, or in the corrosion results of Test No. T602 in the dezincification corrosion tests 1 and 2, not only α phase and κ phase on the surface but also γ phase were corroded. However, in the corrosion result of the dezincification corrosion test (dezincification corrosion test according to ISO 6509), substantially no γ phase was corroded. Therefore, it is presumed that, in the dezincification corrosion test 3 (dezincification corrosion test according to ISO 6509), the corrosion of α phase and κ phase on the surface and the corrosion of γ phase were not able to be appropriately evaluated, and the evaluation result did not match the corrosion result in the actual water environment.

FIG. 2C shows a metallographic micrograph of a cross-section of Test No. T01 (Alloy No. S01/Step No. A1) after the dezincification corrosion test 1.

In the vicinity of the surface, about 60% of γ phase and κ phase exposed to the surface were corroded. However, the remaining κ phase and α phase were solid (were not corroded). The maximum corrosion depth was about 20 μm. Further, about 20 μm-deep selective corrosion of γ phase occurred toward the inside. It is presumed that the length of the long side of γ phase is one of the large factors that determine the corrosion depth.

In can be seen that, in the Test No. T01 of the embodiment shown in FIG. 2C, the corrosion of α phase and κ phase in the vicinity of the surface was significantly suppressed as compared to Tests No. T601 and T602 shown in FIGS. 2A and 2B. It is presumed that the progress of the corrosion was delayed by the aforementioned suppression. From the observation result of the corrosion form, the main reason why the corrosion of α phase and κ phase in the vicinity of the surface was significantly suppressed is presumed to be improved κ phase' corrosion resistance by Sn that is contained in κ phase.

INDUSTRIAL APPLICABILITY

The free-cutting copper alloy according to the present invention has excellent hot workability (hot extrudability and hot forgeability) and excellent corrosion resistance and machinability. Therefore, the free-cutting copper alloy according to the present invention is suitable in devices such as faucets, valves, or fittings for drinking water consumed by a person or an animal every day, in members for electrical uses, automobiles, machines and industrial plumbing such as valves, or fittings, or in devices and components that come in contact with liquid.

Specifically, the free-cutting copper alloy according to the present invention is suitable to be applied as a material that composes faucet fittings, water mixing faucet fittings, drainage fittings, faucet bodies, water heater components, EcoCute components, hose fittings, sprinklers, water meters, water shut-off valves, fire hydrants, hose nipples, water supply and drainage cocks, pumps, headers, pressure reducing valves, valve seats, gate valves, valves, valve stems, unions, flanges, branch faucets, water faucet valves, ball valves, various other valves, and fittings for plumbing, through which drinking water, drained water, or industrial water flows, for example, components called elbows, sockets, bends, connectors, adaptors, tees, or joints.

In addition, the free-cutting copper alloy according to the present invention is suitable in solenoid valves, control valves, various valves, radiator components, oil cooler components, cylinders, and is suitable in mechanical components used as automobile components, for example, pipe fittings, valves, valve stems, heat exchanger components, water supply and drainage cocks, cylinders, or pumps, and is suitable in industrial pipe members, for example, pipe fittings, valves, or valve stems.

The invention claimed is:

1. A free-cutting copper alloy comprising:

higher than 77.0 mass % and lower than 81.0 mass % of Cu;

higher than 3.4 mass % and lower than 4.1 mass % of Si;

0.07 mass % to 0.28 mass % of Sn;

0.06 mass % to 0.14 mass % of P;

higher than 0.02 mass % and lower than 0.25 mass % of Pb; and a balance including Zn and inevitable impurities, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$1.0 \le f0 = 100 \times [Sn]/([Cu]+[Si]+0.5\times[Pb]+0.5\times[P]-75.5) \le 3.7,$$

$$78.5 \le f1 = [Cu]+0.8\times[Si]-8.5\times[Sn]+[P]+0.5\times[Pb] \le 83.0, \text{ and}$$

$$61.8 \le f2 = [Cu]-4.2\times[Si]-0.5\times[Sn]-2\times[P] \le 63.7$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$36 \le (\kappa) \le 72,$$

$$0 \le (\gamma) \le 2.0,$$

$$0 \le (\beta) \le 0.5,$$

$$0 \le (\mu) \le 2.0,$$

$$96.5 \le f3 = (\alpha)+(\kappa),$$

$99.4 \leq f4 = (\alpha)+(\kappa)+(\gamma)+(\mu)$, $0 \leq f5 = (\gamma)+(\mu) \leq 3.0$, and $38 \leq f6 = (\kappa)+6\times(\gamma)^{1/2}+0.5\times(\mu) \leq 80$ are satisfied, the length of the long side of γ phase is 50 μm or less, and the length of the long side of μ phase is 25 μm or less, wherein an amount of Sn in K phase is 0.08 mass % to 0.45 mass %, and an amount of P in K phase is 0.07 mass % to 0.22 mass %.

2. The free-cutting copper alloy according to claim 1, further comprising:

one or more element(s) selected from the group consisting of higher than 0.02 mass % and lower than 0.08 mass % of Sb, higher than 0.02 mass % and lower than 0.08 mass % of As, and higher than 0.02 mass % and lower than 0.30 mass % of Bi.

3. A free-cutting copper alloy comprising:

77.5 mass % to 80.0 mass % of Cu;

3.45 mass % to 3.95 mass % of Si;

0.08 mass % to 0.25 mass % of Sn;

0.06 mass % to 0.13 mass % of P;

0.022 mass % to 0.20 mass % of Pb; and a balance including Zn and inevitable impurities, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $1.1 \leq f0 = 100\times[Sn]/([Cu]+[Si]+0.5\times[Pb]+0.5\times[P]-75.5) \leq 3.4$, $78.8 \leq f1 = [Cu]+0.8\times[Si]-8.5\times[Sn]+[P]+0.5\times[Pb] \leq 81.7$, and $62.0 \leq f2 = [Cu]-4.2\times[Si]-0.5\times[Sn]-2\times[P] \leq 63.5$ are satisfied, in constituent phases of metallographic structure, when an area ratio of a phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $40 \leq (\kappa) \leq 67$, $0 \leq (\gamma) \leq 1.5$, $0 \leq (\beta) \leq 0.5$, $0 \leq (\mu) \leq 1.0$, $97.5 \leq f3 = (\alpha)+(\kappa)$, $99.6 \leq f4 = (\alpha)+(\kappa)+(\gamma)+(\mu)$, $0 \leq f5 = (\gamma)+(\mu) \leq 2.0$, and $42 \leq f6 = (\kappa)+6\times(\gamma)^{1/2}+0.5\times(\mu) \leq 72$ are satisfied, the length of the long side of γ phase is 40 μm or less, and the length of the long side of μ phase is 15 μm or less, wherein an amount of Sn in K phase is 0.08 mass % to 0.45 mass %, and an amount of P in K phase is 0.07 mass % to 0.22 mass %.

4. The free-cutting copper alloy according to claim 3, further comprising:

one or more element(s) selected from the group consisting of higher than 0.02 mass % and lower than 0.07 mass % of Sb, higher than 0.02 mass % and lower than 0.07 mass % of As, and higher than 0.02 mass % and lower than 0.20 mass % of Bi.

5. The free-cutting copper alloy according to claim 1, wherein a total amount of Fe, Mn, Co, and Cr as the inevitable impurities is lower than 0.08 mass %.

6. The free-cutting copper alloy according to claim 1, that is made into a hot-worked material, wherein a Charpy impact test value is 12 J/cm$^2$ or higher, a tensile strength is 560 N/mm$^2$ or higher, and a creep strain after holding the material at 150° C. for 100 hours in a state where a load corresponding to 0.2% proof stress at room temperature is applied is 0.4% or lower.

7. The free-cutting copper alloy according to claim 1, that is used in a device for water supply, an industrial plumbing member, or a device that comes in contact with liquid.

8. A method of manufacturing the free-cutting copper alloy according to claim 1, the method comprising:

a hot working step, wherein the material's temperature during hot working is 600° C. to 740° C., and the material is cooled in a temperature range from 470° C. to 380° C. at an average cooling rate of 2.5° C./min to 500° C./min.

9. A method of manufacturing the free-cutting copper alloy according to claim 1, the method comprising:

any one or both of a cold working step and a hot working step; and a low-temperature annealing step that is performed after the cold working step or the hot working step, wherein in the low-temperature annealing step, conditions are as follows:

the material's temperature is in a range of 240° C. to 350° C., the heating time is in a range of 10 minutes to 300 minutes, and when the material's temperature is represented by T° C. and the heating time is represented by t min, $150 \leq (T-220)\times(t)^{1/2} \leq 1200$ is satisfied.

* * * * *